US010826241B2

(12) United States Patent
Ito

(10) Patent No.: US 10,826,241 B2
(45) **Date of Patent: *Nov. 3, 2020**

(54) CONNECTOR AND CONNECTOR TERMINAL TO BE USED IN THE CONNECTOR

(71) Applicant: PANASONIC INTELLECTUAL PROPERTY MANAGEMENT CO., LTD., Osaka (JP)

(72) Inventor: Chikara Ito, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/394,713

(22) Filed: Apr. 25, 2019

(65) Prior Publication Data

US 2019/0334286 A1 Oct. 31, 2019

(30) Foreign Application Priority Data

Apr. 27, 2018 (JP) ..... 2018-087652
Nov. 26, 2018 (JP) ..... 2018-220463

(51) Int. Cl.
*H01R 13/639* (2006.01)
*H01R 12/79* (2011.01)
(Continued)

(52) U.S. Cl.
CPC ..... *H01R 13/639* (2013.01); *H01R 12/79* (2013.01); *H01R 13/42* (2013.01); *H01R 13/6272* (2013.01)

(58) Field of Classification Search
CPC .. H01R 13/639; H01R 13/42; H01R 13/6272; H01R 12/79
See application file for complete search history.

(56) References Cited

U.S. PATENT DOCUMENTS 5,910,027 A * 6/1999 Wayt ..... H01R 13/641 439/352
10,193,255 B2 * 1/2019 Ito ..... H01R 12/7005
(Continued)

FOREIGN PATENT DOCUMENTS

JP 2017-152273 A 8/2017
WO WO-2016088308 A1 * 6/2016 ..... H01R 12/78

OTHER PUBLICATIONS

U.S. Appl. No. 16/394,808 to Chikara Ito, which was filed on Apr. 25, 2019.

(Continued)

*Primary Examiner* — Abdullah A Riyami
*Assistant Examiner* — Nader J Alhawamdeh
(74) *Attorney, Agent, or Firm* — Greenblum & Bernstein, P.L.C.

(57) ABSTRACT

A connector set includes: a first connector having a first housing; a second connector having a second housing; and a slide member slidably held in one of the housing. The slide member includes a slide lock mechanism to interfere with a slide restrictor formed on the one housing to restrict sliding of the slide member to a second position in a state where the first housing and the second housing are not fitted together. The slide restrictor is formed on the housing main body of the one housing.

11 Claims, 45 Drawing Sheets

(51) Int. Cl.
*H01R 13/42* (2006.01)
*H01R 13/627* (2006.01)

(56) References Cited

U.S. PATENT DOCUMENTS

| | | | | |
|---|---|---|---|---|
| 2017/0250501 | A1* | 8/2017 | Endo | H01R 13/6271 |
| 2019/0334286 | A1* | 10/2019 | Ito | H01R 13/6272 |
| 2019/0334287 | A1* | 10/2019 | Ito | H01R 13/6272 |

OTHER PUBLICATIONS

U.S. Appl. No. 16/394,866 to Chikara Ito, which was filed on Apr. 25, 2019.
U.S. Appl. No. 16/394,761 to Chikara Ito, which was filed on Apr. 25, 2019.

* cited by examiner

CONNECTOR AND CONNECTOR TERMINAL TO BE USED IN THE CONNECTOR

CROSS REFERENCE TO RELATED APPLICATIONS

This application is based upon and claims the benefit of priority from prior Japanese Patent Applications No. 2018-087652 filed on Apr. 27, 2018 and No. 2018-220463 filed on Nov. 26, 2018; the entire contents of which are incorporated by reference herein.

BACKGROUND OF THE INVENTION

The present disclosure relates to a connector set and a connector.

A connector set including a first connector and a second connector has heretofore been known as shown in Japanese Patent Application Publication No. 2017-152273 (hereinafter referred to as Patent Literature 1). This connector set is configured to allow a first housing of the first connector and a second housing of the second connector to be fitted together to bring a first terminal housed in the first housing and a second terminal housed in the second housing in conduction with each other.

In Patent Literature 1, an elastically deformable lever part formed on the first housing is locked to a locked part formed on the second housing to lock the first connector and the second connector in a fitted state.

In addition, the connector set disclosed in Patent Literature 1 further includes a slide member slidably held in the first housing.

This slide member is slidably attached to the first housing such that in a state where the first housing has not been completely fitted to the second housing yet, the slide movement of the slide member from a first position to a second position is restricted. The slide member is also configured such that once the first housing is completely fitted to the second housing, the slide movement from the first position to the second position is then allowed. This configuration makes it possible to check the completion of the fitting between the first housing and the second housing from the sliding of the slide member from the first position to the second position.

As described above, Patent Literature 1 discloses the connector set that has a connector position assurance (CPA) function.

SUMMARY OF THE INVENTION

However, the above-described conventional technique restricts the slide movement from the first position to the second position by locking a protrusion formed on the slide member to a locked part formed on the lever part. For this reason, there is a risk that the slide movement from the first position to the second position is accidentally allowed due to the lever part elastically deforming in a state where the first housing has not been completely fitted to the second housing yet.

In this way, if the slide member moves to the second position with the fitting not completed yet, it is impossible to accurately check the completion of the fitting between the first housing and the second housing.

In view of this, an object of the present disclosure is achieve a connector set and a connector that make it possible to more surely check the completion of the fitting between a first housing and a second housing.

A connector set according to the present disclosure includes: a first connector having a first housing and a first terminal held in the first housing; a second connector having a second housing to be fitted to the first housing, and a second terminal held in the second housing and to come in conduction with the first terminal in a state where the first housing and the second housing are fitted together; and a slide member held in one housing out of the first housing and the second housing to be slidable between a first position and a second position. In addition, the first housing includes: a first housing main body holding the first terminal; and a lever part provided continuously on the first housing main body and to move relative to the first housing main body. In addition, the second housing includes: a second housing main body holding the second terminal; and an engaging part to be engaged with the lever part in a state where the first housing and the second housing are fitted together and to maintain the fitting between the first housing and the second housing. In addition, the slide member includes a slide lock mechanism to interfere with a slide restrictor formed on the one housing, so that sliding of the slide member to the second position is restricted, in a state where the first housing and the second housing are not fitted together, and to release the interference with the slide restrictor, so that the sliding of the slide member to the second position is allowed, in the state where the first housing and the second housing are fitted together. Then, the slide restrictor is formed on the housing main body of the one housing.

In addition, a connector according to the present disclosure includes: a housing in which the slide member is held to be slidable between a first position and a second position; and a terminal held in the housing.

According to the present disclosure, a connector set and a connector that make it possible to more surely check the completion of the fitting between a first housing and a second housing can be achieved.

DESCRIPTION OF THE EMBODIMENTS

With reference to the drawings, an embodiment of the present disclosure is described in detail below. The following description is given of a plug connector 1 mounted on a cable 1A and a receptacle connector 2 mounted on a circuit board 2A.

Note that, as for the plug connector 1 and the receptacle connector 2, description is given assuming that a direction perpendicular to (normal to) a mounting surface of a mounting member in a state where each of the connectors is mounted on the mounting member is a top-bottom direction (Z direction). Also, description is given assuming that a direction in which terminals housed in a housing of each connector are arranged is a width direction (Y direction) and a direction in which the terminals are inserted into the housing of each connector is a front-rear direction (X direction).

Furthermore, the top side in a state where the connector mounted on the mounting member is located on the upper side of the mounting surface is defined as the top of the top-bottom direction, while the side on which the connectors face each other when fitted together is defined as the front of the front-rear direction.

[Configuration Example of Connector Set]

Figure 1:
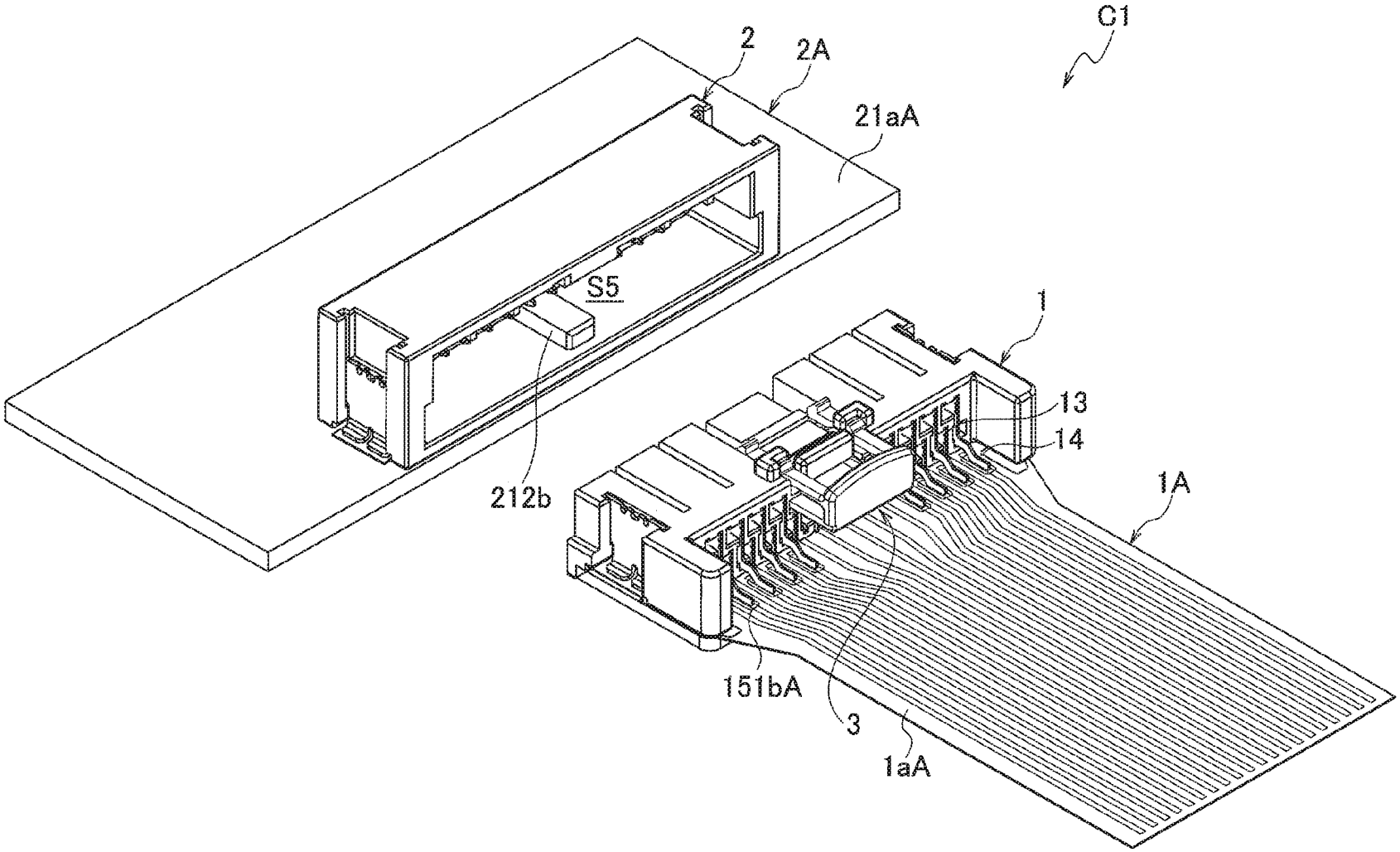
FIG. 1 is an exploded perspective view showing an example of a connector set including a plug connector mounted on a cable and temporarily holding a slide member and a receptacle connector mounted on a circuit board.
Figure 2:
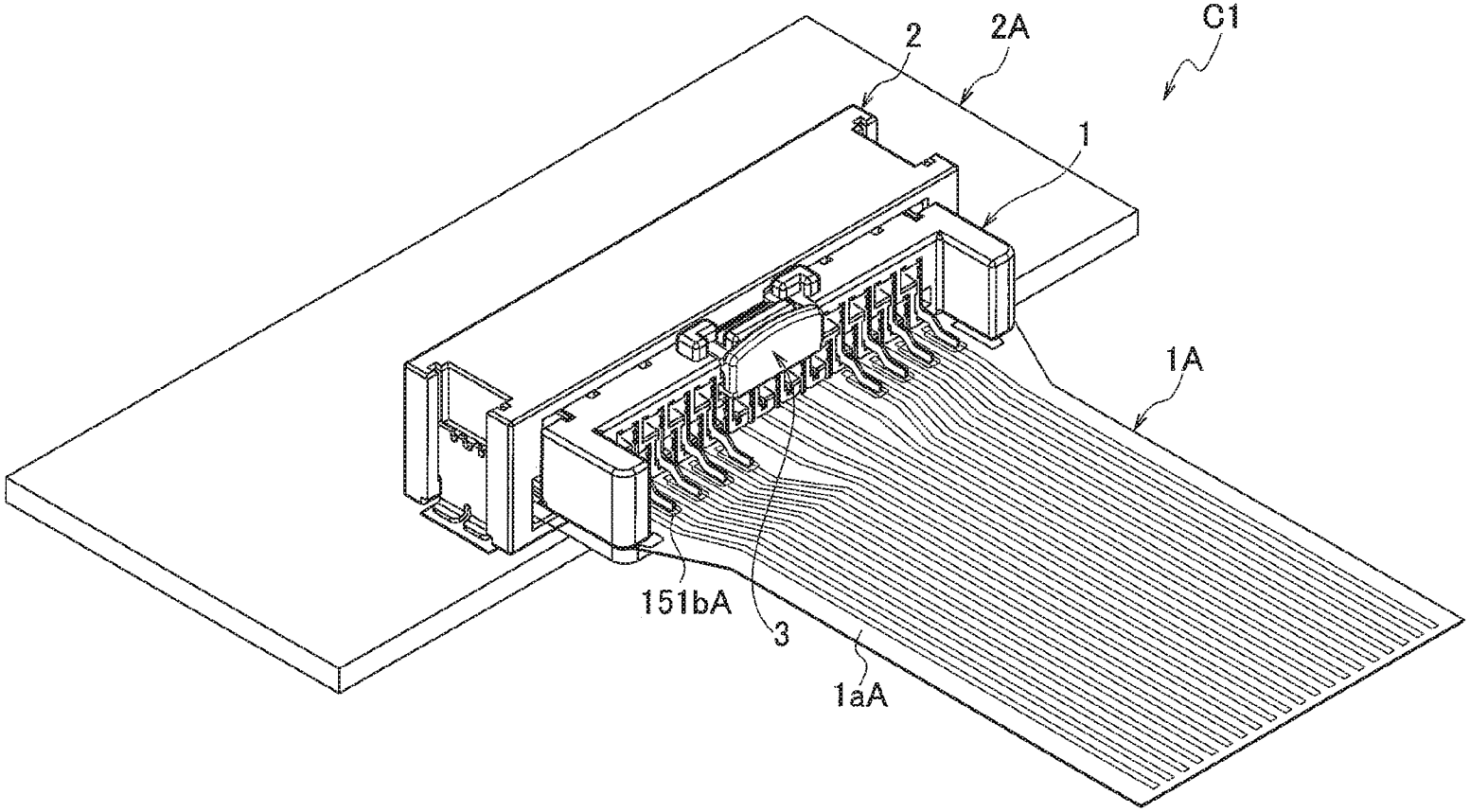
FIG. 2 is a perspective view showing an example of the connector set in a state where the plug connector mounted on the cable and the receptacle connector mounted on the circuit board are fitted together and locked with the slide member.

The plug connector (first connector: connector) 1 according to this embodiment is used for a connector set C1 shown in FIGS. 1 to 3 and the like.

The connector set C1 includes a receptacle connector (second connector) 2 to which the plug connector 1 described above is fitted, as shown in FIG. 1 and FIG. 2.

In this embodiment, the plug connector 1 is formed to be mountable on the cable (mounting member: connecting member) 1A such as an FPC and an FFC. More specifically, the plug connector 1 is configured to be mounted on the cable 1A by electrically connecting (mounting) plug terminals (first terminals) 13 and 14 included in the plug connector 1 to a conductor part 151*b*A of the cable 1A.

Meanwhile, the receptacle connector 2 is formed to be mountable on the circuit board (mounting member) 2A. More specifically, the receptacle connector 2 is configured to be mounted on the circuit board 2A by electrically connecting (mounting) receptacle terminals (second terminals) 23 and 24 included in the receptacle connector 2 to a conductor part 2*b*A of the circuit board 2A.

Thus, the connector set C1 electrically connects the cable 1A to the circuit board 2A by fitting the plug connector 1 into the receptacle connector 2 to achieve conduction between the plug terminals 13 and 14 and the receptacle terminals 23 and 24 (see FIG. 2 and FIG. 3).

Figure 4:
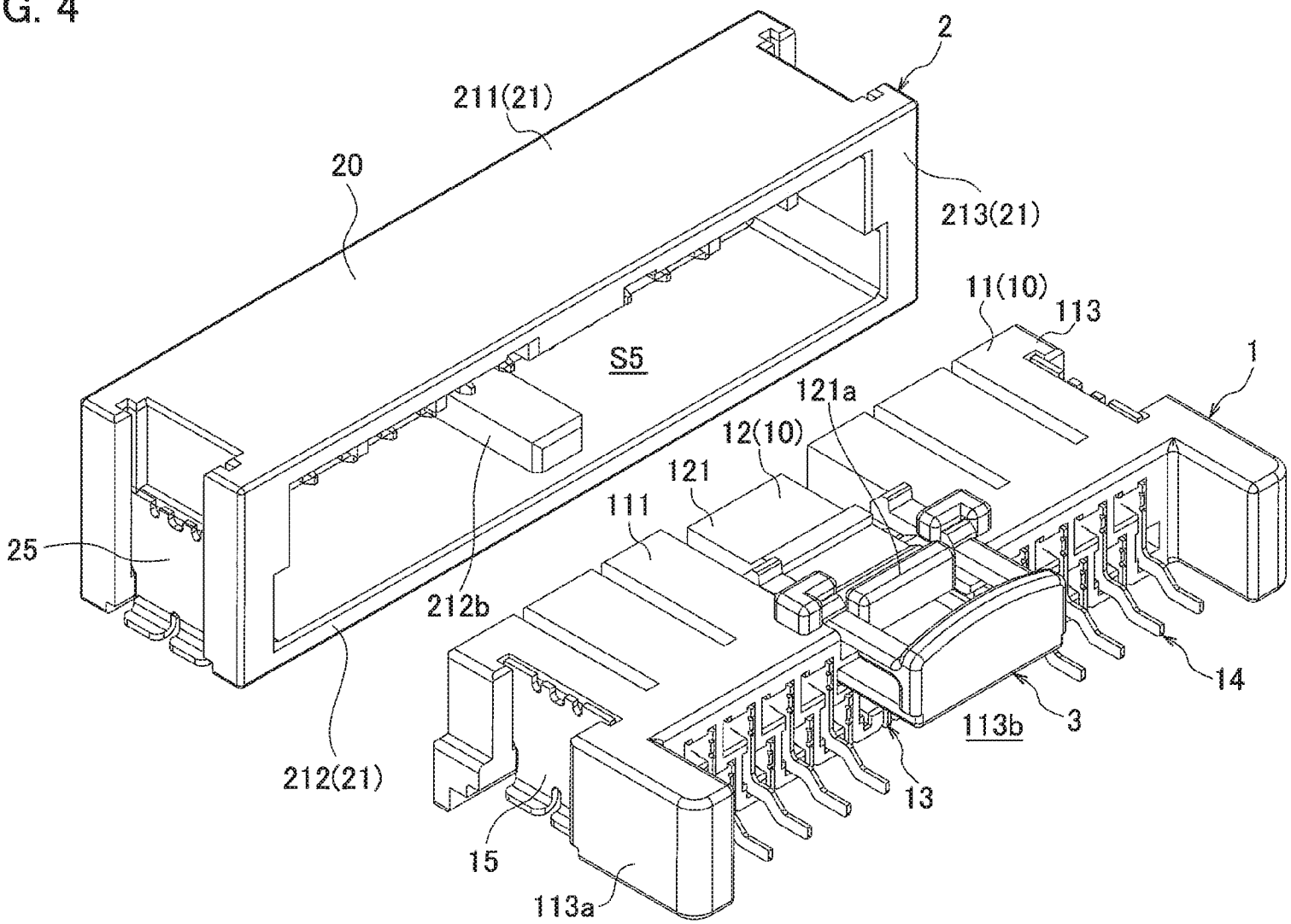
FIG. 4 is a perspective view explaining how the plug connector and the receptacle connector shown as an example are locked with the slide member and showing a state before the plug connector in which the slide member has been temporarily held is fitted to the receptacle connector.
Figure 5:
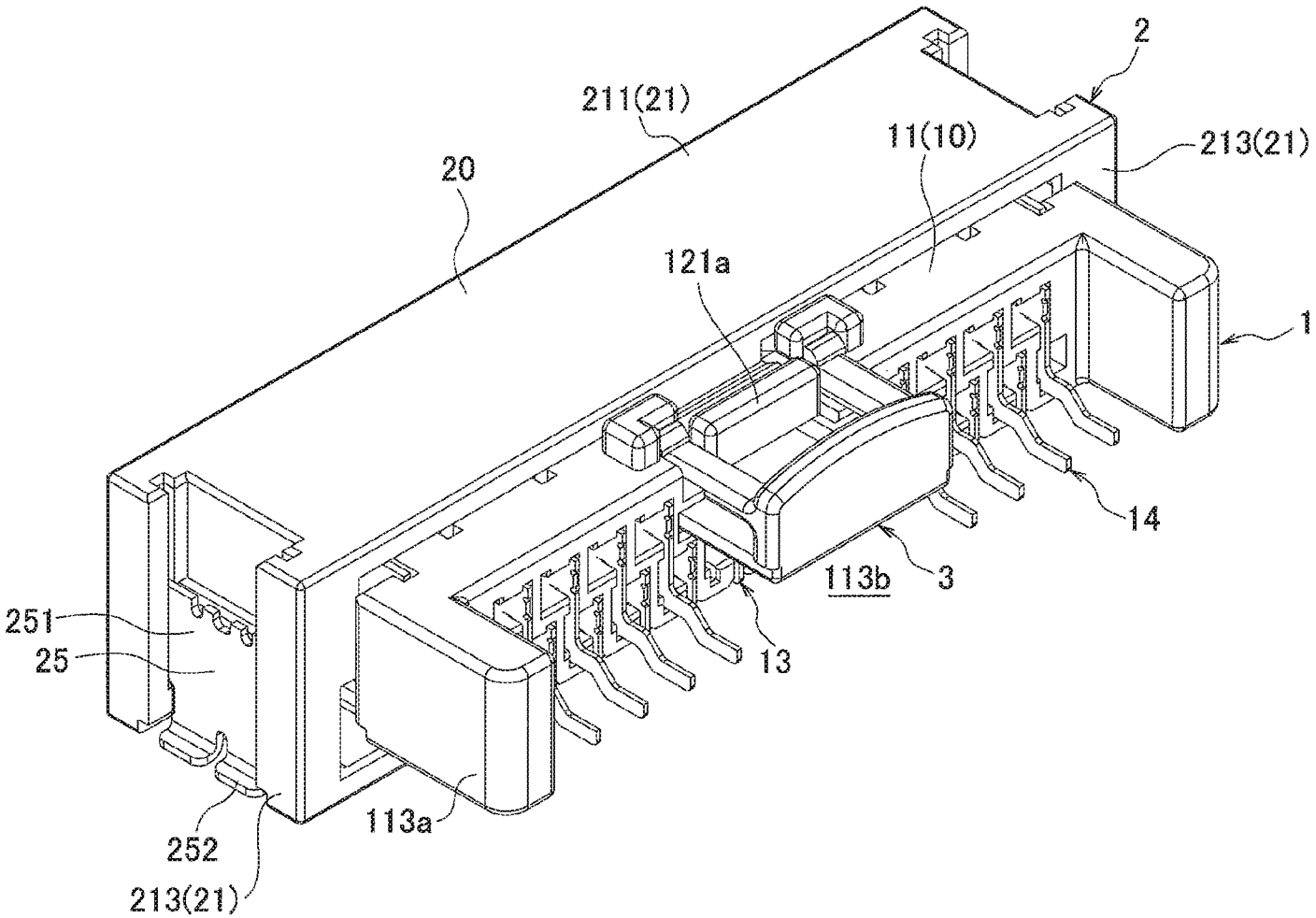
FIG. 5 is a perspective view explaining how the plug connector and the receptacle connector shown as an example are locked with the slide member and showing a state where the plug connector in which the slide member has been temporarily held has been fitted to the receptacle connector.
Figure 6:
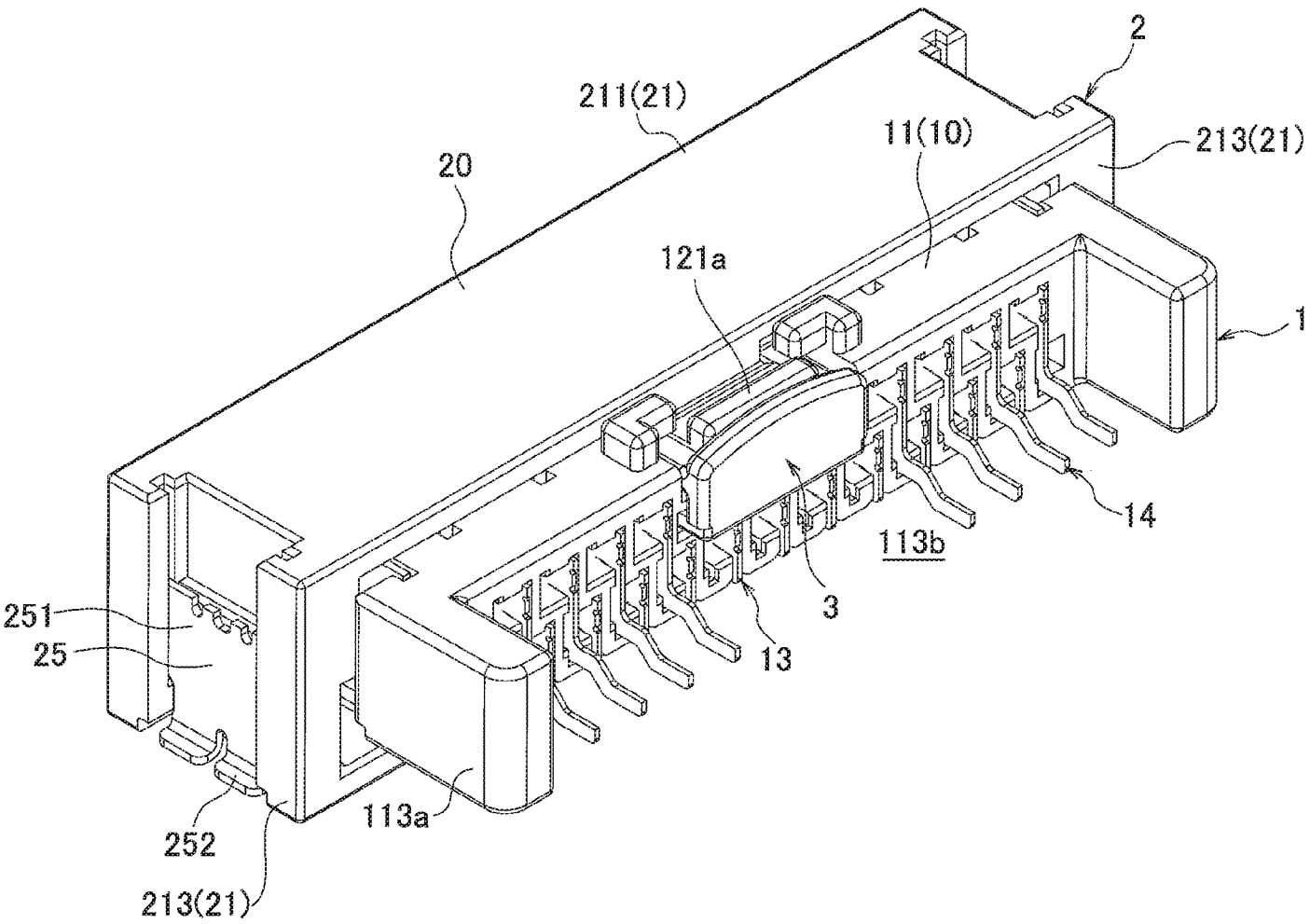
FIG. 6 is a perspective view explaining how the plug connector and the receptacle connector shown as an example are locked with the slide member and showing a state where the plug connector has been fitted to the receptacle connector and locked with the slide member.

Furthermore, in this embodiment, a slide member 3 is slidably supported on the plug connector 1 (see FIG. 4 to FIG. 6).

This slide member 3 is slidably attached to the plug connector 1 such that the slide movement of the slide member 3 from an initial position which is a first position to a slide completion position which is a second position is restricted in a state where the plug connector 1 has not been completely fitted into the receptacle connector 2 yet. Note that the first position and the second position may be set as appropriate.

Then, the slide member 3 is configured such that once the plug connector 1 is completely fitted into the receptacle connector 2, the slide movement of the slide member 3 from the initial position to the slide completion position is allowed. This configuration makes it possible to check the completion of fitting between the plug connector 1 and the receptacle connector 2 from the sliding of the slide member 3 from the initial position to the slide completion position.

As described above, in this embodiment, the connector set C1 has a connector position assurance (CPA) function and the slide member 3 functions as a CPA member.

[Configuration Example of Cable 1A]

Figure 7:
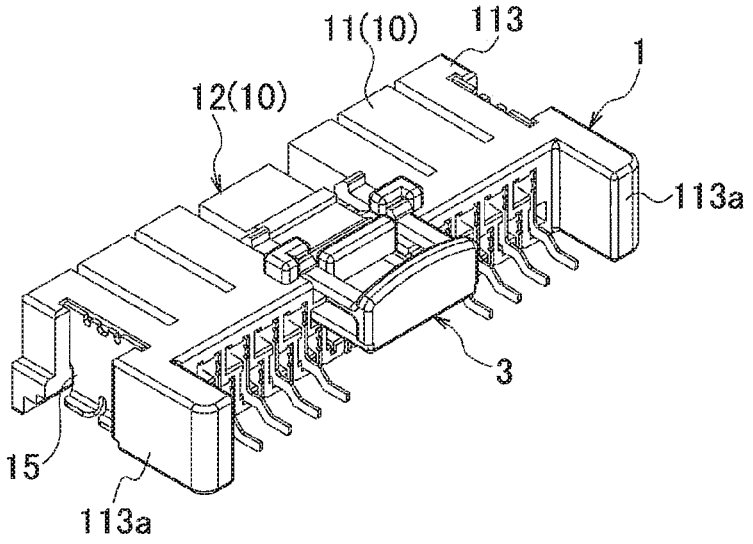
FIG. 7 is a perspective view showing a state before the plug connector in which the slide member has been temporarily held included in the connector set shown as an example is mounted on a cable.
Figure 7:
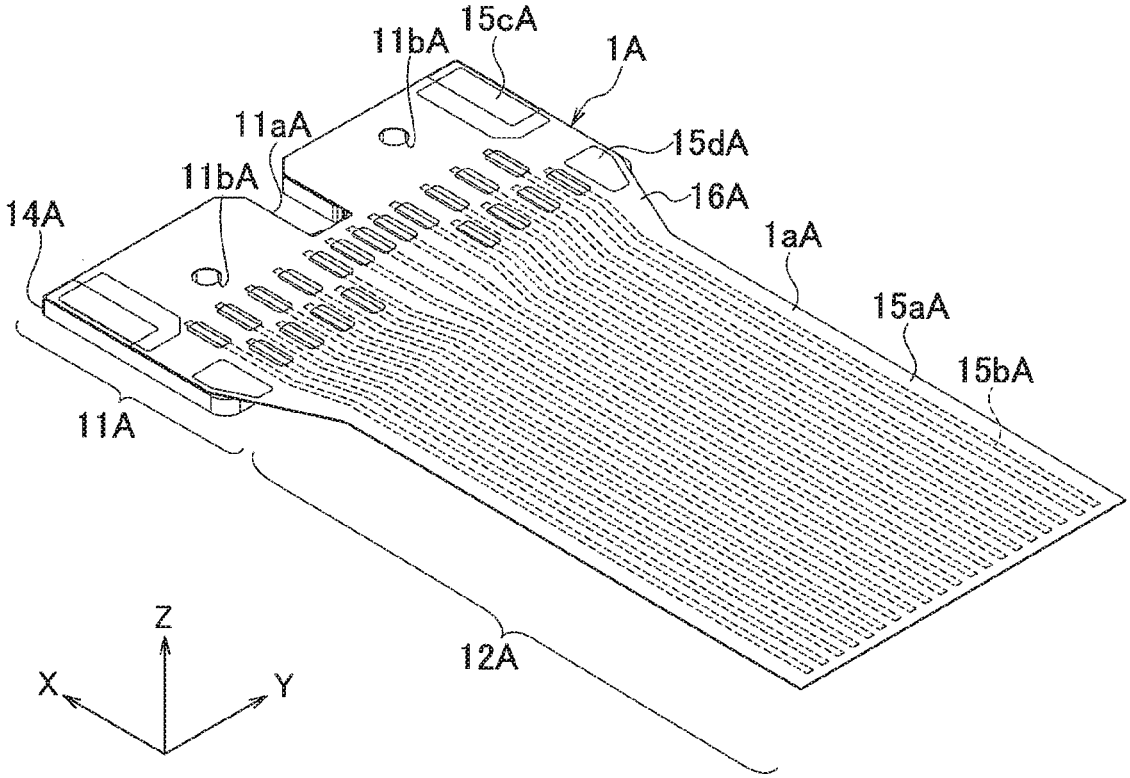
Figure 8A:
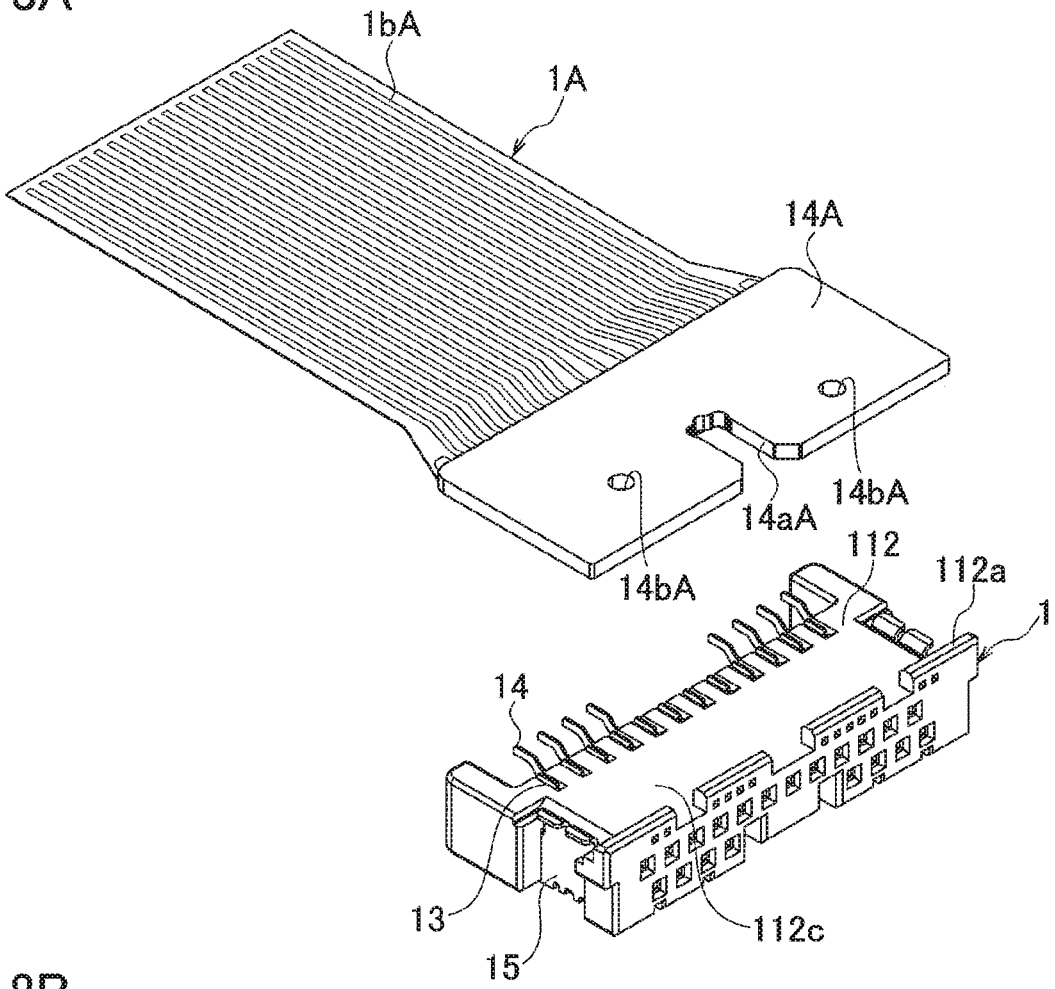
FIGS. 8A and 8B are perspective views explaining how the plug connector included in the connector set shown as an example is mounted on the cable, FIG. 8A showing a state viewed from the reverse side before the plug connector is mounted and FIG. 8B showing a state viewed from the reverse side after the plug connector is mounted.
Figure 8B:
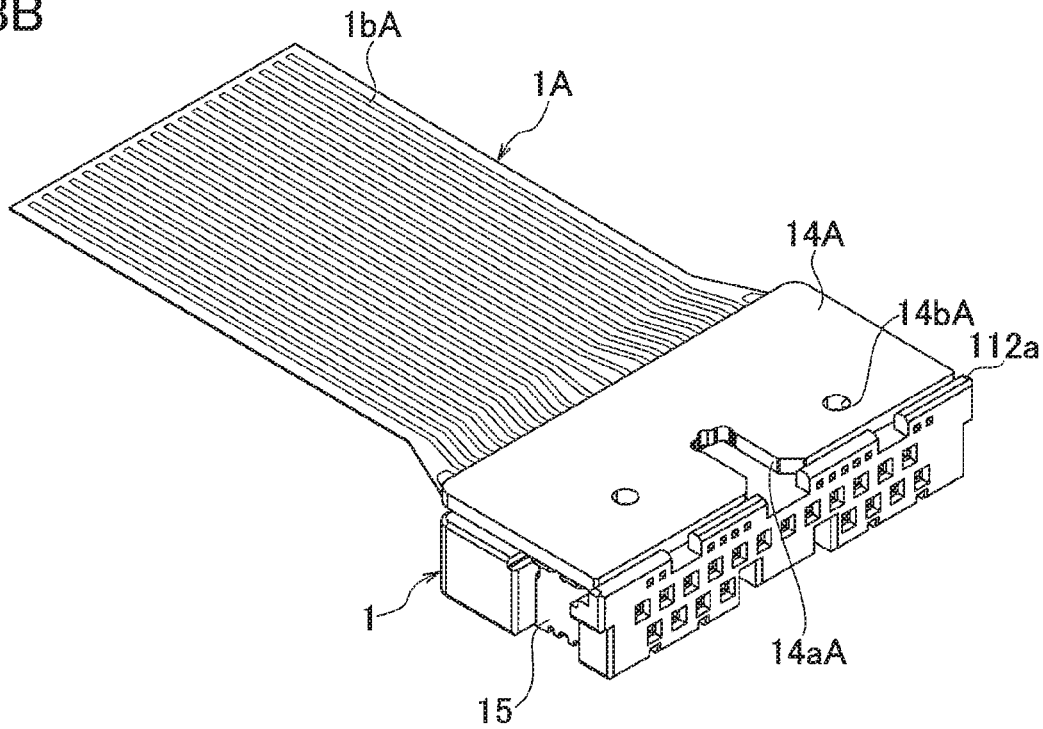

Next, with reference to FIG. 7 and FIG. 8, description is given of a configuration example of the cable 1A on which the plug connector 1 is mounted.

The cable 1A has a sheet shape (flat plate shape) with a top surface (front surface: one side) 1*a*A and a rear surface (back surface: the other side) 1*b*A. The top surface 1*a*A serves as a mounting surface to mount the plug connector 1. The cable 1A is also flexible and thus can be bent (curved) in a cable thickness direction.

This cable 1A includes a connection region 11A used for connection with the plug connector 1 and an extension region 12A in which a conductor layer 15*b*A extends for wiring with another circuit.

In this embodiment, the cable 1A is formed such that the connection region 11A is positioned at one end side of the extension region 12A. In a state where the plug connector 1 having the connection region 11A connected thereto is fitted into the receptacle connector (receptacle connector 2 or receptacle connector 3), the extension region 12A is positioned on the opposite side of the receptacle connector.

Moreover, the cable 1A has a multilayer structure, including a support layer 15*a*A and the conductor layer 15*b*A supported by the support layer 15*a*A. The support layer 15*a*A is formed of a plurality of insulator films to cover the conductor layer 15*b*A. On the other hand, the conductor layer 15*b*A is formed of conductor films printed on the insulator films included in the support layer 15*a*A, which are a plurality of wiring patterns corresponding to the plurality of terminals 13 and 14 to be described later, respectively.

On the upper surface of the connection region 11A, a plurality of conductor parts 151*b*A are formed, which are the conductor layer 15*b*A exposed from the support layer 15*a*A. The plurality of conductor parts 151*b*A are formed in two rows along the front-rear direction, and the conductor parts 151*b*A in each row are formed so as to be arranged at a predetermined pitch in the width direction (Y direction). Furthermore, in this embodiment, the plurality of conductor parts 151*b*A are formed in a staggered pattern in a plan view (state viewed along the mounting surface 1Aa).

Such a structure can be formed, for example, by printing the plurality of conductor films on the support layer 15*a*A to form the conductor layer 15*b*A and then covering the conductor layer 15*b*A with another support layer 15*a*A. In this event, another support layer 15*a*A is provided so as not to cover the tip of the conductor layer 15*b*A. Thus, the cable 1A having the tip of the conductor layer 15*b*A exposed on one side (top side of the top-bottom direction) is formed.

Note that a method for forming the cable 1A is not limited to the above method, but various other methods can be used to form the cable 1A.

On the upper surface of the connection region 11A, fixing parts 15*c*A are also formed to fix holding brackets 15 to be described later in the plug connector 1. In this embodiment, the cable 1A includes wide parts 16A extending on either side in the width direction (Y direction) of the plurality of conductor layers 15*b*A arranged in the width direction (Y direction), and a pair of fixing parts 15*c*A are formed on the tip side of the respective wide parts 16A (on the front side of the front-rear direction). Moreover, on the rear side in the front-rear direction of the respective wide parts 16A, fixing parts 15*d*A are formed to fix a plug housing (housing) 10 of the plug connector 1. These fixing parts 15*c*A and 15*d*A can be formed, for example, in the same manner as the conductor layers 15*b*A in a printing process for the conductor layers 15*b*A.

Moreover, in this embodiment, a slit 11*a*A that is elongated in the front-rear direction (X direction) and opened forward is formed in the connection region 11A of the cable 1A. On either side, in the width direction (Y direction), of the slit 11*a*A in the connection region 11A, through-holes 11*b*A are formed penetrating in the cable thickness direction (top-bottom direction; Z direction).

Furthermore, in this embodiment, the cable 1A includes a reinforcing plate 14A. This reinforcing plate 14A is formed using glass epoxy resin, stainless steel, or the like, and is configured to reinforce the connection region 11A of the cable 1A by sandwiching the connection region 11A of the cable 1A between the reinforcing plate 14A and the plug connector 1.

In this embodiment, the reinforcing plate 14A has a shape corresponding to the shape of the connection region 11A of the cable 1A. More specifically, a contour shape of the reinforcing plate 14A in the plan view (state viewed along the mounting surface 1Aa) is approximately the same as that of the connection region 11A. Therefore, a slit 14*a*A that is elongated in the front-rear direction (X direction) and opened forward and through-holes 14*b*A penetrating in the cable thickness direction (top-bottom direction; Z direction) are formed in the reinforcing plate 14A. Then, the reinforcing plate 14A is attached to the rear surface side of the connection region 11A with an adhesive or the like in a state where the slit 11*a*A and the slit 14*a*A communicate with each other and the through-holes 11*b*A and the through-holes 14*b*A communicate with each other.

In this event, it is preferable that the entire conductor part 151*b*A overlap with the reinforcing plate 14A in the plan view (state viewed along the mounting surface 1Aa). In this way, the entire conductor part 151*b*A is supported by the reinforcing plate 14A, and thus can be prevented from bending in the top-bottom direction (Z direction) or warping in the width direction (Y direction).

[Configuration Example of Plug Connector 1]

Next, with reference to FIGS. 9 to 17, description is given of a configuration example of the plug connector 1.

Figure 9:
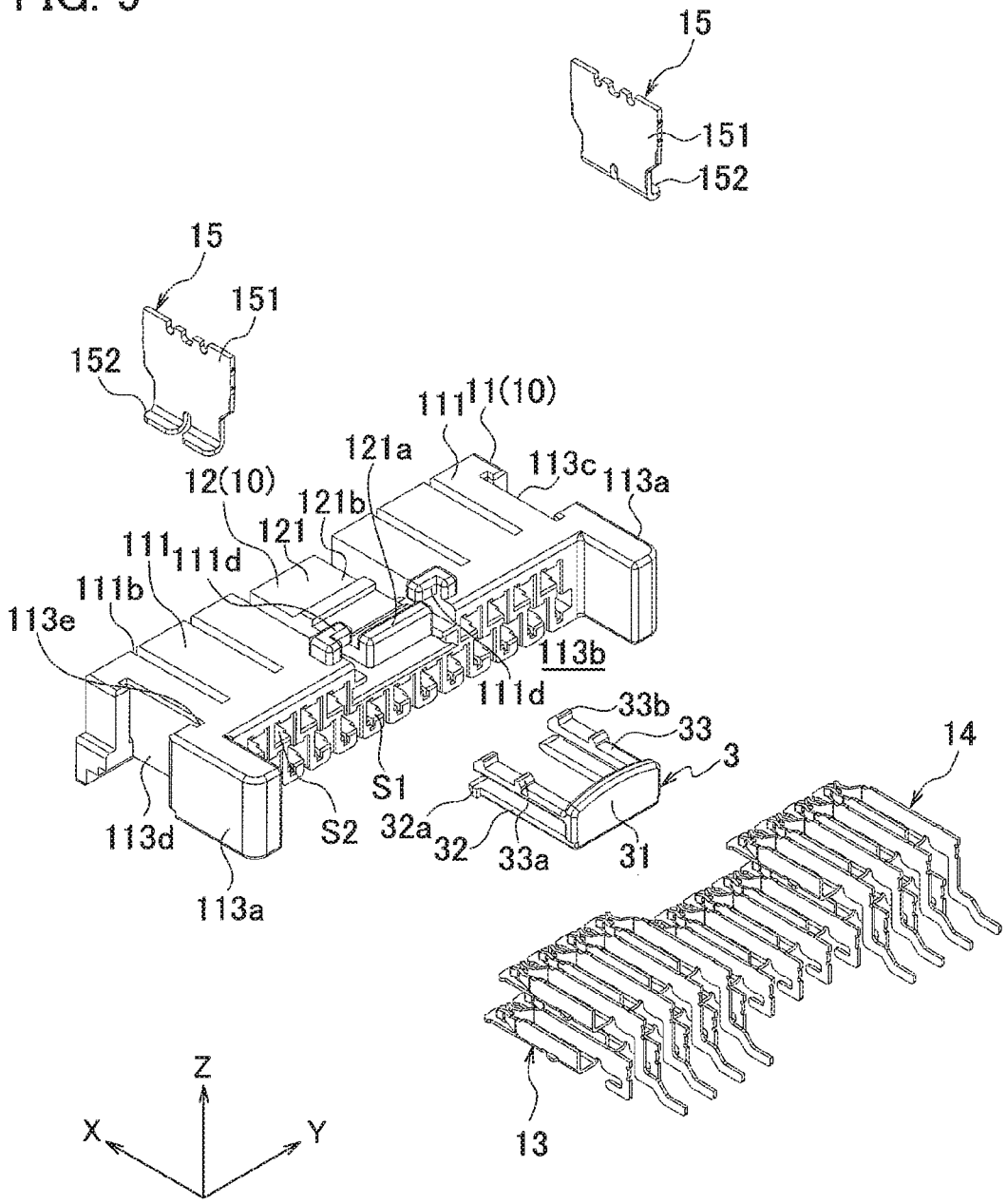
FIG. 9 is an exploded perspective view showing the plug connector and the slide member included in the connector set shown as an example.
Figure 10A:
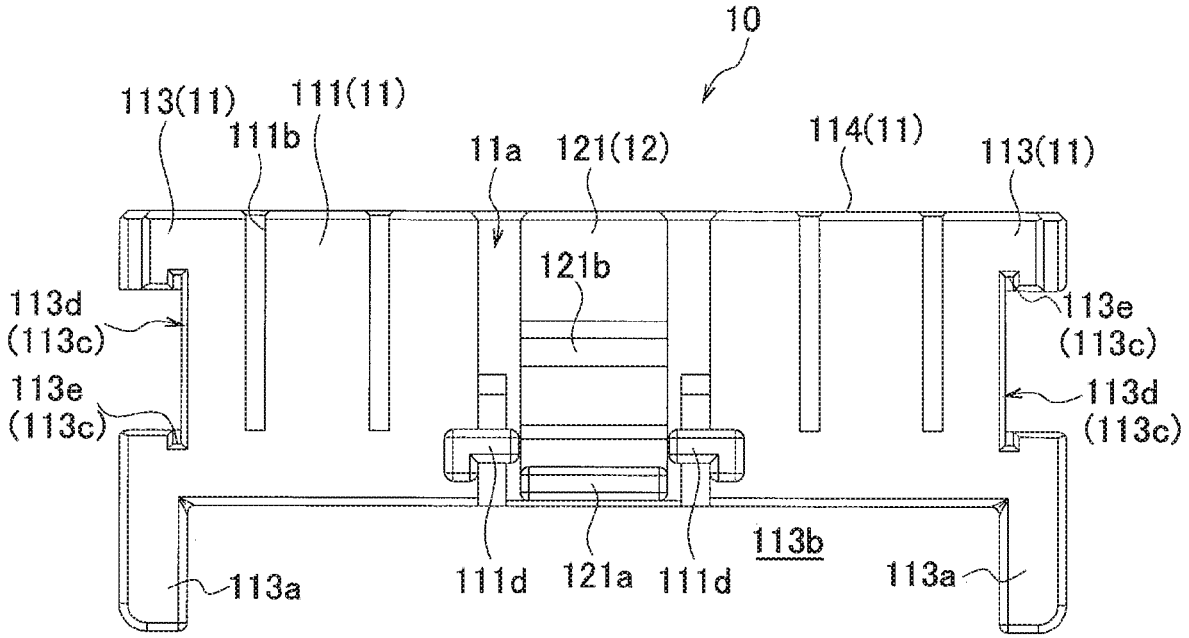
FIG. 10A is a plan view and FIG. 10B is a reverse side view, showing the plug housing included in the plug connector.
Figure 10B:
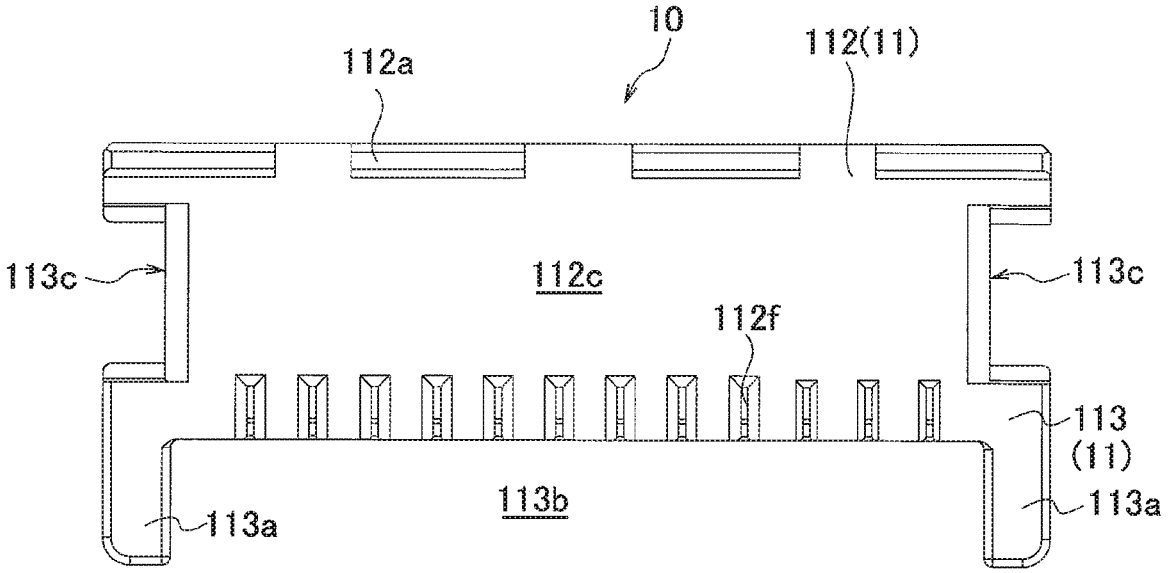
Figure 11A:
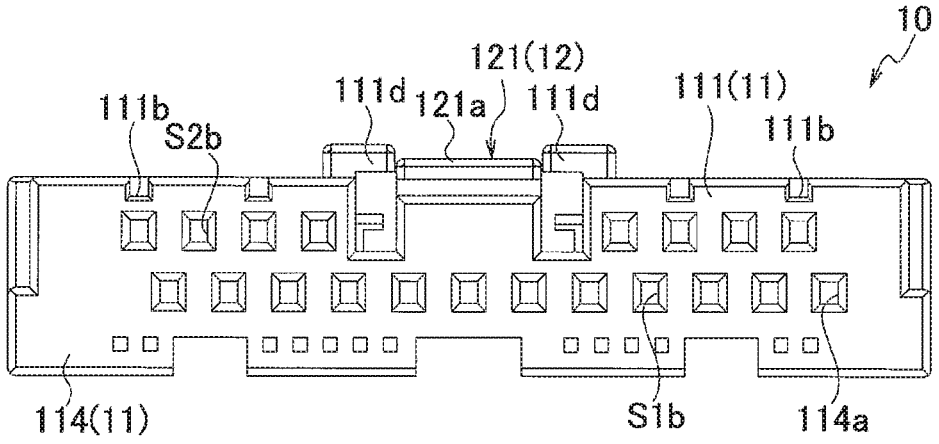
FIG. 11A is a front view.
Figure 11B:
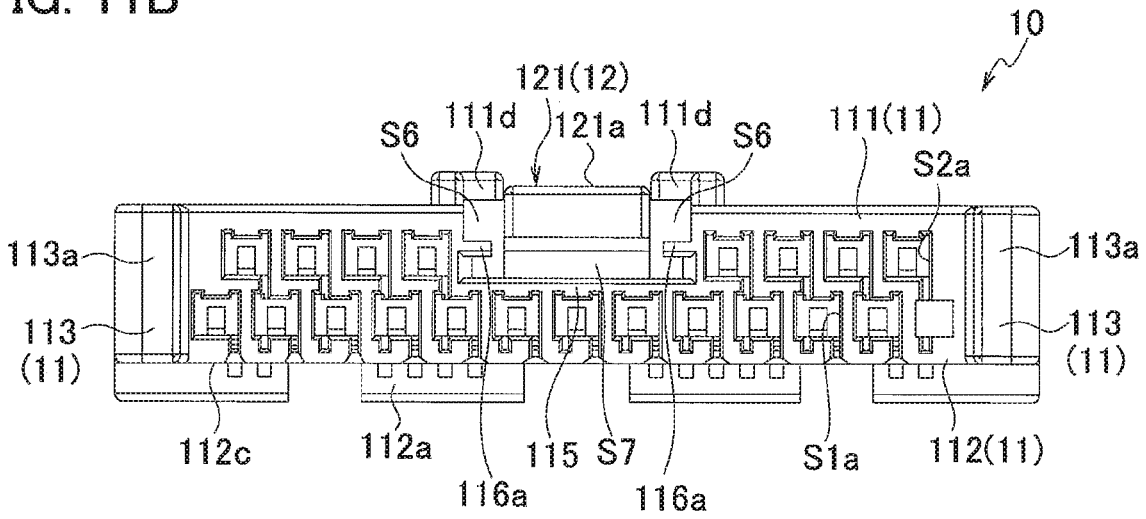
FIG. 11B is a back view.
Figure 11C:
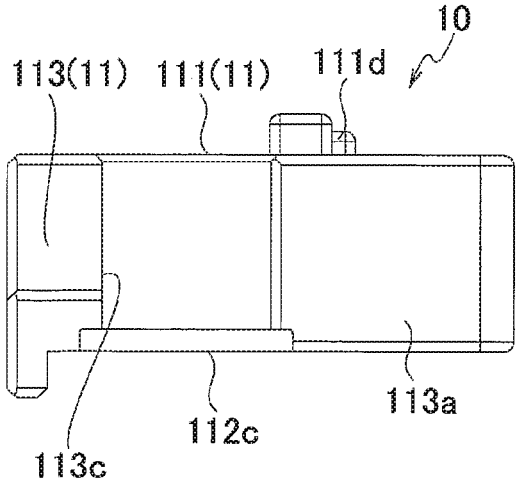
FIG. 11C is a side view.
Figure 11D:
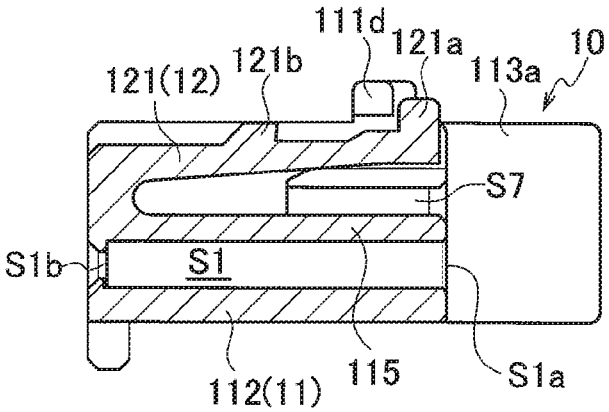
FIG. 11D is a sectional side view, showing the plug housing included in the plug connector.
Figure 12B:
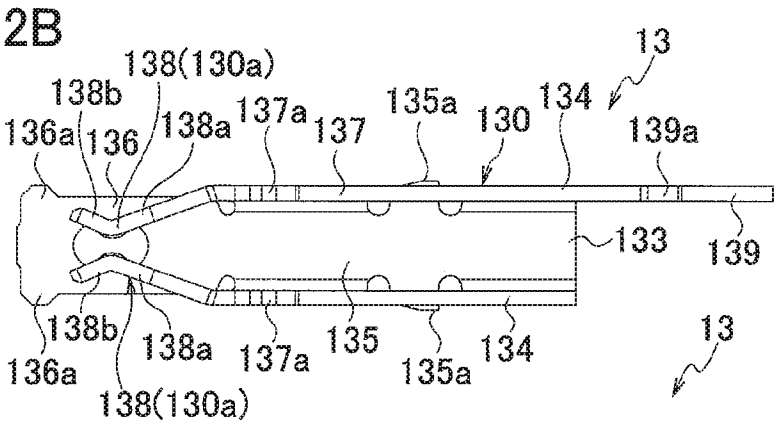
FIG. 12B is a plan view.
Figure 12C:
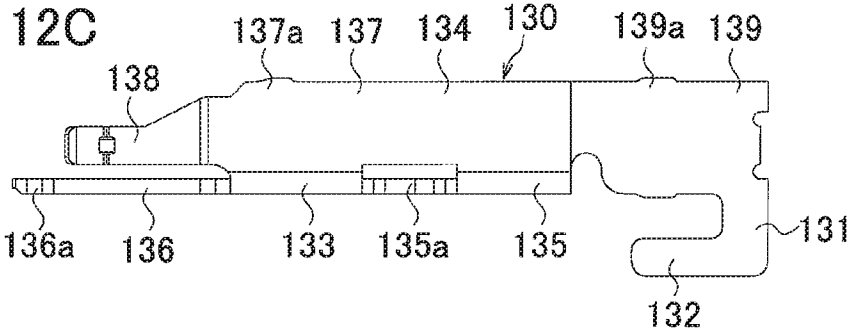
FIG. 12C is a side view.
Figure 12D:
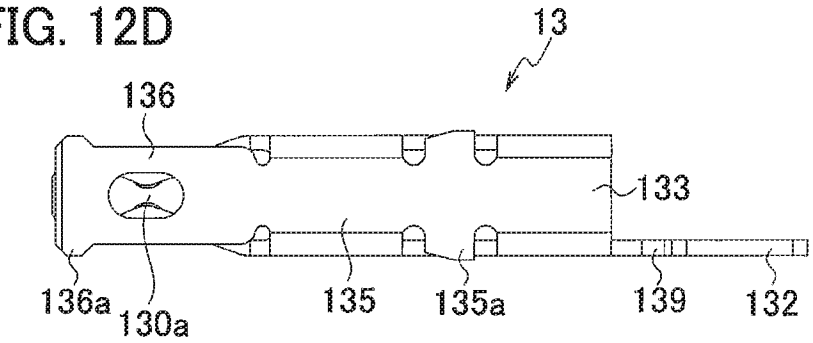
FIG. 12D is a reverse side view.
Figure 12A:
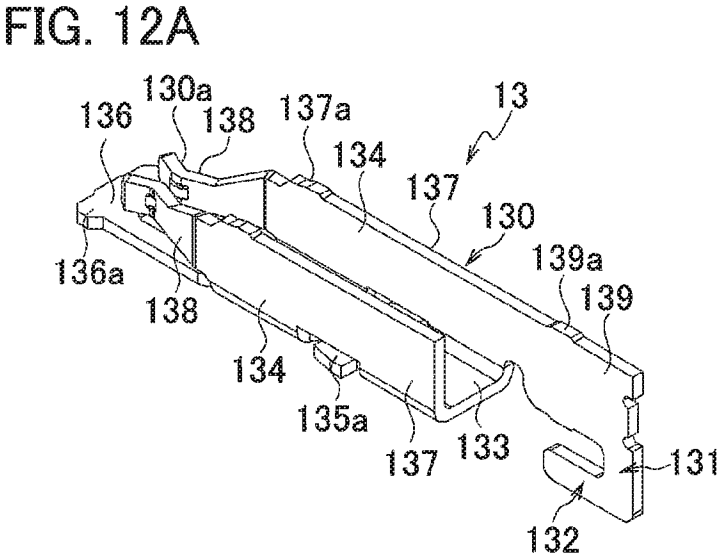
FIG. 12A is a perspective view.
Figure 12F:
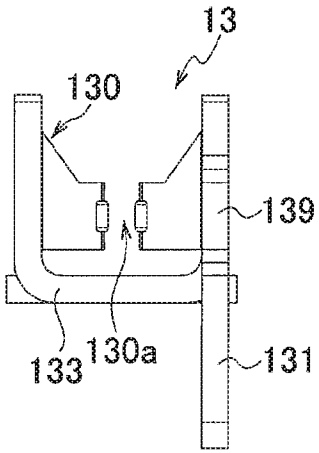
FIG. 12F is a back view, showing the lower terminal included in the plug connector.
Figure 12E:
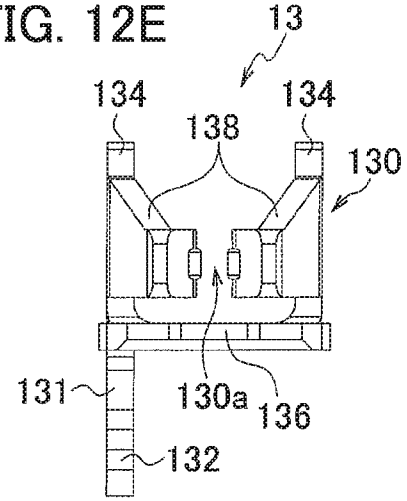
FIG. 12E is a front view.
Figure 13B:
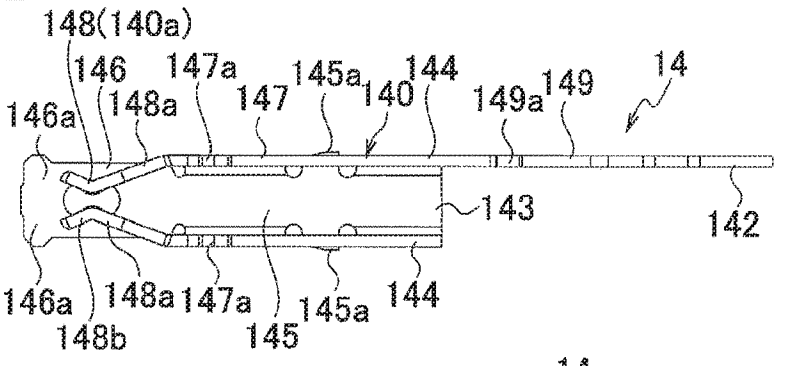
FIG. 13B is a plan view.
Figure 13C:
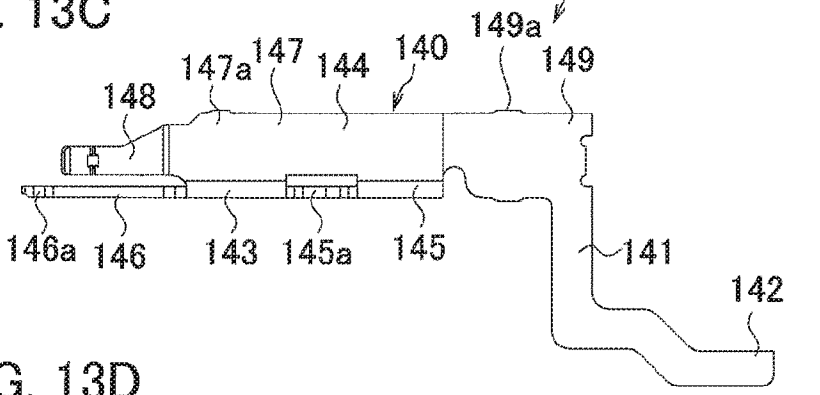
FIG. 13C is a side view.
Figure 13D:
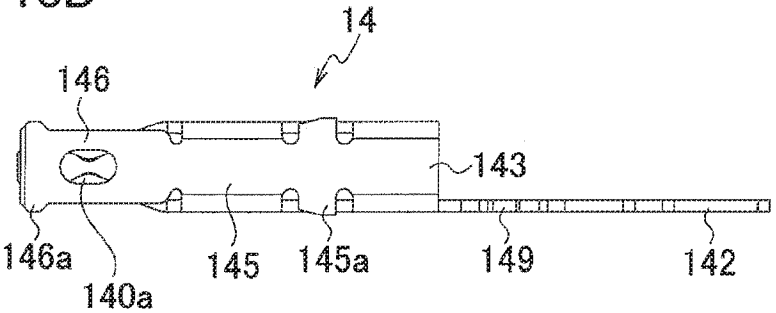
FIG. 13D is a reverse side view.
Figure 13A:
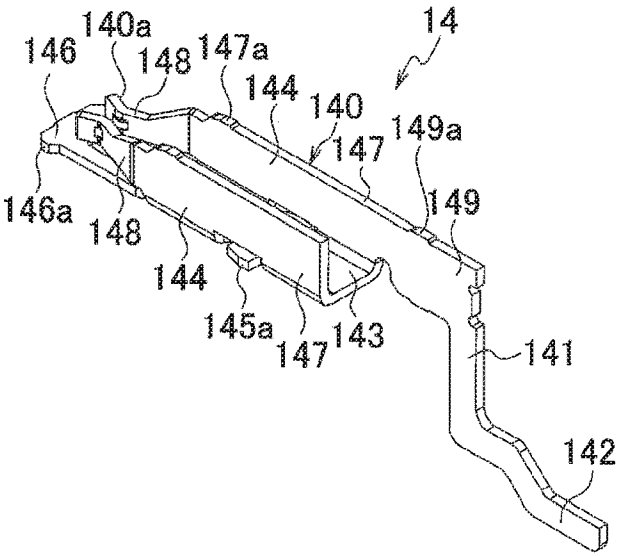
FIG. 13A is a perspective view.
Figure 13F:
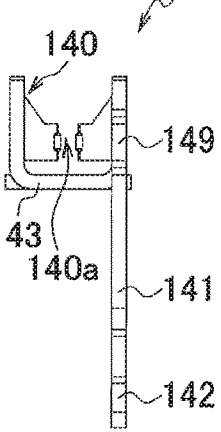
FIG. 13F is a back view, showing the upper terminal included in the plug connector.
Figure 13E:
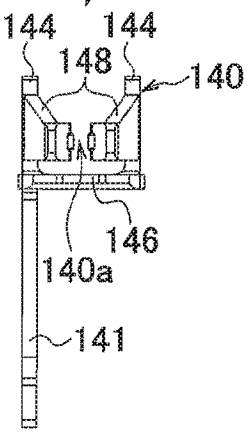
FIG. 13E is a front view.

As shown in FIG. 9, the plug connector (first connector) 1 includes a plug housing (first housing) 10, plug terminals (first terminals) 13 and 14 held by the plug housing 10, and the holding brackets 15 held by the plug housing 10.

The plug connector 1 is configured to be mounted on the cable 1A as the mounting member by mounting the plug terminals 13 and 14 held by the plug housing 10 on the conductor part 151*b*A of the cable 1A disposed outside the plug housing 10. Note that the plug terminals 13 and 14 are mounted on the conductor part 151*b*A by soldering or the like. The holding brackets 15 are fixed to the fixing parts 15*c*A of the cable 1A by soldering or the like, in a state where the holding brackets 15 are held by the plug housing 10, to fix the plug housing 10 to the cable 1A.

The plug housing 10 includes a rigid housing main body (first housing main body) 11, and can be formed, for example, using an insulating resin material.

The housing main body 11 also has a lock part 12 formed on its upper side. This lock part 12 holds the plug housing 10 and the housing of the receptacle connector 2 in their fitted state or releases the fitted state.

Thus, in this embodiment, the plug housing 10 includes the housing main body 11 and the lock part 12 formed in the housing main body 11.

The housing main body 11 includes a top wall 111, a bottom wall 112, a pair of side walls 113 connecting both ends, in the width direction (Y direction), of the top wall 111 and the bottom wall 112, and a front wall 114 provided continuously from front ends of the top wall 111, the bottom wall 112, and the side walls 113, 113.

In addition, the housing main body 11 includes a partition walls 115 that is provided continuously from the pair of side walls 113 and the front wall 114 and partitions, into upper and lower parts, a space defined by the top wall 111, the bottom wall 112, the side walls 113, 113, and the front wall 114.

The housing main body 11 further includes a plurality of upper partition walls 116 provided continuously from the top wall 111, the partition wall 115, and the front wall 114. These upper partition walls 116 partition the upper space partitioned by the partition wall 115 into a plurality of spaces. The housing main body 11 also includes a plurality of lower partition walls 117 provided continuously from the bottom wall 112, the partition wall 115, and the front wall 114.

These lower partition walls 117 partition the lower space partitioned by the partition wall 115 into a plurality of spaces.

The lock part 12 is formed in the middle, in the width direction, of the upper side of the housing main body 11. To be more specific, the top wall 111 is formed on either side in the width direction, and the upper partition wall 116 is provided continuously from the inner side, in the width direction, of each of the top walls 111. As described above, in this embodiment, the housing main body 11 has a shape in which the middle part in the width direction is recessed as viewed along the insertion direction (front-rear direction; X direction). The lock part 12 is formed in a recess part 11*a* formed in the middle, in the width direction, of this housing main body 11.

The lock part 12 includes a lever part 121 that is provided continuously from the front end of the partition wall 115 and extends rearward. This lever part 121 has its rear side capable of moving in the top-bottom direction relative to the partition wall 115 (housing main body 11). The lever part 121 has an operation part 121*a* formed at its rear end to operate the lever part 121, and also has an engagement protrusion 121*b* formed in its central portion in the front-rear direction to engage with an engagement recess part (engaged part) 221*a* formed in the receptacle connector 2.

In this embodiment, when the plug housing 10 and the receptacle housing 20 of the receptacle connector 2 are fitted together, the housings of the respective connectors can be locked together (maintained in the fitted state) by the engagement protrusion 121*b* engaging with the engagement recess part 221*a*. Then, the fitted state of the housings of the respective connectors can be released by lowering the operation part 121*a* of the lever part 121 to move downward the lever part 121 as well as the engagement protrusion 121*b*, thus releasing the engagement with the engagement recess part 221*a*.

Furthermore, an insertion space S6 into which the slide member 3 is inserted is formed on either side, in the width direction, of the lever part 121 in the recess part 11*a*. In addition, below the lever part 121 in the recess part 11*a* (between the lever part 121 and the partition wall 115), a deflection allowance space S7 is formed where downward deflection of the lever part 121 (the movement of the lever part 121 relative to the housing main body 11) is allowed.

Note that the insertion space S6 is partitioned into a space into which a lower arm part 32 of the slide member 3 to be described later is inserted and a space into which an upper arm part 33 of the slide member 3 is inserted, by a protrusion wall 116*a* formed to protrude in the width direction on the upper partition wall 116 which defines the recess part 11*a*.

Figure 26:
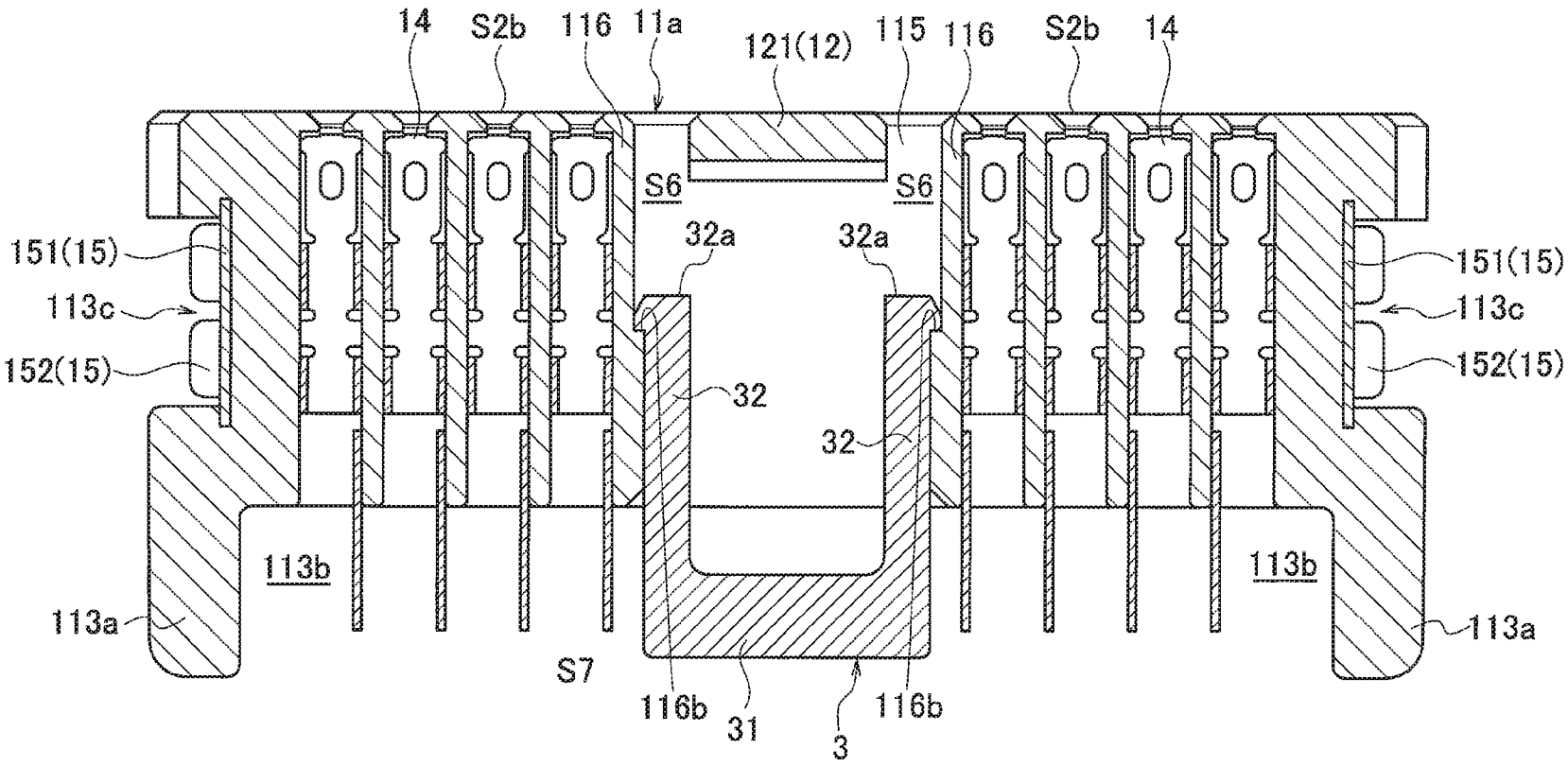
FIG. 26 is a horizontal sectional view showing a state where the slide member is temporarily held in the plug connector shown as an example.

In addition, a step part 116*b* is formed in the middle in the front-rear direction, below the protrusion wall 116*a* of the upper partition wall 116 which defines the recess part 11*a*. A space into which the lower arm part 32 is inserted is formed to have a wider front side in a plan view (see FIG. 26). Locking a locking protrusion 32*a* that is formed to protrude outward in the width direction on the tip (front end) of the lower arm part 32 to the step part 116*b* prevents the slide member 3 from falling off the housing main body 11.

Moreover, the top walls 111 have guide grooves 111*b* formed therein to guide the fitting between the plug housing 10 and the receptacle housing 20.

In rear parts of the top walls 111, restrictive protrusions (slide restrictor) 111*d* each having a substantially L-shape in a plan view are formed. The restrictive protrusions 111*d* prevent the slide member 3 from sliding from the initial position to the slide completion position in the state where the plug housing 10 has not been completely fitted into the receptacle housing 20 yet.

Moreover, at the front end of the lower side (rear surface side) of the bottom wall 112, a protrusion 112*a* extending in the width direction is formed so as to protrude downward. This protrusion 112*a* is formed in the bottom wall 112 such that the protrusion amount is not less than the sum of the thickness of the cable 1A and the thickness of the reinforcing plate 14A.

By forming such a protrusion 112*a* in the bottom wall 112, a recess part 112*c* is formed in the lower surface of the bottom wall 112. When the plug connector 1 is mounted on the cable 1A, the connection region 11A having the reinforcing plate 14A attached thereto is housed in the recess part 112*c* (see FIG. 8B).

As described above, in this embodiment, the plug housing 10 includes a pair of walls (top wall 111 and bottom wall 112) facing each other in the housing thickness direction (top-bottom direction: Z direction). The recess part 112*c* to house the connection region 11A of the cable 1A is formed in the bottom wall 112 that is one of the pair of walls (top wall 111 and bottom wall 112). More specifically, the plug housing 10 has a receiving part (recess part 112*c*) to receive the cable (mounting member) 1A in the wall (bottom wall 112) on one side in the housing thickness direction (top-bottom direction).

Note that in this embodiment, in the receptacle connector 2, a positioning protrusion 212*b* is formed corresponding to the slit 11*a*A and the slit 14*a*A. When the plug housing 10 is fitted into the receptacle housing 20, the positioning protrusion 212*b* is inserted into the slit 11*a*A and the slit 14*a*A. This makes it possible to prevent the cable 1A from being displaced in the width direction. In addition, the protrusions 112*a* prevent the cable 1A from being displaced forward.

Also, the front wall 114 has through-holes 114*a* formed therein, which communicate with the plurality of spaces partitioned by the partition wall 115 and the upper and lower partition walls 116 and 117. Thus, in this embodiment, the plurality of spaces penetrating in the front-rear direction are formed in the housing main body 11. Then, the plug terminals 13 and 14 are press-fitted (inserted) into the spaces penetrating in the front-rear direction.

In this embodiment, a plurality of spaces arranged in the width direction (Y direction) are formed in two stages in the top-bottom direction (Z direction) in the housing main body 11. These plurality of spaces are formed in a staggered pattern when viewed from the rear side in the front-rear direction of the housing main body 11. Accordingly, the plug connector 1 is reduced in size in the width direction.

To be more specific, on the lower side (mounting surface 1*a*A side) of the housing main body 11, a plurality of spaces defined by the bottom wall 112, the partition wall 115, and the lower partition walls 117 are arranged in the width direction (Y direction). These spaces formed on the lower side (mounting surface 1*a*A side) of the housing main body 11 serve as first spaces S into which lower plug terminals 13 to be described later, among the plug terminals 13 and 14, are press-fitted (inserted).

On the other hand, on the upper side (position further away from the mounting surface 1*a*A than the first spaces S1) of the housing main body 11, a plurality of spaces defined by the top wall 111, the partition wall 115, and the upper partition walls 116 are arranged in the width direction (Y direction). These spaces formed on the upper side of the housing main body 11 serve as second spaces S2 into which upper plug terminals 14 to be described later, among the plug terminals 13 and 14, are press-fitted (inserted).

In this embodiment, in a lower part of the housing main body 11, 12 lower spaces (first spaces S1) are arranged in the width direction. On the other hand, in an upper part of the housing main body 11, 4 upper spaces (second spaces S2) are arranged at one side of the lock part 12 in the width direction and 4 upper spaces (second spaces S2) are arranged at the other side of the lock part 12 in the width direction. In other words, in the upper part of the housing main body 11, 8 upper spaces (second spaces S2) are arranged in the width direction in such a manner as to sandwich the lock part 12. Accordingly, the housing main body 11 is reduced in size in the height dimension.

Furthermore, in this embodiment, the upper partition walls 116 and the lower partition walls 117 are formed at positions shifted from each other in the width direction. More specifically, the first spaces S1 and the second spaces S2 are formed so as to partially overlap with each other in the plan view. In other words, the first spaces S1 and the second spaces S2 overlap with each other, when the plug housing 10 is viewed along a direction (top-bottom direction) normal to the mounting surface 1*a*A, in a state where the plug terminals 13 and 14 are held by the plug housing 10 and also mounted on the cable 1A.

Note that in this embodiment, the insertion space S6 and the second space S2 are placed over each other when the plug housing 10 is viewed in the width direction. This enables a low height of the plug housing 10 holding the slide member 3.

The lower plug terminals 13 are each configured to be press-fitted (inserted) forward from an opening at the rear end side of the first space S1. This opening at the rear end side of the first space S1 serves as an insertion opening (insertion slot) S1*a*. Also, an opening at the front end side of the first space S1 is formed to be smaller than the insertion opening S1*a* so as to prevent the lower plug terminal 13 from falling off. More specifically, forward movement of the lower plug terminal 13 press-fitted (inserted) from the insertion opening S1*a* is restricted by the front wall 114. Note that the opening at the front end side of the first space S1 serves as an introduction port S1*b* for introducing a contact portion of the receptacle terminal of the receptacle connector to be described later into the first space S1. This introduction port S1*b* has its peripheral portion formed into a tapered shape so as to facilitate introduction of the contact portion of the receptacle terminal.

Likewise, the upper plug terminals 14 are each configured to be press-fitted (inserted) forward from an opening at the rear end side of the second space S2. This opening at the rear end side of the second space S2 serves as an insertion opening (insertion slot) S2*a*. Also, an opening at the front end side of the second space S2 is formed to be smaller than the insertion opening S2*a* so as to prevent the upper plug terminal 14 from falling off. More specifically, forward movement of the upper plug terminal 14 press-fitted (inserted) from the insertion opening S2*a* is restricted by the front wall 114. Note that the opening at the front end side of the second space S2 serves as an introduction port S2*b* for introducing a contact portion of the receptacle terminal of the receptacle connector to be described later into the second space S2. This introduction port S2*b* has its peripheral portion formed into a tapered shape so as to facilitate introduction of the contact portion of the receptacle terminal.

Moreover, in the lower part of the top wall 111, grooves 111*c* opened rearward and downward are formed to communicate with the second space S2. These grooves 111*c* guide press-fitting (insertion) of the upper plug terminals 14 into the second space S2 by insertion of upper ends of side walls 144 of the upper plug terminals 14 to be described later into the grooves 111*c*.

Figure 17:
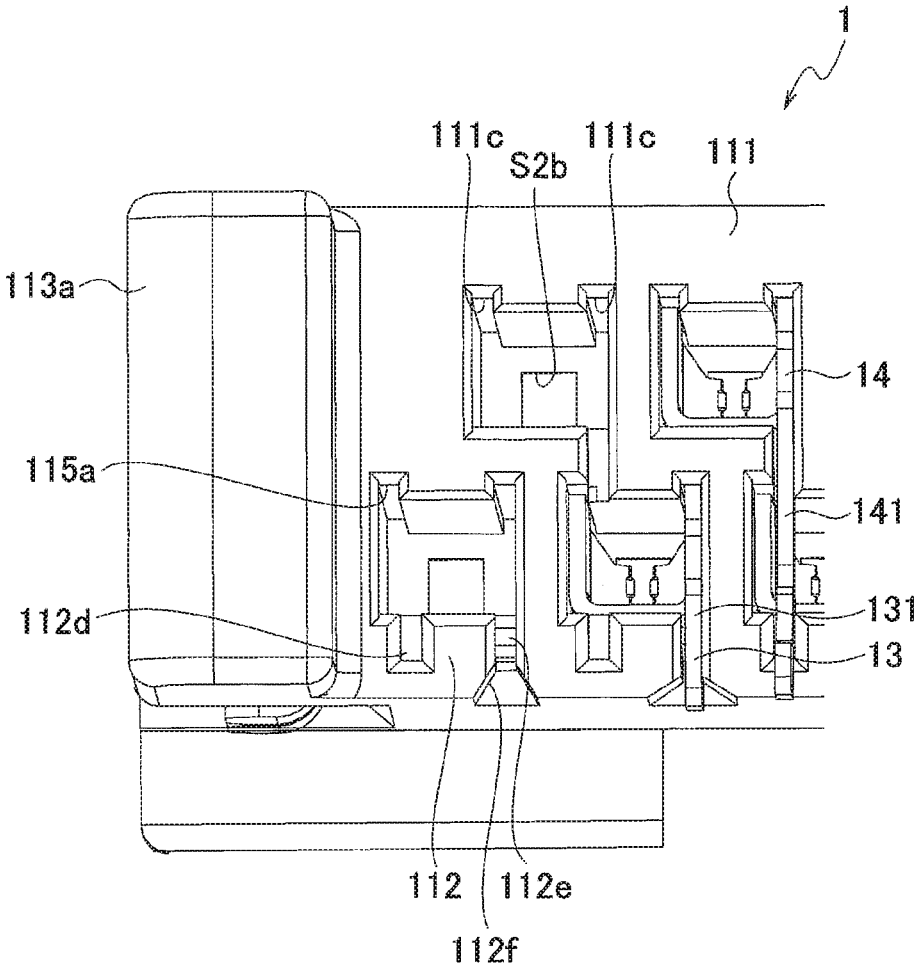
FIG. 17 is an enlarged perspective view showing a terminal guide groove of the plug connector.

In this embodiment, as shown in FIG. 17, the grooves 111*c* are formed on either side, in the width direction, of the second space S2 so as to extend from the insertion openings S2*a* to the front wall 114.

More specifically, the grooves 111*c* are formed such that the length in the insertion direction (X direction) is not less than a distance the upper plug terminals 14 move during the period from the start of insertion of upper ends of side walls 144 into the grooves 111*c* through until the insertion is completed. Therefore, a portion of the upper end of the side wall 144 first inserted into the groove 111*c* stays inside the groove 111*c* during the period from the start of the insertion into the groove 111*c* through until the press-fitting (insertion) of the upper plug terminal 14 into the second space S2 is completed.

Note that the grooves 111*c* are formed to have a groove width (length in the Y direction) slightly larger than the thickness of the side wall 144.

Likewise, in the lower part of the partition wall 115, grooves 115*a* opened rearward and downward are formed to communicate with the first space S1. These grooves 115*a* guide press-fitting (insertion) of the lower plug terminals 13 into the first space S1 by insertion of the upper ends of the side walls 134 of the lower plug terminals 13 to be described later into the grooves 115*a*.

In this embodiment, as shown in FIG. 17, the grooves 115*a* are also formed on either side, in the width direction, of the first space S1 so as to extend from the insertion openings S1*a* to the front wall 114.

More specifically, the grooves 115*a* are formed such that the length in the insertion direction (X direction) is not less than a distance the lower plug terminals 13 move between the start of the insertion of the upper ends of the side walls 134 into the grooves 115*a* and the end of the insertion. Therefore, a portion of the upper end of the side wall 134 first inserted into the groove 115*a* stays inside the groove 115*a* until the press-fitting (insertion) of the lower plug terminal 13 into the first space S1 is completed after the start of the insertion thereof into the groove 115*a*.

Note that the grooves 115*a* are formed to have a groove width (length in the Y direction) slightly larger than the thickness of the side wall 134.

Furthermore, in this embodiment, a groove 115*b* extending in the top-bottom direction and having both ends opened into the first and second spaces S1 and S2, respectively, is formed at the rear end of the partition wall 115. To be more specific, the groove 115*b* is formed so as to face, in the top-bottom direction, one of the two grooves 111*c* (the one on the right side in FIG. 16 and FIG. 17) formed so as to communicate with one of the second spaces S2.

Figure 16:
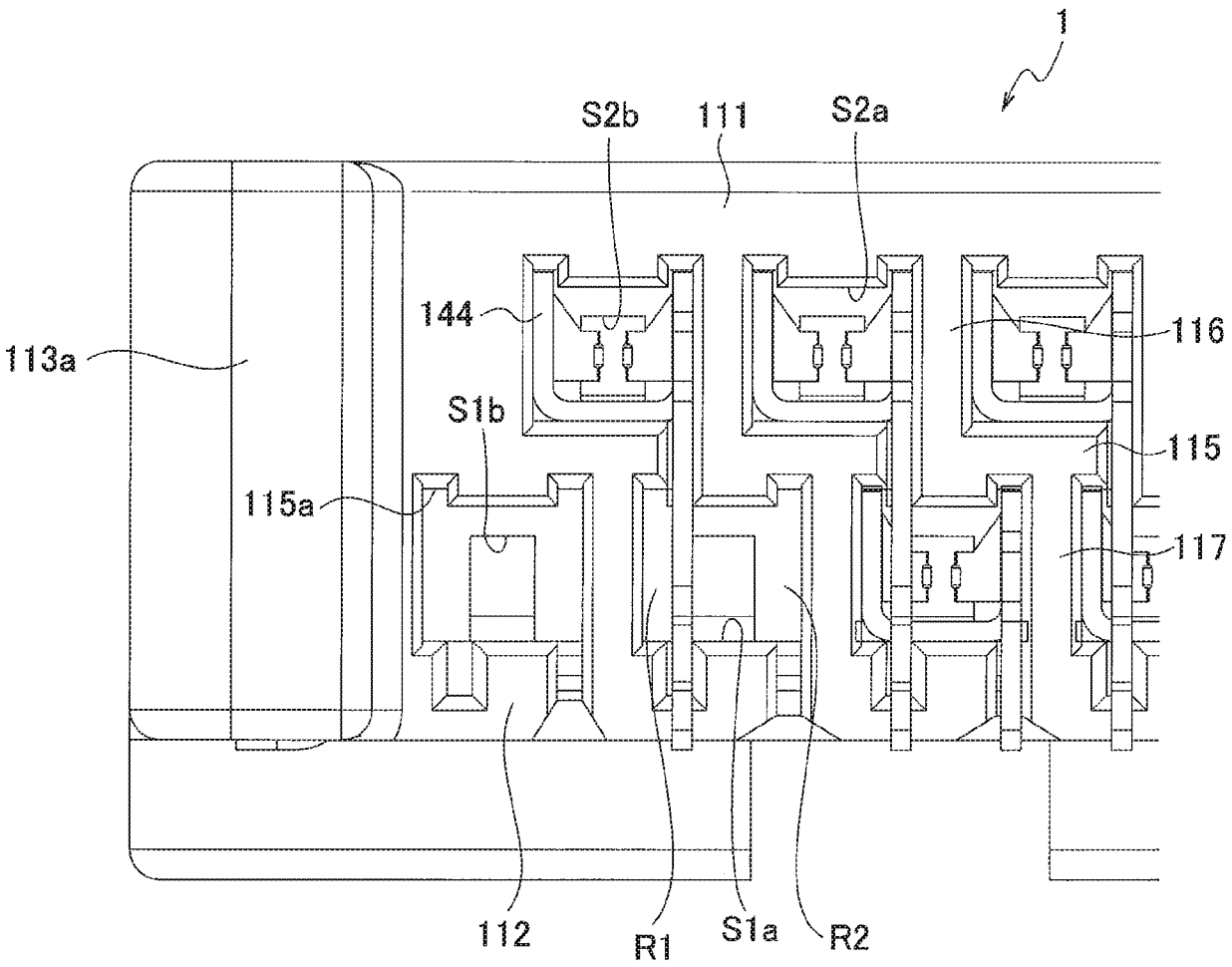
FIG. 16 is a view explaining a state where a first space of the plug connector is divided by a second leg part.

More specifically, as shown in FIG. 16, the groove 115*b* is aligned in the top-bottom direction with one of the grooves 111*c* (the one on the right side in FIG. 16) when the plug housing 10 is viewed from the rear side in the front-rear direction. A leg part 141 of the press-fitted (inserted) upper plug terminal 14 has its upper part inserted into this groove 115*b*.

Moreover, a groove 112*d* extending in the top-bottom direction and having its upper end opened into the first space S1 is formed at the rear end of the bottom wall 112. To be more specific, the groove 112*d*, one of the grooves 111*c* (the one on the right side in FIG. 16), and the groove 115*b* are arranged so as to be aligned in the top-bottom direction with each other when the plug housing 10 is viewed from the rear side in the front-rear direction. The leg part 141 of the press-fitted (inserted) upper plug terminal 14 has its lower part inserted into this groove 112*d*.

Furthermore, a groove 112*e* extending in the top-bottom direction and having both ends opened into the first space S1 and below the plug housing 10, respectively, is formed at the rear end of the bottom wall 112. To be more specific, the groove 112*e* is formed so as to face, in the top-bottom direction, one of the two grooves 115*a* (the one on the right side in FIG. 16 and FIG. 17) formed so as to communicate with one of the first spaces S1.

More specifically, as shown in FIG. 16, the groove 112*e* is aligned in the top-bottom direction with one of the grooves 115*a* (the one on the right side in FIG. 16) when the plug housing 10 is viewed from the rear side in the front-rear direction. A leg part 131 of the press-fitted (inserted) lower plug terminal 13 is inserted into this groove 112*e*.

Moreover, a recess part 112*f* that is opened downward and rearward and extends in the front-rear direction is formed at the rear end part of the bottom wall 112. In this recess part 112*f*, a mounting piece (mounting part) 132 of the press-fitted (inserted) lower plug terminal 13 is received.

Furthermore, extension parts 113*a*, 113*a* extending rearward are formed on the pair of side walls 113, 113, respectively. A region where the extension parts 113*a*, 113*a* face each other serves as a recess part 113*b* that houses mounting pieces (mounting parts) 132 and 142 of the plug terminals 13 and 14.

As described above, in this embodiment, the mounting pieces (mounting parts) 132 and 142 of the plug terminals 13 and 14 are mounted on the conductor part 151*b*A of the cable 1A at the position closer to the front than the rear ends of the extension parts 113*a*, 113*a*. Furthermore, in this embodiment, tips (rear ends) of the extension parts 113*a*, 113*a* are fixed to the fixing parts 15*d*A of the cable 1A. In this event, the connection region 11A of the cable 1A is sandwiched between the extension parts 113*a*, 113*a* and the reinforcing plate 14A.

In this way, when the cable 1A is fanned to move away from the reinforcing plate 14A, the cable 1A and the reinforcing plate 14A can be more surely suppressed from coming off each other. Furthermore, since the mounting pieces (mounting parts) 132 and 142 of the plug terminals 13 and 14 are positioned closer to the front than the tips (rear ends) of the extension parts 113*a*, 113*a*, the leg parts 131 and 141 of the plug terminals 13 and 14 as well as the mounting pieces 132 and 142 can be prevented from being deformed by fanning of the cable 1A. More specifically, the mounting parts between the cable 1A and the plug terminals 13 and 14 can be protected from fanning of the cable 1A.

Moreover, at the front ends of the pair of side walls 113, 113, holding bracket attachments 113*c*, 113*c* are formed, respectively, to hold the holding brackets 15.

In this embodiment, the holding bracket attachment 113*c* includes: a recess part 113*d* opened outward in the top-bottom direction and in the width direction; and slits 113*e*, 113*e* provided continuously inward, in the width direction, of the recess part 113*d*, into which both ends, in the front-rear direction, of a main body part 151 of the holding bracket 15 is inserted. In a state where the holding brackets 15 are held by the plug housing 10, fixing pieces 152 provided continuously from lower ends of the main body parts 151 are fixed to the fixing parts 15*c*A of the cable 1A, thereby fixing the plug housing 10 to the cable 1A.

Moreover, in this embodiment, the plug terminals each include: a main body part to be inserted into a space formed in the plug housing 10; a leg part extending from the main body part toward the mounting surface 1*a*A of the cable 1A in a state where the plug terminals are mounted on the cable (the mounting member) 1A; and a mounting part provided continuously from the leg part and to be mounted on the cable 1A.

To be more specific, the plug terminals include the lower plug terminal 13 to be press-fitted (inserted) into the first space S formed on the lower side (mounting surface 1*a*A side) of the housing main body 11. The plug terminals further include the upper plug terminal 14 to be press-fitted (inserted) into the second space S2 formed on the upper side (position further away from the mounting surface 1*a*A than the first space S1) of the housing main body 11.

In this embodiment, the lower plug terminal 13 is conductive, and a plurality of the lower plug terminals 13 are arranged in the width direction (Y direction) of the plug housing 10. As shown in FIGS. 12A to 12F, the lower plug terminal 13 has a shape formed by bending a strip-shaped metal member in a strip thickness direction, and has an approximately U-shape when viewed along the insertion direction (front-rear direction; X direction) (see FIG. 12E and FIG. 12F). Such a lower plug terminal 13 can be formed, for example, by bending a strip-shaped metal member.

The lower plug terminal 13 also includes a first main body part 130 to be press-fitted (inserted) into the first space S1. The lower plug terminal 13 further includes: a first leg part 131 extending from the first main body part 130 toward the mounting surface 1*a*A in a state where the lower plug terminal 13 is mounted on the cable (the mounting member) 1A; and a first mounting piece (first mounting part) 132 connected to the first leg part 131 and to be mounted on the cable 1A.

The first main body part 130 includes a bottom wall 133 and a side wall 134 connected to both ends, in the width direction (Y direction) of the bottom wall 133.

The bottom wall 133 includes: a bottom wall main body 135 provided continuously from the lower end of the side wall 134; and a contact protection part 136 that is provided continuously from the front end of the bottom wall main body 135 and protrudes forward. This contact protection part 136 prevents a contact part 130*a* of the lower plug terminal 13 from coming into contact with the housing main body 11 when the first main body part 130 is press-fitted (inserted) into the first space S1.

The bottom wall main body 135 and the contact protection part 136 have restricting pieces 135*a* and 136*a* formed therein, respectively, which protrude outward from both ends in the width direction (Y direction). These restricting pieces 135*a* and 136*a* prevent the first main body part 130 from being obliquely press-fitted (inserted) when the first main body part 130 is press-fitted (inserted) into the first space S1.

The side wall 134 includes: a side wall main body 137 having its lower end provided continuously from the bottom wall main body 135; and an elastically deformable contact piece 138 that is provided continuously from the front end of the side wall main body 137 and comes into contact with the contact part of the receptacle connector.

The side wall main body 137 has a restricting protrusion 137*a* formed at its upper end. This restricting protrusion 137*a* prevents the first main body part 130 from being lifted when press-fitted (inserted) into the first space S1.

The contact piece 138 includes: an inner bent piece 138*a* provided continuously from the front end of the side wall main body 137 so as to be bent inward in the width direction;

and an outer bent piece 138*b* provided continuously from the front end of the inner bent piece 138*a* so as to be bent inward in the width direction.

In this embodiment, the contact pieces 138 are provided continuously from the pair of side wall main bodies 137, 137, respectively, and are formed to be approximately line-symmetric in the plan view. More specifically, the pair of contact pieces 138, 138 include: the inner bent pieces 138*a*, 138*a* bent in a direction of getting close to each other toward the front; and the outer bent pieces 138*b*, 138*b* bent in a direction of getting away from each other toward the front.

Figure 3A:
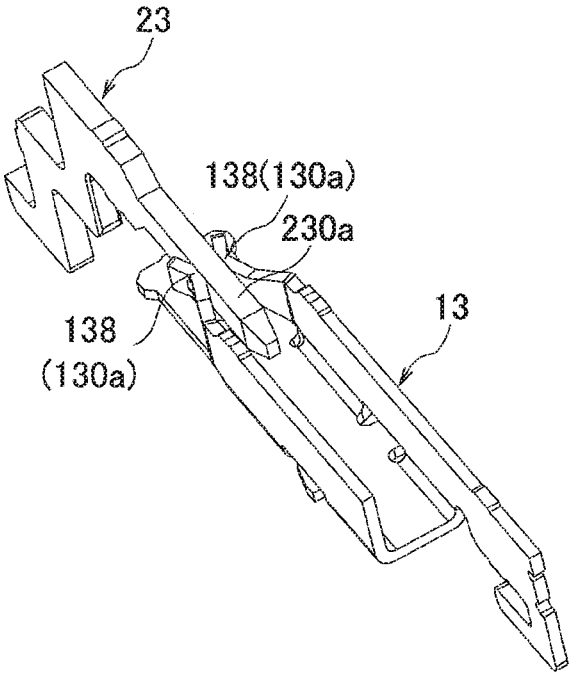
FIGS. 3A and 3B are perspective views showing contact state of terminals on the plug connector side and terminals on the receptacle connector side of the connector set shown as an example, FIG. 3A showing a contact state of a lower terminal on the plug connector side and a lower terminal on the receptacle connector side, and FIG. 3B showing a contact state of an upper terminal on the plug connector side and an upper terminal on the receptacle connector side.

The contact part of the receptacle connector is sandwiched in a spot (connection between the inner bent piece 138*a* and the outer bent piece 138*b*) where the pair of contact pieces 138, 138 come closest to each other (see FIG. 3A and FIG. 6A). Thus, in this embodiment, the pair of contact pieces 138, 138 function as the contact part 130*a* of the lower plug terminal 13. Also, the pair of outer bent pieces 138*b* function as a guide part for more smoothly guiding the contact part of the receptacle connector.

Furthermore, in this embodiment, an extension wall 139 protruding rearward is provided continuously from the rear end of one of the pair of side wall main bodies 137, 137, and the first main body part 130 has a shape having its one side protruding rearward.

This extension wall 139 has a press-fit protrusion 139*a* formed at its upper end. The first main body part 130 is press-fitted into the first space S1 by sticking the press-fit protrusion 139*a* into the housing main body 11.

Note that, in this embodiment, the grooves 115*a* are formed to guide the press-fitting (insertion) of the lower plug terminal 13 into the first space S1 while the upper ends of the side walls 134 of the lower plug terminal 13 are inserted into the grooves. Therefore, a positional shift in the lower plug terminal 13 is suppressed even when the lower plug terminal 13 is press-fitted (inserted) into the first space S1 by pressing one side wall 134 protruding rearward of the first main body part 130. As a result, the lower plug terminal 13 can be press-fitted (inserted) more smoothly and more accurately into the first space S1.

The first leg part 131 is provided extending downward (toward the cable 1A: mounting member) from the rear and of the extension wall 139. Thus, in this embodiment, the first leg part 131 is provided extending in the housing thickness direction from the first main body part 130 that is press-fitted (inserted) into the first space S1. Moreover, a first mounting piece 132 is provided continuously from the lower end of the first leg part 131 so as to protrude forward.

In this event, the first leg part 131 and the first mounting piece 132 are each formed into a thin plate shape (plate shape) such that its plate thickness direction is approximately the same as the thickness direction of the side wall main body 137.

Therefore, in a state where the first main body part 130 is inserted into the first space S1 and also the first mounting piece (first mounting part) 132 is mounted on the cable (mounting member) 1A, the thickness direction of the first leg part 131 is the width direction (Y direction). More specifically, in a state where the plug connector 1 is mounted on the cable 1A, the thickness direction of the first leg part 131 is the direction intersecting with the insertion direction of the first main body part 130 into the first space S1 and with the direction normal to the mounting surface 1*a*A.

Meanwhile, the upper plug terminal 14 is also conductive, and a plurality of the upper plug terminals 14 are arranged in the width direction (Y direction) of the plug housing 10. As shown in FIGS. 13A to 13F, the upper plug terminal 14 has a shape formed by bending a strip-shaped metal member in a strip thickness direction, and has an approximately U-shape when viewed along the insertion direction (front-rear direction; X direction) (see FIG. 13E and FIG. 13F). Such a upper plug terminal 14 can also be formed, for example, by bending a strip-shaped metal member.

The upper plug terminal 14 also includes a second main body part 140 to be press-fitted (inserted) into the second space S2. The upper plug terminal 14 further includes: a second leg part 141 extending from the second main body part 140 toward the mounting surface 1*a*A in a state where the upper plug terminal 14 is mounted on the cable (the mounting member) 1A; and a second mounting piece (second mounting part) 142 provided continuously from the second leg part 141 and to be mounted on the cable 1A.

The second main body part 140 includes a bottom wall 143 and a side wall 144 provided continuously from both ends, in the width direction (Y direction) of the bottom wall 143.

The bottom wall 143 includes: a bottom wall main body 145 provided continuously to the lower end of the side wall 144; and a contact protection part 146 that is provided continuously from the front end of the bottom wall main body 145 and protrudes forward. This contact protection part 146 prevents a contact part 140*a* of the upper plug terminal 14 from coming into contact with the housing main body 11 when the second main body part 140 is press-fitted (inserted) into the second space S2.

The bottom wall main body 145 and the contact protection part 146 have restricting pieces 145*a* and 146*a* formed therein, respectively, which protrude outward from both ends in the width direction (Y direction). These restricting pieces 145*a* and 146*a* prevent the second main body part 140 from being obliquely press-fitted (inserted) when the second main body part 140 is press-fitted (inserted) into the second space S2.

The side wall 144 includes: a side wall main body 147 having its lower end connected to the bottom wall main body 145; and an elastically deformable contact piece 148 that is provided continuously from the front end of the side wall main body 147 and comes into contact with the contact part of the receptacle connector.

The side wall main body 147 has a restricting protrusion 147*a* formed at its upper end. This restricting protrusion 147*a* prevents the second main body part 140 from being lifted when press-fitted (inserted) into the second space S2.

The contact piece 148 includes: an inner bent piece 148*a* provided continuously from the front end of the side wall main body 147 so as to be bent inward in the width direction; and an outer bent piece 148*b* provided continuously from the front end of the inner bent piece 148*a* so as to be bent inward in the width direction.

In this embodiment, the contact pieces 148 are continuous from the pair of side wall main bodies 147, 147, respectively, and are formed to be approximately line-symmetric in the plan view. More specifically, the pair of contact pieces 148, 148 include: the inner bent pieces 148*a*, 148*a* bent in a direction of getting close to each other toward the front; and the outer bent pieces 148*b*, 148*b* bent in a direction of getting away from each other toward the front.

Figure 3B:
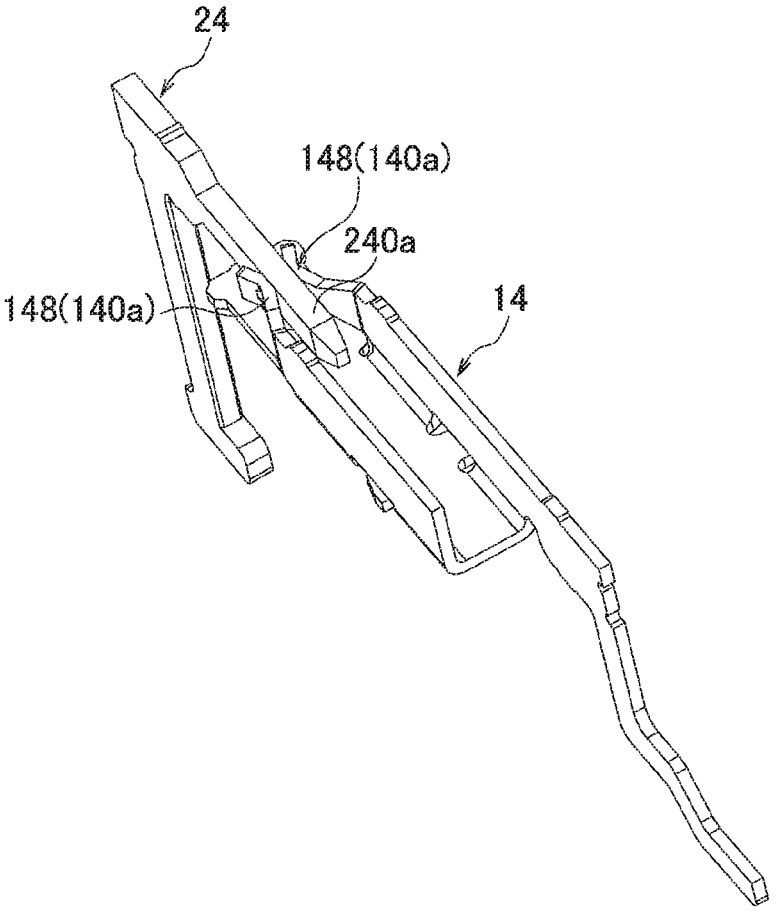

The contact part of the receptacle connector is sandwiched in a spot (connection between the inner bent piece 148*a* and the outer bent piece 148*b*) where the pair of contact pieces 148, 148 come closest to each other (see FIG. 3B and FIG. 6B). Thus, in this embodiment, the pair of contact pieces 148, 148 function as the contact part 140*a* of the upper plug terminal 14. Also, the pair of outer bent pieces 148*b* function as a guide part for more smoothly guiding the contact part of the receptacle connector.

Furthermore, in this embodiment, an extension wall 149 protruding rearward is provided continuously from the rear end of one of the pair of side wall main bodies 147, 147, and the second main body part 140 has a shape having its one side protruding rearward.

This extension wall 149 has a press-fit protrusion 149*a* formed at its upper end. The second main body part 140 is press-fitted into the second space S2 by sticking the press-fit protrusion 149*a* into the housing main body 11.

Note that, in this embodiment, the grooves 111*c* are formed to guide the press-fitting (insertion) of the upper plug terminal 14 into the second space S2 while the upper ends of the side walls 144 of the upper plug terminal 14 are inserted into the grooves. Therefore, a positional shift in the upper plug terminal 14 is suppressed even when the upper plug terminal 14 is press-fitted (inserted) into the second space S2 by pressing one side wall 144 protruding rearward of the second main body part 140. As a result, the upper plug terminal 14 can be press-fitted (inserted) more smoothly and more accurately into the second space S2.

The second leg part 141 is provided extending downward (toward the cable 1A: mounting member) from the rear end of the extension wall 149. The second leg part 141 has its length, in the top-bottom direction, longer than the first leg part 131. Thus, in this embodiment, the second leg part 141 is provided extending in the housing thickness direction from the second main body part 140 that is press-fitted (inserted) into the second space S2. Moreover, a second mounting piece 142 is provided continuously from the lower end of the second leg part 141 so as to protrude rearward.

As described above, in this embodiment, the first mounting piece (first mounting part) 132 is provided continuously from the first leg part 131 so as to protrude forward (toward one side) in the front-rear direction (X direction: insertion direction into the space of the main body part). Also, the second mounting piece (second mounting part) 142 is provided continuously from the second leg part 141 so as to protrude rearward (toward the other side) in the front-rear direction (X direction: insertion direction into the space of the main body part).

Figure 14A:
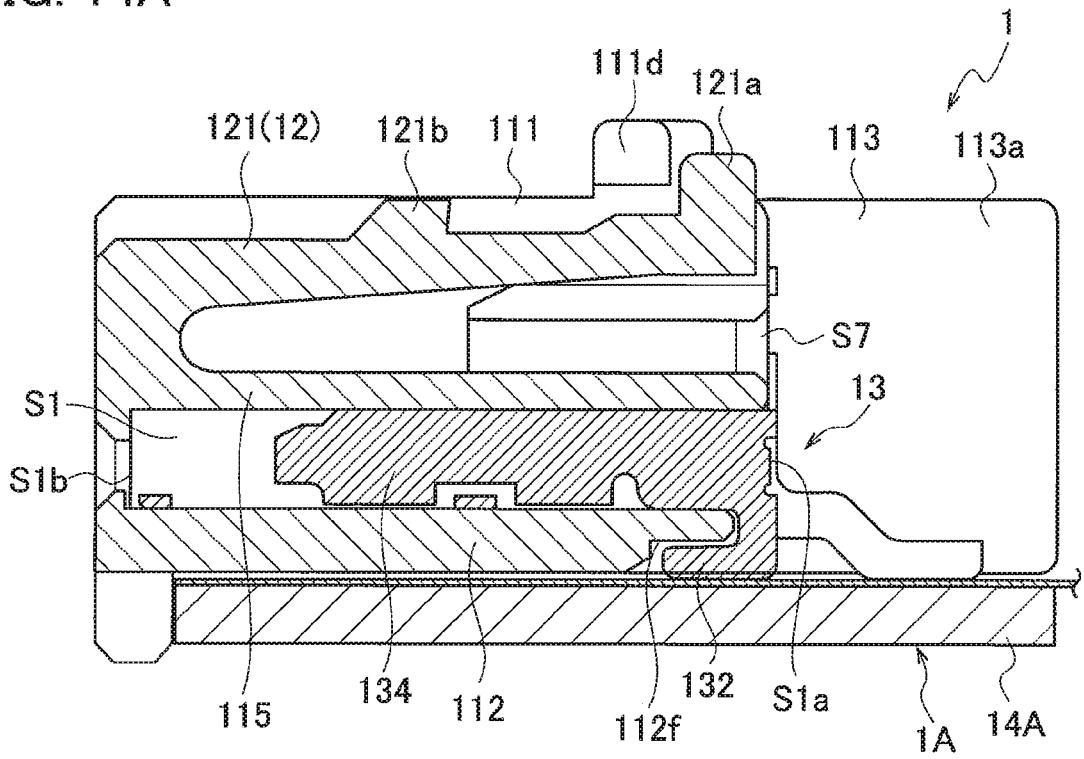
FIGS. 14A and 14B are sectional side views showing a state where the plug connector is mounted on the cable, FIG. 14A showing a state where the lower terminal is mounted on a conductor part of the cable and FIG. 14B showing a state where the upper terminal is mounted on the conductor part of the cable.
Figure 14B:
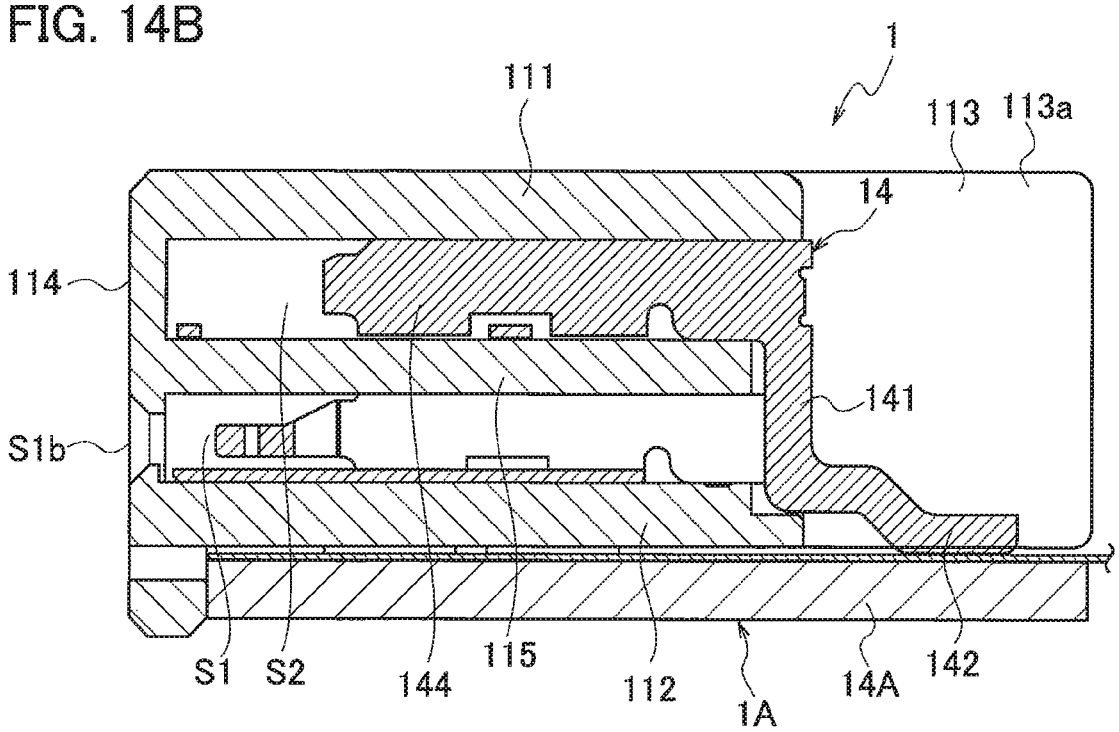
Figure 15:
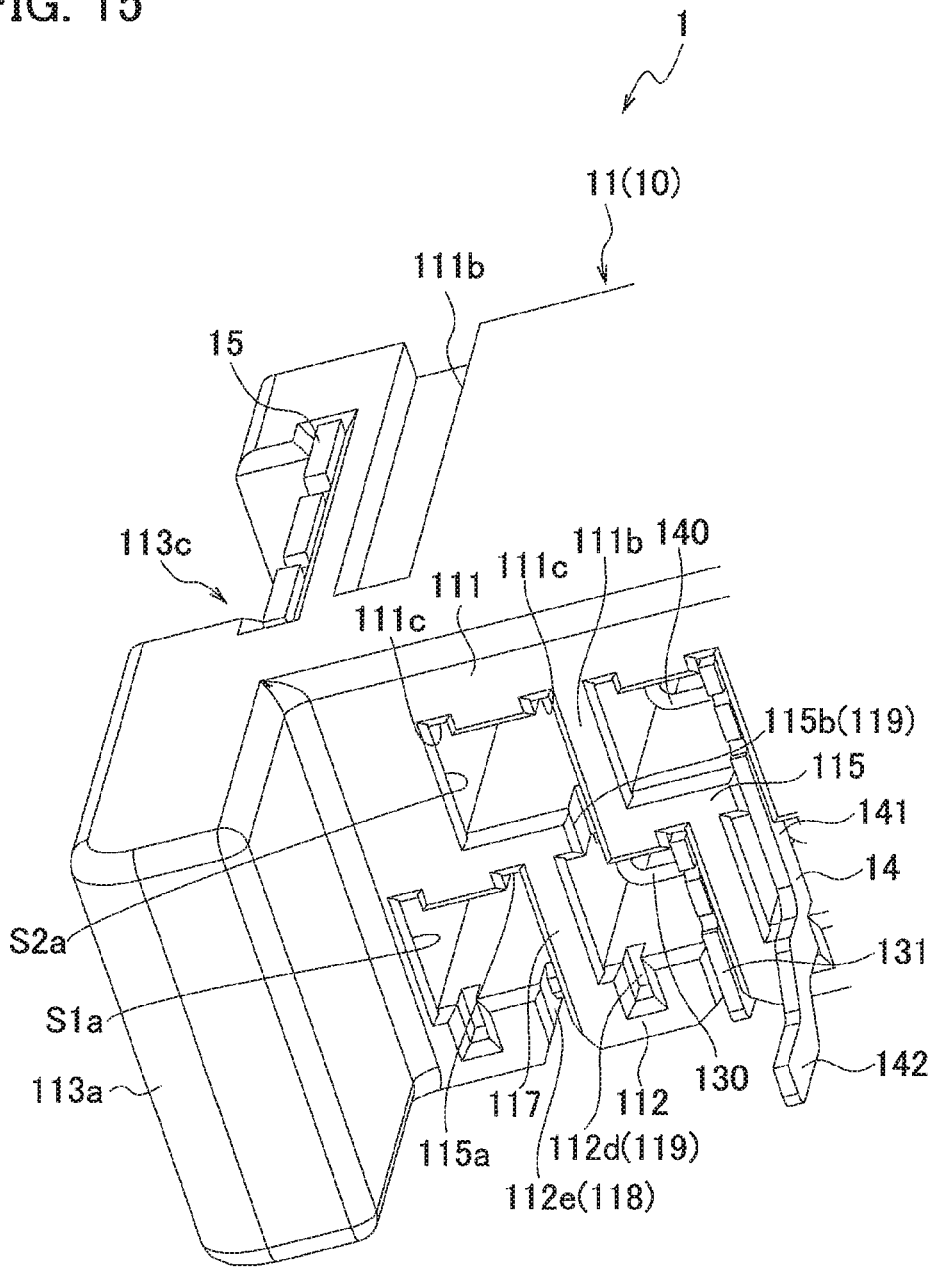
FIG. 15 is an enlarged perspective view showing a leg holding part of the plug connector.

The first leg part 131 and the second leg part 141 are located at approximately the same position in the front-rear direction in a state where the first main body part 130 and the second main body part 140 are inserted into the first space S1 and the second space S2 (see FIG. 14). At the same time, the first leg part 131 and the second leg part 141 are located at positions shifted by approximately a half pitch in the width direction in the state where the first main body part 130 and the second main body part 140 are inserted into the first space S1 and the second space S2.

Therefore, in this embodiment, the mounting parts (first and second mounting pieces 132 and 142) are arranged in a staggered pattern in a state where the plurality of plug terminals are held by the plug housing 10.

Furthermore, the first mounting piece 132 is housed in the recess part 112*f* formed at the rear end of the bottom wall 112 in the state where the first main body part 130 is inserted into the first space S1. Meanwhile, the second mounting piece 142 is positioned behind the insertion opening S1*a* of the second space S2 in the state where the second main body part 140 is inserted into the second space S2.

Therefore, the first mounting piece 132 overlaps with the plug housing 10 in the plan view in a state where the plurality of plug terminals are held by the plug housing 10 and also mounted on the cable 1A. At the same time, the second mounting piece 142 is exposed from the plug housing 10 in the plan view in a state where the plurality of plug terminals are held by the plug housing 10 and also mounted on the cable 1A.

More specifically, either one of the first and second mounting pieces (mounting parts) 132 and 142 overlaps with the plug housing 10 when the plug housing 10 is viewed along the direction normal to the mounting surface 1*a*A in a state where the plug connector 1 is mounted on the cable 1A.

Thus, in this embodiment, the mounting parts are arranged in a staggered pattern on either side of the insertion opening (rear end) of the space in the state where the plurality of plug terminals are held by the plug housing.

Moreover, the second leg part 141 and the second mounting piece 142 are also each formed into a thin plate shape (plate shape) such that its plate thickness direction is approximately the same as the thickness direction of the side wall main body 147.

Therefore, in a state where the second main body part 140 is inserted into the second space S2 and also the second mounting piece (second mounting part) 142 is mounted on the cable (mounting member) 1A, the thickness direction of the second leg part 141 is the width direction (Y direction). More specifically, in a state where the plug connector 1 is mounted on the cable 1A, the thickness direction of the second leg part 141 is the direction intersecting with the insertion direction of the second main body part 140 into the second space S2 and with the direction normal to the mounting surface 1*a*A.

Moreover, in this embodiment, the first insertion opening S1*a* is divided into two regions R1 and R2 by the second leg part 141 when viewed from the rear side in the front-rear direction in a state where the main body parts 130 and 140 of the terminals 13 and 14 are inserted into the spaces S1 and S2 (see FIG. 16). More specifically, the first insertion opening S1*a* of the first space S1 is divided into the two regions R1 and R2 by the second leg part 141 when the plug housing is viewed along the insertion direction of the main body parts 130 and 140 into the spaces S1 and S2 in a state where the plug connector 1 is mounted on the cable 1A.

Furthermore, in this embodiment, at the position where the press-fitting (insertion) of the first main body part 130 into the first space S1 is completed, the first leg part 131 is held in a state of being inserted into the groove 112*e* and having its movement restricted in the width direction (Y direction; thickness direction). More specifically, the groove 112*e* formed in the bottom wall 112 of the housing main body 11 functions as a leg part holder 118 to hold the first leg part 131. Thus, the plug connector 1 includes the leg part holder 118 connected to the plug housing 10 to hold the first leg part 131. In this embodiment, the leg part holder 118 is formed integrally with the plug housing 10. Note that the leg part holder may be formed by connecting a separate member from the plug housing 10 to the plug housing 10.

Moreover, at the position where the press-fitting (insertion) of the second main body part 140 into the second space S2 is completed, the second leg part 141 is held in a state of being inserted into the grooves 115*b* and 112*d* and having its movement restricted in the width direction (Y direction; thickness direction). More specifically, the groove 115*b* formed in the partition wall 115 of the housing main body 11 and the groove 112*d* formed in the bottom wall 112 thereof function as a leg part holder 119 to hold the second leg part 141. Thus, the plug connector 1 includes the leg part holder 119 connected to the plug housing 10 to hold the second leg part 141. The leg part holder 119 is also formed integrally with the plug housing 10 in this embodiment, but may be formed as a separate member.

In this way, the leg parts 131 and 141 are prevented from being deformed when the plug terminals 13 and 14 are press-fitted (inserted) into the spaces S1 and S2 of the main body parts 130 and 140, when the plug terminals 13 and 14 press-fitted (inserted) into the spaces S1 and S2 are mounted on the cable 1A, or the like.

[Configuration Example of Receptacle Connector 2]

Next, with reference to FIGS. 18 to 24, description is given of a configuration example of the receptacle connector 2.

Figure 18:
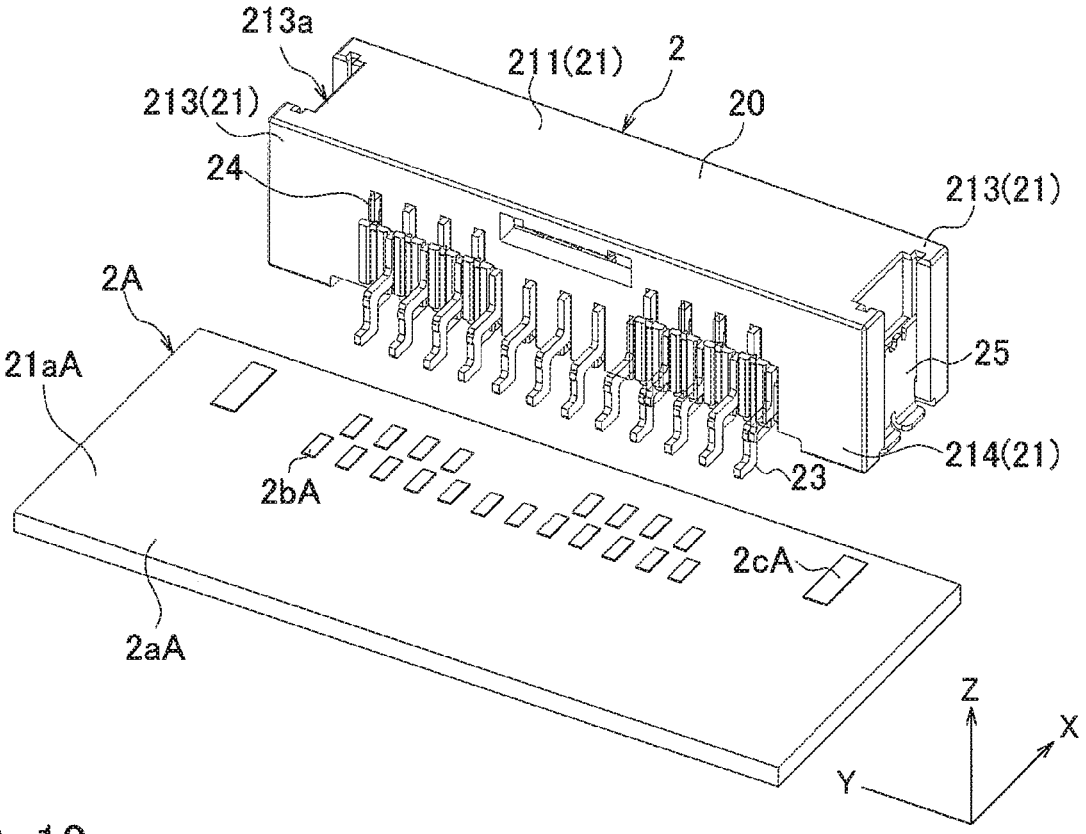
FIG. 18 is a perspective view showing a state before the receptacle connector included in the connector set shown as an example is mounted on the circuit board.
Figure 19:
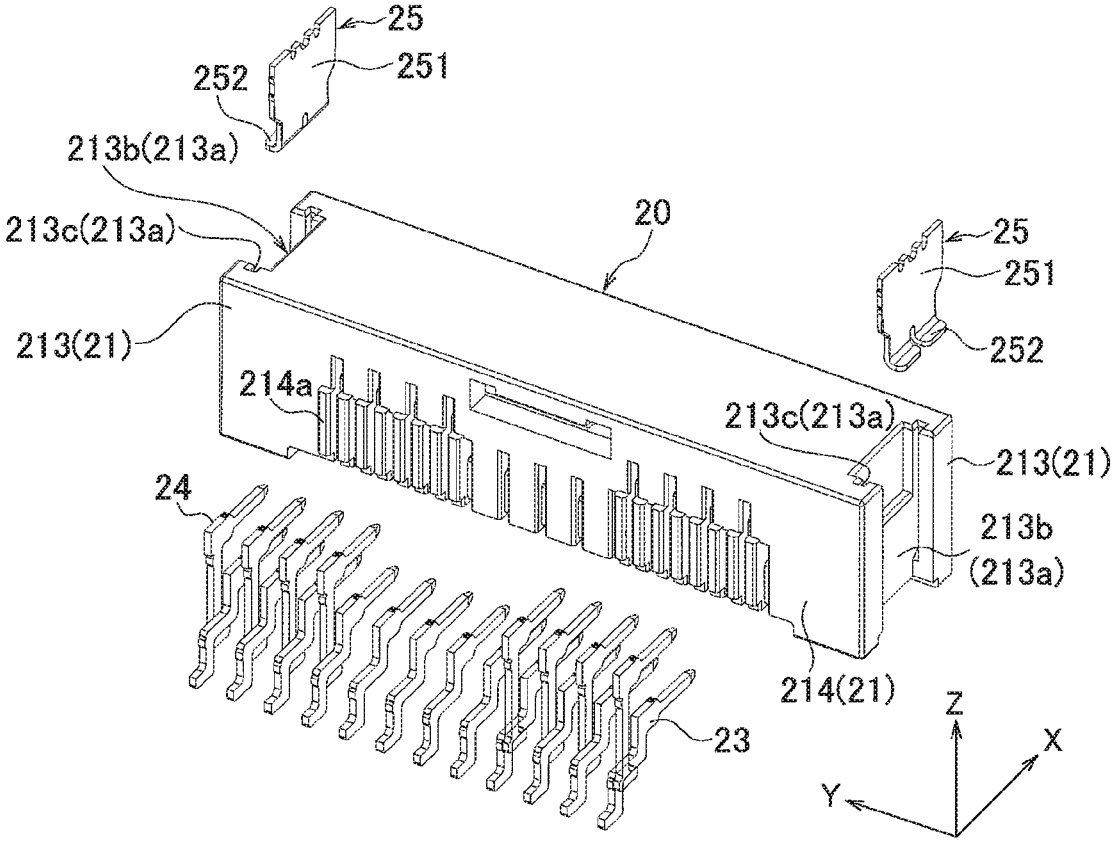
FIG. 19 is an exploded perspective view showing the receptacle connector included in the connector set shown as an example.
Figure 20A:
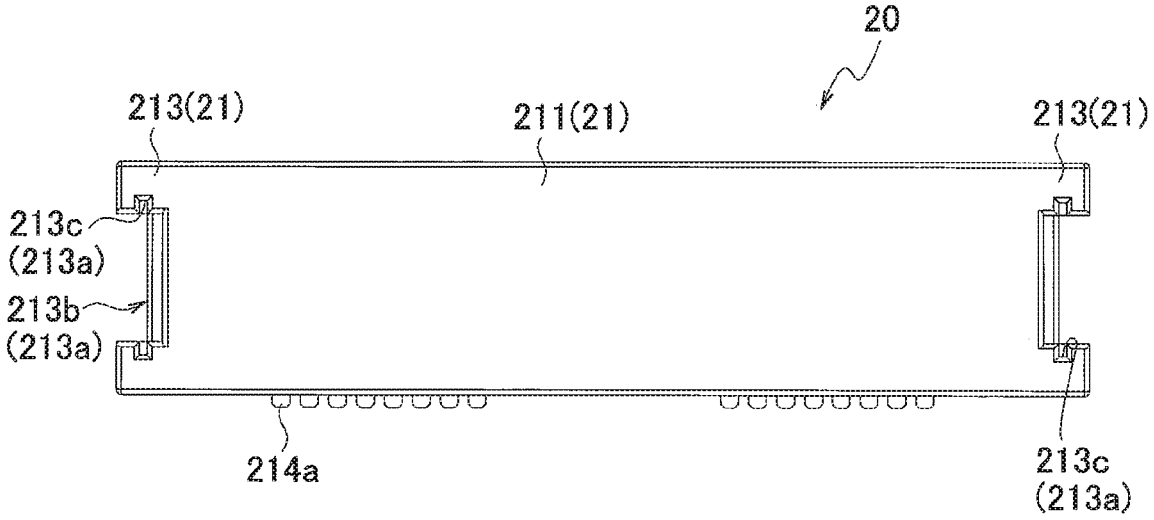
FIG. 20A is a plan view and FIG. 20B is a reverse side view, showing a receptacle housing included in the receptacle connector shown as an example.
Figure 20B:
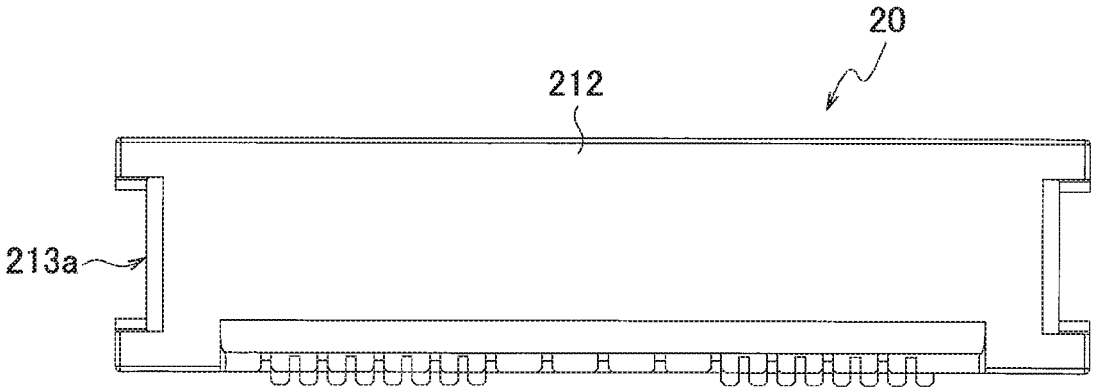
Figure 21A:
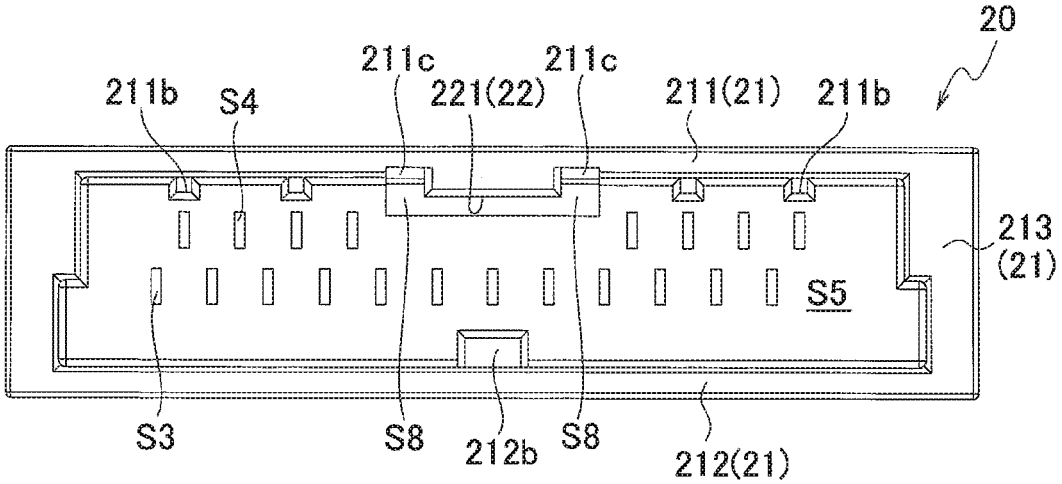
FIG. 21A is a front view.
Figure 21B:
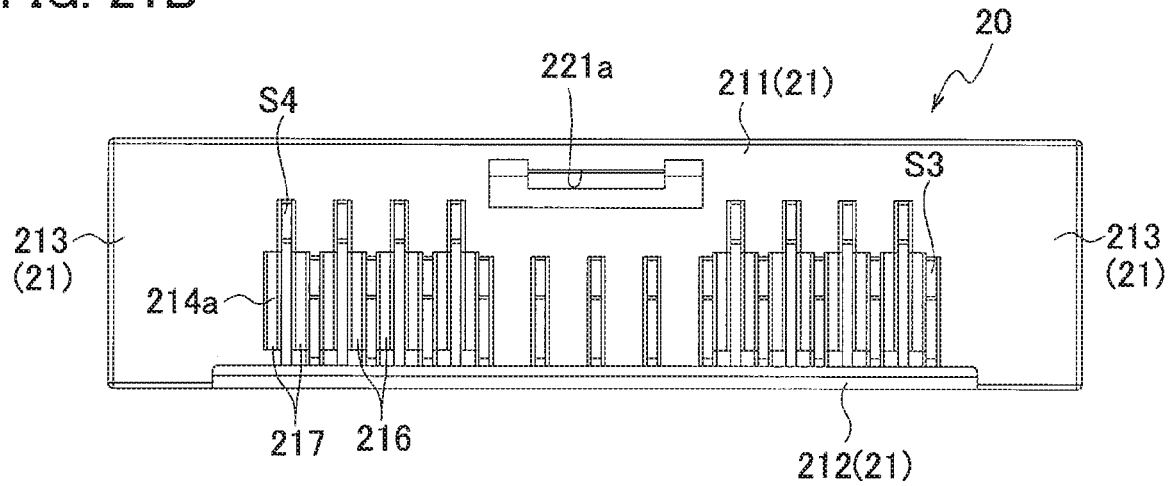
FIG. 21B is a back view.
Figure 21C:
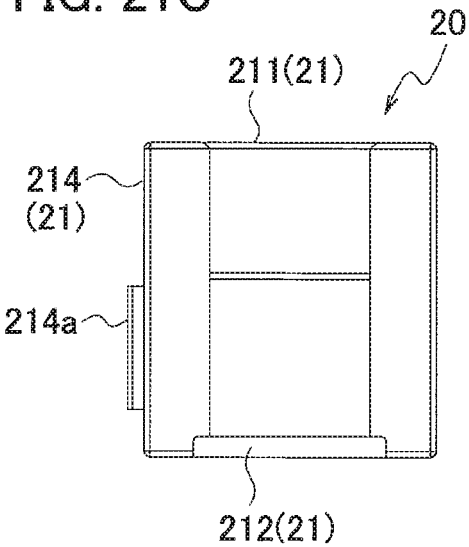
FIG. 21C is a side view.
Figure 21D:
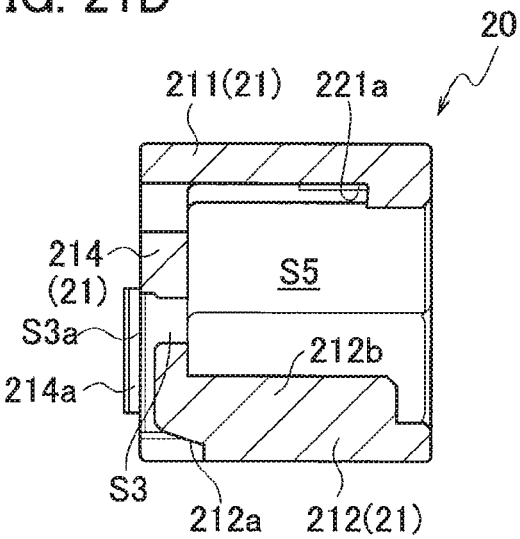
FIG. 21D is a sectional side view, showing the receptacle housing included in the receptacle connector shown as an example.
Figure 22A:
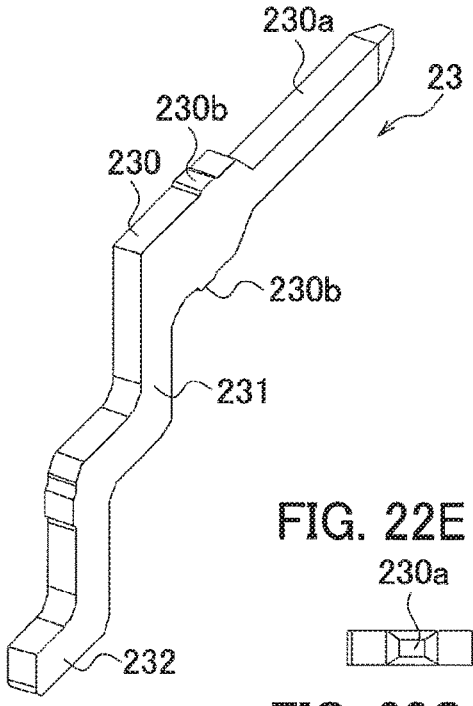
FIG. 22A is a perspective view.
Figure 22E:
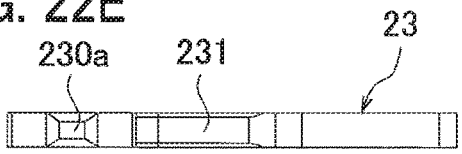
FIG. 22E is a front view.
Figure 22B:
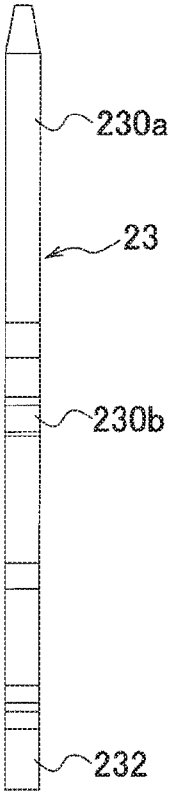
FIG. 22B is a plan view.
Figure 22C:
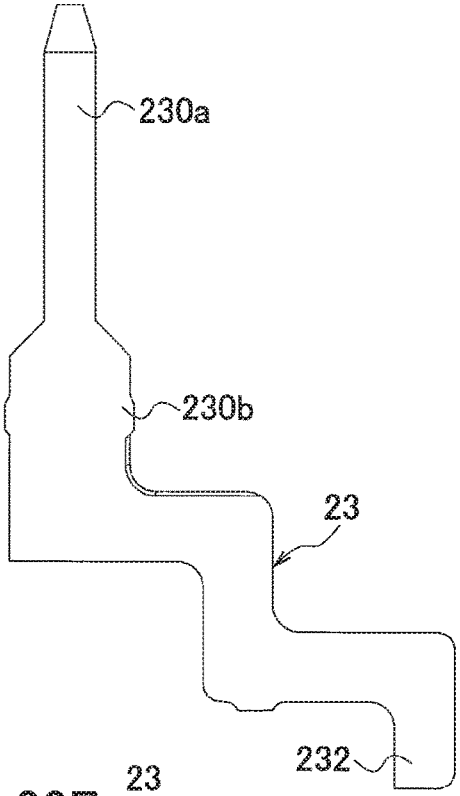
FIG. 22C is a side view.
Figure 22D:
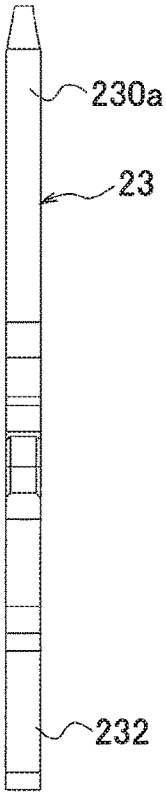
FIG. 22D is a reverse side view.
Figure 22F:
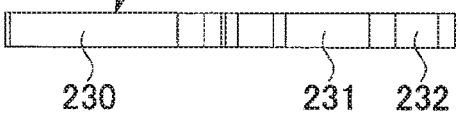
FIG. 22F is a back view, showing a lower terminal included in the receptacle connector shown as an example.
Figure 23A:
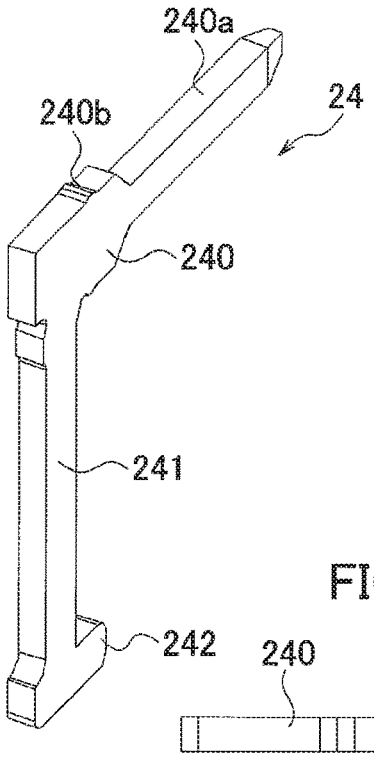
FIG. 23A is a perspective view.
Figure 23B:
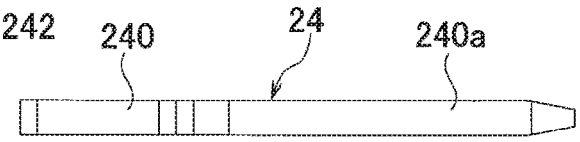
FIG. 23B is a plan view.
Figure 23C:
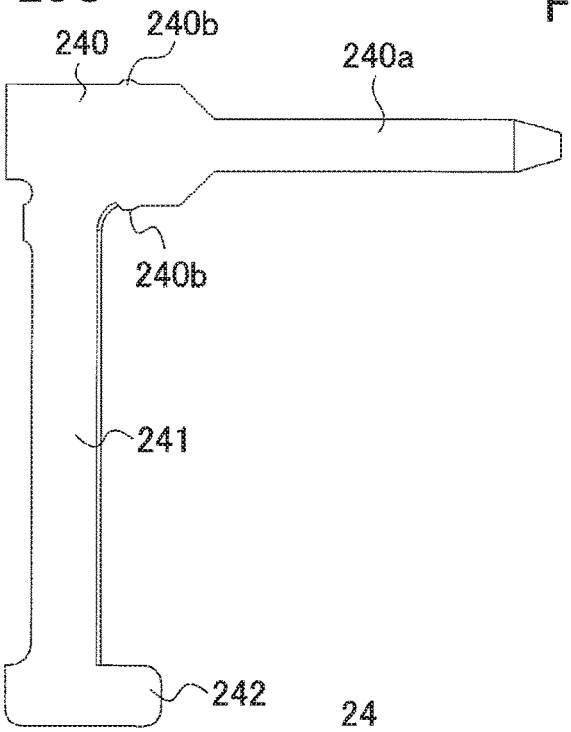
FIG. 23C is a side view.
Figure 23F:
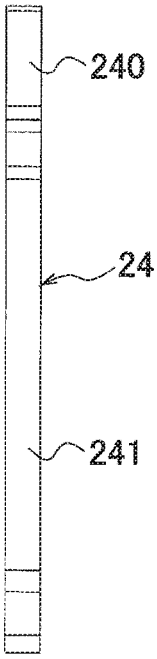
FIG. 23F is a back view, showing an upper terminal included in the receptacle connector shown as an example.
Figure 23E:
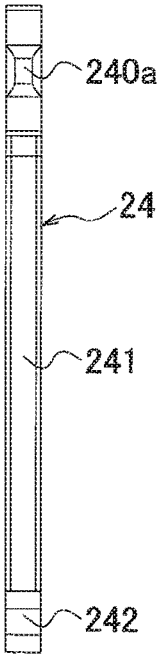
FIG. 23E is a front view.
Figure 23D:
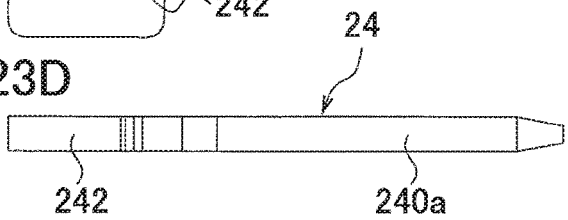
FIG. 23D is a reverse side view.
Figure 24A:
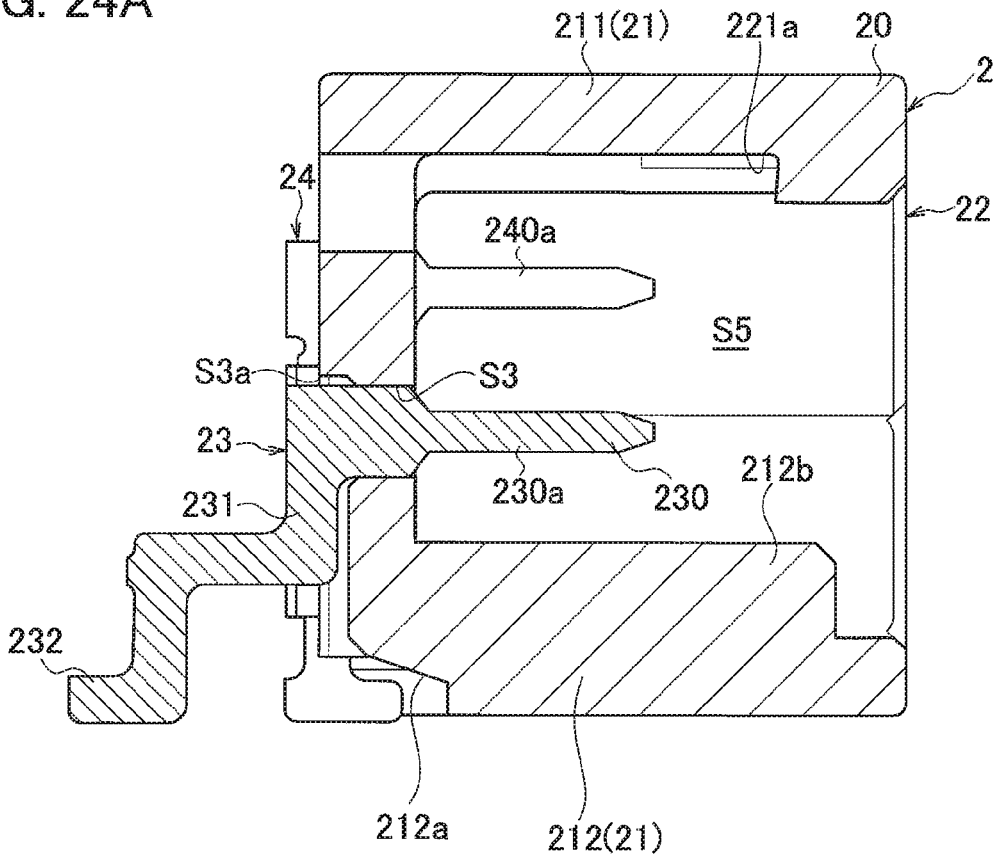
FIGS. 24A and 24B are sectional side views showing a state where the receptacle connector shown as an example is mounted on the circuit board, FIG. 24A showing a state where the lower terminal is mounted on a conductor part of the circuit board and FIG. 24B showing a state where the upper terminal is mounted on the conductor part of the circuit board.
Figure 24B:
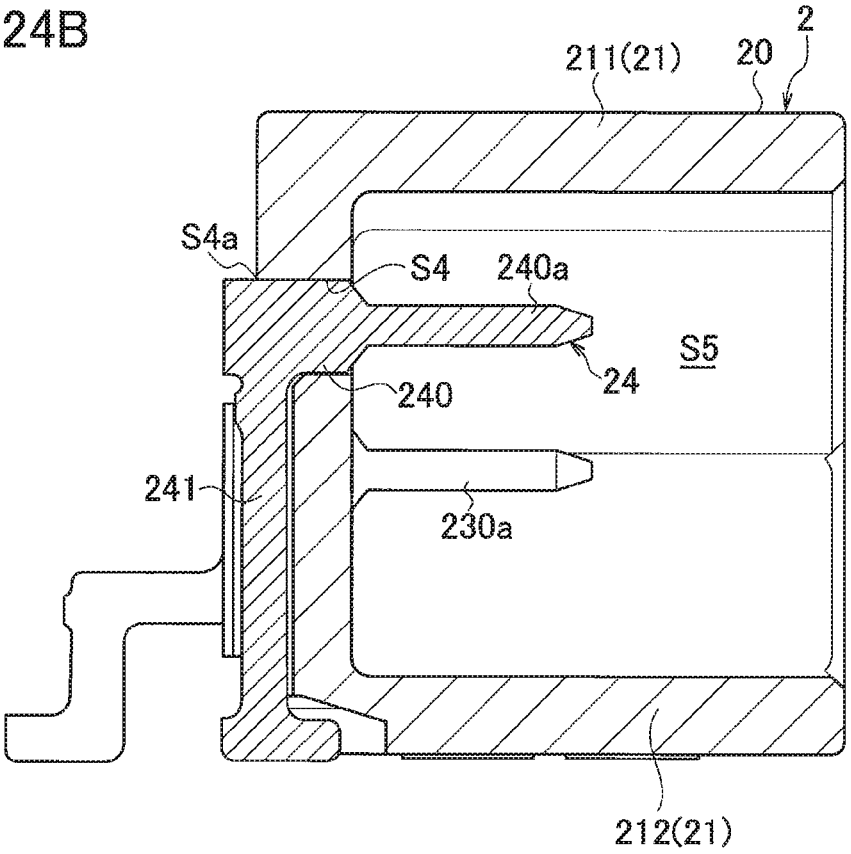
Figure 25B:
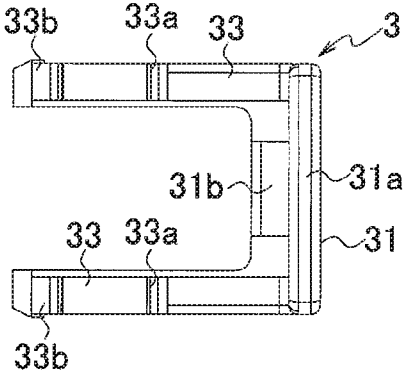
FIG. 25B is a plan view.
Figure 25C:
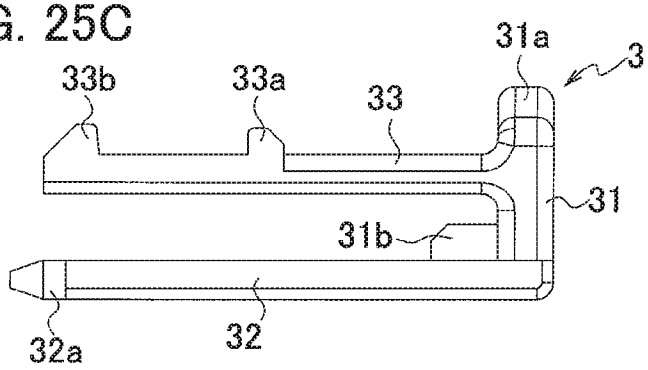
FIG. 25C is a side view.
Figure 25D:
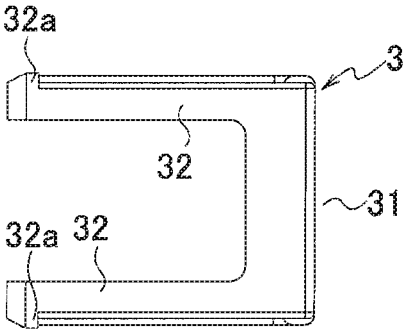
FIG. 25D is a reverse side view.
Figure 25A:
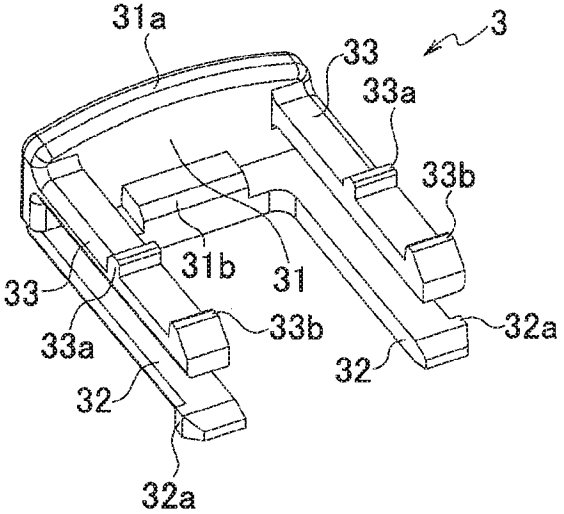
FIG. 25A is a perspective view.
Figure 25F:
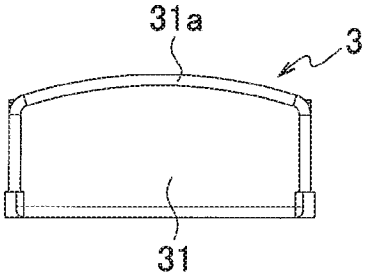
FIG. 25F is a back view, showing the slide member included in the connector set shown as an example.
Figure 25E:
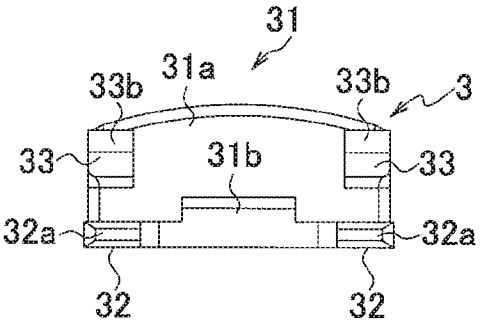
FIG. 25E is a front view.

As shown in FIG. 18 and FIG. 19, the receptacle connector 2 includes a receptacle housing (second housing) 20 and receptacle terminals (second terminals) 23 and 24 held by the receptacle housing 20. The receptacle connector 2 also includes holding brackets 25 held by the receptacle housing 20.

The receptacle connector 2 is configured to be mounted on the circuit board 2A as the mounting member by mounting the receptacle terminals 23 and 24 held by the receptacle housing 20 on the conductor part 2*b*A of the circuit board 2A disposed outside the receptacle housing 20. Note that the receptacle terminals 23 and 24 are also mounted on the conductor part 2*b*A by soldering or the like. The holding brackets 25 are fixed to the fixing parts 2*c*A of the circuit board 2A by soldering or the like, in a state where the holding brackets 25 are held by the receptacle housing 20, to fix the receptacle housing 20 to the circuit board 2A.

Note that the circuit board 2A includes a board main body 2*a*A that has an approximately rectangular plate shape and is formed of a rigid and insulating resin material or the like. The conductor part 2*b*A and the fixing parts 2*c*A are formed so as to be exposed to the surface 21*a*A of the board main body 2*a*A. Thus, in this embodiment, the surface 21*a*A of the board main body 2*a*A serves as a mounting surface.

The receptacle housing 20 includes a rigid housing main body (second housing main body) 21, and can be formed, for example, using an insulating resin material.

The housing main body 21 also has a lock insertion part 22 formed on its upper side. The lock part 12 configured to hold the plug housing 10 and the receptacle housing 20 in their fitted state or to release the fitted state is inserted into this lock insertion part 22.

Thus, in this embodiment, the receptacle housing 20 includes the housing main body 21 and the lock insertion part 22 formed in the housing main body 21.

The housing main body 21 includes a top wall 211, a bottom wall 212, a pair of side walls 213 connecting both ends, in the width direction (Y direction), of the top wall 211 and the bottom wall 212, and a rear wall 214 provided continuously from rear ends of the top wall 211, the bottom wall 212, and the side walls 213, 213.

The lock insertion part 22 is formed in the middle, in the width direction, of the top wall 211. To be more specific, the lock insertion part 22 includes a housing part 221 that is formed inside of the top wall 211, and houses the lever part 121. In the middle, in the front-rear direction, of the housing part 221, an engagement recess part (engaged part) 221*a* is formed to engage with the engagement protrusion 121*b* of the lock part 12.

In addition, on either side, in the width direction, of the housing part 221, insertion spaces S8 into which the upper arm parts 33 of the slide member 3 are inserted are formed. On the top wall 211, protrusions (locked part) 211*c* protruding downward are formed such that the protrusions (locked part) 211*c* are located in the insertion spaces S8 as viewed in an insertion direction (front-rear direction; X direction). These protrusions 211*c* are configured to deflect the upper arm parts 33 downward and to lock engagement protrusions 32*b* formed on the tip of the upper arm parts 33.

The top wall 211 also has guide protrusions 211*b* formed thereon, which are housed in the guide grooves 111*b*.

In addition, on the middle, in the width direction, of the bottom wall 212, a positioning protrusion 212*b* protruding upward is formed. When the plug housing 10 is fitted into the receptacle housing 20, this positioning protrusion 212*b* positions the cable 1A in the width direction.

Moreover, the rear wall 214 has a plurality of spaces formed therein, which penetrate in the front-rear direction. In this embodiment, a plurality of spaces arranged in the width direction (Y direction) are formed in two stages in the top-bottom direction (Z direction). These spaces are formed in a staggered pattern when viewed from the rear side in the front-rear direction of the housing main body 21. Accordingly, the receptacle connector 2 is reduced in size in the width direction.

Then, the receptacle terminals 23 and 24 are press-fitted (inserted) into the spaces penetrating in the front-rear direction, respectively.

To be more specific, the spaces formed on the lower side (mounting surface 21*a*A side) of the housing main body 21 serve as first spaces S3 into which lower receptacle terminals 23 to be described later, among the receptacle terminals 23 and 24, are press-fitted (inserted).

On the other hand, the spaces formed on the upper side (position further away from the mounting surface 21*a*A than the first spaces S3) of the housing main body 21 serve as second spaces S4 into which upper receptacle terminals 24 to be described later, among the receptacle terminals 23 and 24, are press-fitted (inserted).

The lower receptacle terminals 23 are each configured to be press-fitted (inserted) forward from an opening at the rear end side of the first space S3. This opening at the rear end side of the first space S3 serves as an insertion opening (insertion slot) S3*a*. Likewise, the upper receptacle terminals 24 are each configured to be press-fitted (inserted) forward from an opening at the rear end side of the second space S4. This opening at the rear end side of the second space S4 serves as an insertion opening (insertion slot) S4*a*.

Moreover, the housing main body 21 has a fitting space S5 formed therein, which is opened forward (toward the plug connector 1 side). This fitting space S5 is a space into which the housing main body 11 of the plug housing 10 is inserted and fitted, and which is defined by the top wall 211, the bottom wall 212, the pair of side walls 213, 213, and the rear wall 214. Therefore, the first space S3 and the second space S4 are formed to communicate with the fitting space S5, respectively.

Furthermore, in this embodiment, a plurality of projections 214*a* extending in the top-bottom direction and protruding rearward are arranged in the width direction at the rear end of the rear wall 214. To be more specific, the projections 214*a* are formed between the first and second spaces S3 and S4 adjacent to each other in the width direction.

Moreover, a recess part 212*a* that is opened downward and rearward and extends in the front-rear direction is formed at the rear end of the bottom wall 212. This recess part 212*a* houses a mounting piece (mounting part) 242 of the upper receptacle terminal 24 in the press-fitted (inserted) state.

Moreover, the pair of side walls 213, 213 have holding bracket attachments 213*a*, 213*a* formed thereon, respectively, to hold the holding brackets 25.

In this embodiment, the holding bracket attachment 213*a* includes: a recess part 213*b* opened outward in the top-bottom direction and in the width direction; and slits 213*c*, 213*c* provided continuously inward, in the width direction, of the recess part 213*b*, into which both ends, in the front-rear direction, of a main body part 251 of the holding bracket 25 is inserted. In a state where the holding brackets 25 are held by the receptacle housing 20, fixing pieces 252 provided continuously from lower ends of the main body parts 251 are fixed to the fixing parts 2*c*A of the circuit board 2A, thereby fixing the receptacle housing 20 to the circuit board 2A.

Moreover, in this embodiment, the receptacle terminals each include: a main body part to be inserted into a space formed in the receptacle housing 20; a leg part extending from the main body part toward the mounting surface 21*a*A of the circuit board 2A in a state where the receptacle terminals are mounted on the circuit board (the mounting member) 2A; and a mounting part provided continuously from the leg part and to be mounted on the circuit board 2A.

To be more specific, the receptacle terminals include the lower receptacle terminal 23 to be press-fitted (inserted) into the first space S3 formed on the lower side (mounting surface 21*a*A side) of the housing main body 21. The receptacle terminals further include the upper receptacle terminal 24 to be press-fitted (inserted) into the second space S4 formed on the upper side (position further away from the mounting surface 21*a*A than the first space S3) of the housing main body 21.

In this embodiment, the lower receptacle terminal 23 is conductive, and a plurality of the lower receptacle terminals 23 are arranged in the width direction (Y direction) of the receptacle housing 20. As shown in FIG. 22, the lower receptacle terminal 23 is formed into a thin plate shape, and is press-fitted (inserted) from the rear side into the first space S3 formed in the housing main body 21 in a state where the plate thickness direction is approximately aligned with the width direction (Y direction). Such a lower receptacle terminal 23 can be formed, for example, by punching thin sheet metal.

The lower receptacle terminal 23 also includes a first main body part 230 to be press-fitted (inserted) into the first space S3. The lower receptacle terminal 23 further includes: a first leg part 231 extending from the first main body part 230 toward the mounting surface 21*a*A in a state where the lower receptacle terminal 23 is mounted on the circuit board (the mounting member) 2A; and a first mounting piece (first mounting part) 232 provided continuously from the first leg part 231 and to be mounted on the circuit board 2A.

At the front end of the first main body part 230, an approximately rod-shaped contact part 230*a* is formed so as to protrude forward. Also, press-fit protrusions 230*b* are formed at the upper and lower ends of the first main body part 230. The first main body part 230 is press-fitted into the first space S3 by sticking the press-fit protrusions 230*b* into the housing main body 21. In the state where the first main body part 230 is press-fitted (inserted) into the first space S3, the contact part 230*a* is disposed in the fitting space S5.

Moreover, in this embodiment, the first leg part 231 is provided extending downward (toward the circuit board 2A: mounting member) from the rear end of the first main body part 230. To be more specific, the first leg part 231 is bent into a crank shape and has its lower end located behind the first main body part 230. Thus, in this embodiment, the first leg part 231 is provided extending in the housing thickness direction (top-bottom direction) from the first main body part 230 press-fitted (inserted) into the first space S3. The first mounting piece 232 is provided continuously from the lower end of this first leg part 231 so as to protrude rearward.

Meanwhile, the upper receptacle terminal 24 is also conductive, and a plurality of the upper receptacle terminals 24 are arranged in the width direction (Y direction) of the receptacle housing 20. As shown in FIG. 23, the upper receptacle terminal 24 is formed into a thin plate shape, and is press-fitted (inserted) from the rear side into the second space S4 formed in the housing main body 21 in a state where the plate thickness direction is approximately aligned with the width direction (Y direction). Such a upper receptacle terminal 24 can also be formed, for example, by punching thin sheet metal.

The upper receptacle terminal 24 also includes a second main body part 240 to be press-fitted (inserted) into the second space S4. The upper receptacle terminal 24 further includes: a second leg part 241 extending from the second main body part 240 toward the mounting surface 21*a*A in a state where the upper receptacle terminal 24 is mounted on the circuit board (the mounting member) 2A; and a second mounting piece (second mounting part) 242 provided continuously from the second leg part 241 and to be mounted on the circuit board 2A.

At the front end of the second main body part 240, an approximately rod-shaped contact part 240*a* is formed so as to protrude forward. Also, press-fit protrusions 240*b* are formed at the upper and lower ends of the second main body part 240. The second main body part 240 is press-fitted into the second space S4 by sticking the press-fit protrusions 240*b* into the housing main body 21. In the state where the second main body part 240 is press-fitted (inserted) into the second space S4, the contact part 240*a* is disposed in the fitting space S5.

Moreover, in this embodiment, the second leg part 241 is provided approximately linearly extending downward (toward the circuit board 2A: mounting member) from the rear end of the second main body part 240. Thus, in this embodiment, the second leg part 241 is provided extending in the housing thickness direction (top-bottom direction) from the second main body part 240 press-fitted (inserted) into the second space S4. The second leg part 241 has its length, in the top-bottom direction, longer than the first leg part 231. The first mounting piece 232 is provided continuously from the lower end of this second leg part 241 so as to protrude forward.

Thus, in this embodiment, the second mounting piece (second mounting part) 242 is provided continuously from the second leg part 241 so as to protrude forward (toward one side) in the front-rear direction (X direction: insertion direction into the space of the main body part). Also, the first mounting piece (first mounting part) 232 is provided continuously from the first leg part 231 so as to protrude rearward (toward the other side) in the front-rear direction (X direction: insertion direction into the space of the main body part).

More specifically, the mounting parts (first and second mounting pieces 232 and 242) are arranged in a staggered pattern in a state where the plurality of receptacle terminals are held by the receptacle housing 20.

Furthermore, the second mounting piece 242 is housed in the recess part 212*a* formed at the rear end of the bottom wall 212 in the state where the second main body part 240 is inserted into the second space S4. Meanwhile, the first mounting piece 232 is positioned behind the insertion opening S3*a* of the first space S3 in the state where the first main body part 230 is inserted into the first space S3.

Therefore, the second mounting piece 242 overlaps with the receptacle housing 20 in the plan view in a state where the plurality of receptacle terminals are held by the receptacle housing 20 and also mounted on the circuit board 2A. At the same time, the first mounting pieces 232 are exposed from the receptacle housing 20 in the plan view in a state where the plurality of receptacle terminals are held by the receptacle housing 20 and also mounted on the circuit board 2A.

More specifically, either one of the first and second mounting pieces (mounting parts) 232 and 242 overlaps with the receptacle housing 20 when the receptacle housing 20 is viewed along the direction normal to the mounting surface 21*a*A in a state where the receptacle connector 2 is mounted on the circuit board 2A.

Thus, in this embodiment, the mounting parts are arranged in a staggered pattern on either side of the insertion opening (rear end) of the space in the state where the plurality of receptacle terminals are held by the receptacle housing.

Furthermore, in this embodiment, at the position where the press-fitting (insertion) of the first main body part 230 into the first space S3 is completed, the first leg part 231 is held between the projections 214*a* in a state of having its movement restricted in the width direction (Y direction; thickness direction). More specifically, the projections 214*a* formed on the rear wall 214 of the housing main body 21 function as leg part holders 216 to hold the first leg part 231. Thus, the receptacle connector 2 includes the leg part holders 216 connected to the receptacle housing 20 to hold the first leg part 231. In this embodiment, the leg part holders 216 are formed integrally with the receptacle housing 20. Note that the leg part holders may be formed by connecting separate members from the receptacle housing 20 to the receptacle housing 20.

Moreover, at the position where the press-fitting (insertion) of the second main body part 240 into the second space S4 is completed, the second leg part 241 is held between the projections 214*a* in a state of having its movement restricted in the width direction (Y direction; thickness direction). More specifically, the projections 214*a* formed on the rear wall 214 of the housing main body 21 function as leg part holders 217 to hold the second leg part 241. Thus, the receptacle connector 2 includes the leg part holders 217 connected to the receptacle housing 20 to hold the second leg part 241. The leg part holders 217 are also formed integrally with the receptacle housing 20 in this embodiment, but may be formed as separate members.

In this way, the leg parts 231 and 241 are prevented from being deformed when the terminals 23 and 24 are press-fitted (inserted) into the spaces S3 and S4 of the main body parts 230 and 240.

When the plug connector 1 described above is fitted into the receptacle connector 2 thus configured, the lock part 12 of the plug housing 10 is inserted into the lock insertion part 22 of the receptacle housing 20, and thus the housing main body 11 is inserted into the fitting space S5.

In this event, the engagement protrusion 121*b* of the lever part 121 is pushed downward by the top wall 211 of the receptacle housing 20. When the engagement protrusion 121*b* is pushed downward by the top wall 211 in this way, the rear end part (operation part 121*a*) of the lever part 121 is elastically deformed so as to move downward, and thus the engagement protrusion 121*b* can be moved into the inner side of the lock insertion part 22.

Then, when the engagement protrusion 121*b* is moved into the inner side of the lock insertion part 22, the downward pushing of the engagement protrusion 121*b* by the top wall 211 is released, and the elastic restoring force of the lever part 121 moves the engagement protrusion 121*b* upward. The engagement protrusion 121*b* is moved upward to be engaged with the engagement recess part 221*a* formed in the receptacle connector 2, thus allowing the plug connector 1 and the receptacle connector 2 to be locked in the fitted state.

During the course of fitting the plug connector 1 into the receptacle connector 2, the tip of the contact part 230*a* of the lower receptacle terminal 23 is introduced into the first space S1 formed in the plug housing 10 from the introduction port S1*b* to come into contact with the contact part 130*a* of the first plug terminal 13. Note that, in this embodiment, the approximately rod-shaped contact part 230*a* is inserted between the pair of contact pieces 138, 138 and sandwiched by the pair of contact pieces 138, 138 to achieve conduction between the first plug terminal 13 and the lower receptacle terminal 23.

Likewise, the tip of the contact part 240*a* of the upper receptacle terminal 24 is introduced into the second space S2 formed in the plug housing 10 from the introduction port S2*b* to come into contact with the contact part 140*a* of the upper plug terminal 14. Note that, in this embodiment, the approximately rod-shaped contact part 240*a* is inserted between the pair of contact pieces 148, 148 and sandwiched by the pair of contact pieces 148, 148 to achieve conduction between the upper plug terminal 14 and the upper receptacle terminal 24.

As described above, the plug connector 1 and the receptacle connector 2 are fitted together to achieve conduction between the terminals 13 and 14 and the terminals 23 and 24. Thus, the connector set C1 is formed to electrically connect the cable 1A to the circuit board 2A.

Meanwhile, in order to detach the plug connector 1 from the receptacle connector 2, the operation part 121*a* of the lever part 121 is first lowered to move the lever part 121 downward. Accordingly, the engagement protrusion 121*b* is also moved downward to release the engagement between the engagement protrusion 121*b* and the engagement recess part 221*a*. Then, by pulling the plug connector 1 in a removal direction from the receptacle connector 2 in the state where the engagement between the engagement protrusion 121*b* and the engagement recess part 221*a* is released, the plug connector 1 is moved in the removal direction relative to the receptacle connector 2. When the plug connector 1 is thus moved in the removal direction relative to the receptacle connector 2, the conduction between the terminals is first released, and then the fitting between the housings is released. Thus, the plug connector 1 is detached from the receptacle connector 2.

[Configuration Example of Slide Member 3]

Next, an example of the configuration of the slide member 3 is described based on FIGS. 25A to 25F.

The slide member 3 includes a main body part 31 having a substantially rectangular plate shape. On the upper part of this main body part 31, a handle 31*a* is formed.

In addition, a pair of lower arm parts 32 are provided continuously on either side, in the width direction, of the lower part of the main body part 31 such that the pair of lower arm parts 32 extend forward in the front-rear direction. The pair of lower arm parts 32 are provided continuously on the main body part 31 in a cantilever fashion and are formed to be capable of elastically deforming in the width direction. On the tips (front ends) of these lower arm parts 32, locking protrusions (retaining part) 32*a* are formed to protrude outward in the width direction.

On the other hand, a pair of upper arm part 33 are provided continuously on either side, in the width direction, of the upper part of the main body part 31 such that the pair of upper arm part 33 extend forward in the front-rear direction. The pair of upper arm part 33 are provided continuously on the main body part 31 in a cantilever fashion and formed to be elastically deformed in the top-bottom direction (the direction intersecting the insertion direction of the terminals). On the tips (front ends) of these upper arm parts 33, engagement protrusions (engaging parts) 33*b* are formed to protrude upward.

In addition, protrusions 33*a* protruding upward are formed in a substantially middle, in the front-rear direction, of the upper arm parts 33.

In a middle, in the width direction, of the lower part of the main body part 31, a restrictive protrusion (restrictor) 31*b* extending forward and upward is formed.

As described above, in this embodiment, this slide member 3 functions as the CPA member. Specifically, the slide member 3 is slidably attached to the plug housing 10 such that the slide movement of the slide member 3 from the initial position (first position) to the slide completion position (second position) is restricted in a state where the plug housing 10 has not been completely fitted into the receptacle housing 20 yet. Then, the slide member 3 is configured such that once the plug housing 10 is completely fitted into the receptacle housing 20, the slide movement of the slide member 3 from the initial position to the slide completion position is allowed.

To be more specific, the slide member 3 is configured such that the tips of the lower arm parts 32 are inserted into the insertion space S6 while being deflected inward in the width direction. At this time, the tips of the upper arm parts 33 are also inserted into the insertion space S6.

In a state where the tips of the lower arm parts 32 and the upper arm part 33 are inserted into the insertion space S6, when the slide member 3 is moved forward (inserted) by a predetermined distance, the tips of the lower arm parts 32 move forward beyond the step parts 116*b* formed on the upper partition walls 116, which define the recess part 11*a*. Once the tips of the lower arm parts 32 move forward beyond the step parts 116*b*, the lower arm parts 32 are moved by elastic restoring force in directions to separate from each other (outward in the width direction), so that the locking protrusions 32*a* of the lower arm parts 32 are locked to the step parts 116*b*. As a result, the slide member 3 is slidably held (temporarily held) in the plug housing 10 while being prevented from falling off the housing main body 11.

Figure 27:
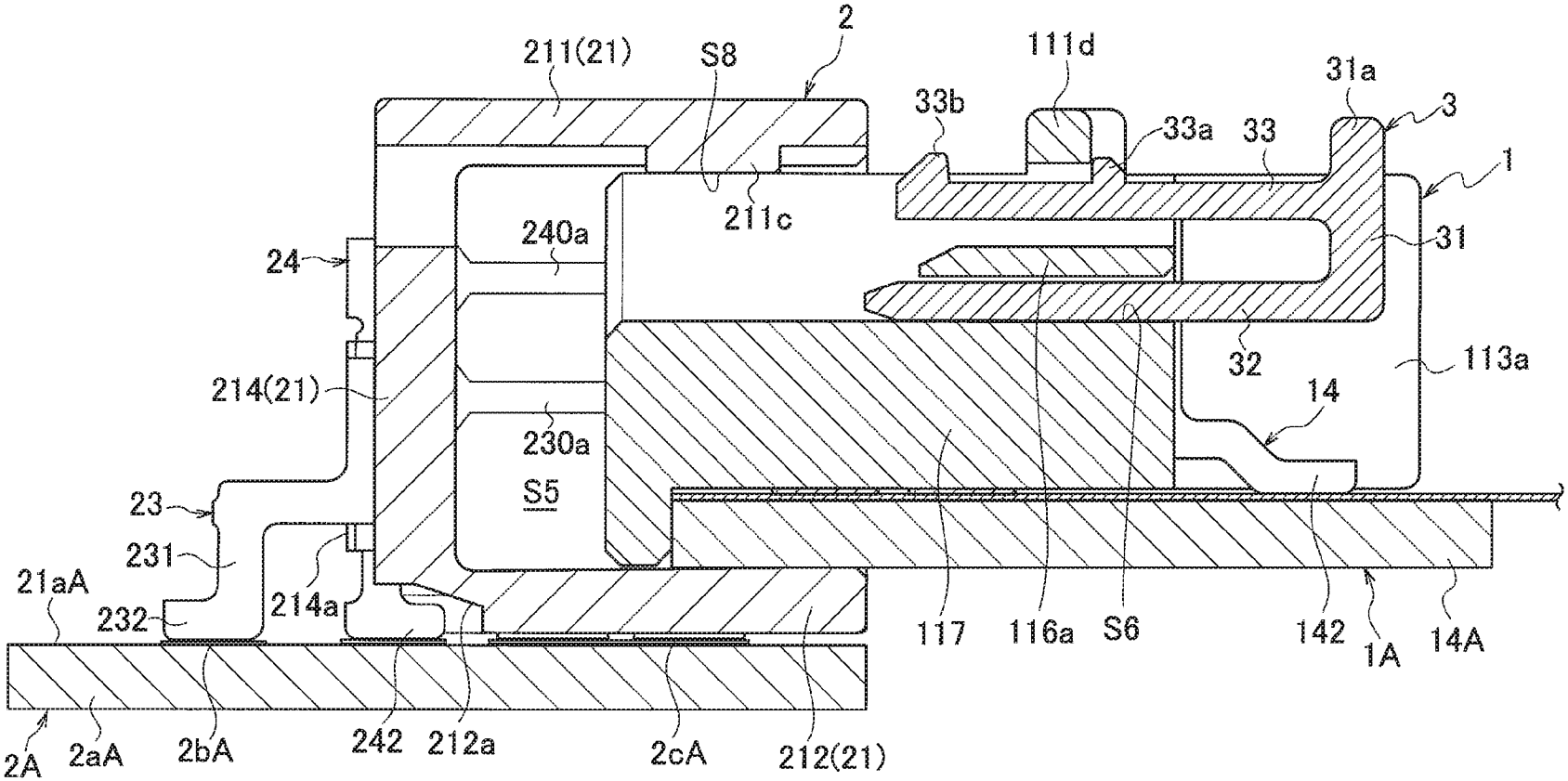
FIG. 27 is a sectional side view explaining how the plug connector and the receptacle connector shown as an example are locked with the slide member and showing a state before the plug connector in which the slide member has been temporarily held is fitted to the receptacle connector.

Note that in a state where the locking protrusions 32*a* of the lower arm parts 32 are locked to the step parts 116*b*, the protrusions 33*a* of the upper arm parts 33 are located to face the restrictive protrusions (slide restrictor) 111*d* behind the restrictive protrusions (slide restrictors) 111*d* (see FIG. 27).

For this reason, in a state where the slide member 3 is temporarily held in the plug housing 10 not fitted into the receptacle housing 20, if the slide member 3 is attempted to be slid forward, the protrusions 33*a* of the upper arm parts 33 come into contact with the restrictive protrusions 111*d*, thus preventing the slide member 3 from moving forward further.

In this embodiment, this configuration makes it unable for the slide member 3 to slide from the initial position to the slide completion position when the plug housing 10 has not been completely fitted into the receptacle housing 20 yet. Note that in this embodiment, the slide member 3 is regarded as being at the initial position when the locking protrusion 32*a* of the lower arm part 32 is locked to the step part 116*b*.

When the plug housing 10 which has temporarily held the slide member 3 is fitted into the receptacle housing 20, the engagement protrusions 33*b* of the upper arm parts 33 come into contact with the protrusions 211*c* of the top wall 211 and are pressed downward from the initiation to the completion of the fitting. Then, once the plug housing 10 is completely fitted into the receptacle housing 20, the tips of the engagement protrusions 33*b* abut against the lower surfaces of the protrusions 211*c*, so that the upper arm parts 33 are deflected downward. At this time, the protrusions 33*a* of the upper arm parts 33 also move downward to be located at a level lower than the restrictive protrusions (slide restrictors) 111*d* (see FIG. 28).

Thus, once the plug housing 10 is fitted into the receptacle housing 20, the restriction on the forward movement of the protrusions 33*a*, which is effected by the restrictive protrusions 111*d*, is released. This allows the slide member 3 to be slid forward. As described above, in this embodiment, the upper arm parts 33, which are elastically deformable up and down, and the protrusions 33*a*, which are formed on the upper arm parts 33 to be capable of coming into contact with the restrictive protrusions 111*d*, function as the slide lock mechanism.

Figure 29:
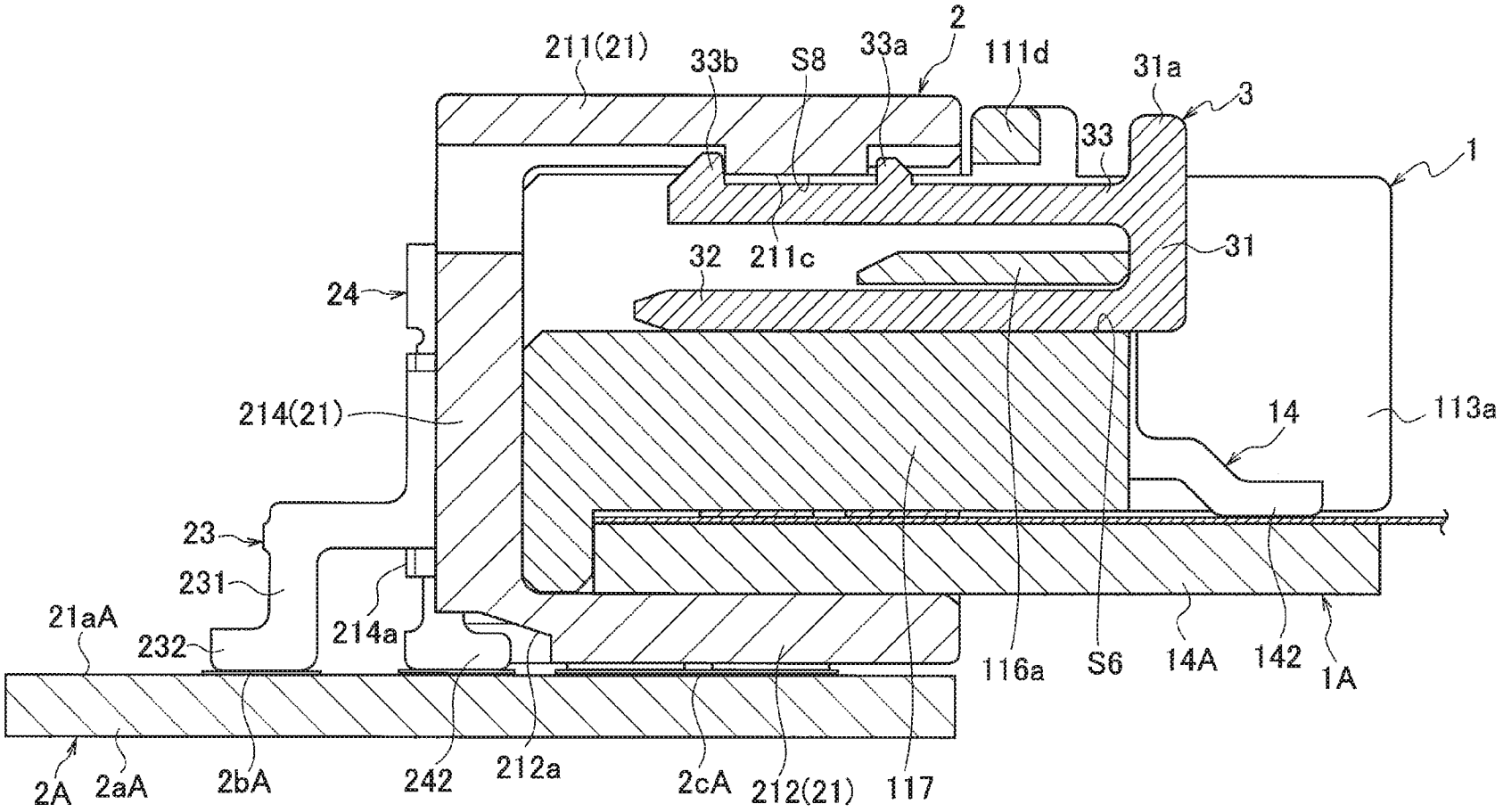
FIG. 29 is a sectional side view explaining how the plug connector and the receptacle connector shown as an example are locked with the slide member and showing a state where the plug connector has been fitted to the receptacle connector and locked with the slide member.

Then, by sliding the slide member 3 forward and locking the engagement protrusions 33*b* of the upper arm parts 33 to the front ends of the protrusions 211*c* of the top wall 211, the plug housing 10 and the receptacle housing 20 are locked in a fitted state with this slide member 3 as well (see FIG. 29). Note that in this embodiment, the slide member 3 is regarded as being at the slide completion position (completion position: second position) when the engagement protrusions 33*b* of the upper arm parts 33 are locked to the front ends of the protrusions 211*c* of the top wall 211.

In this way, the connector set C1 is locked doubly by the lever part 121 and the slide member 3.

Figure 30:
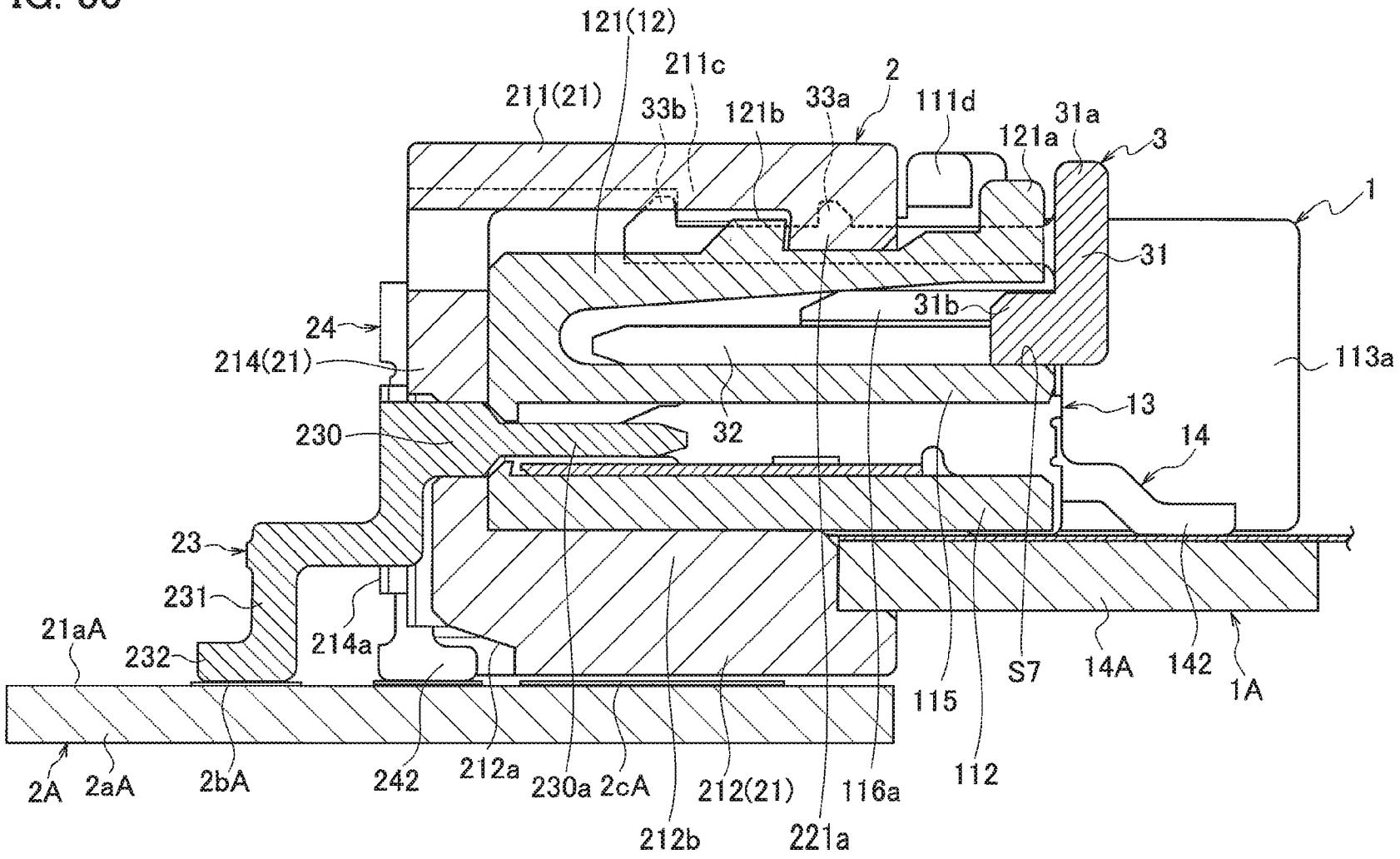
FIG. 30 is a sectional side view explaining how deflection of the lever part is restricted in the state where the plug connector has been fitted to the receptacle connector and locked with the slide member.
Figure 31A:
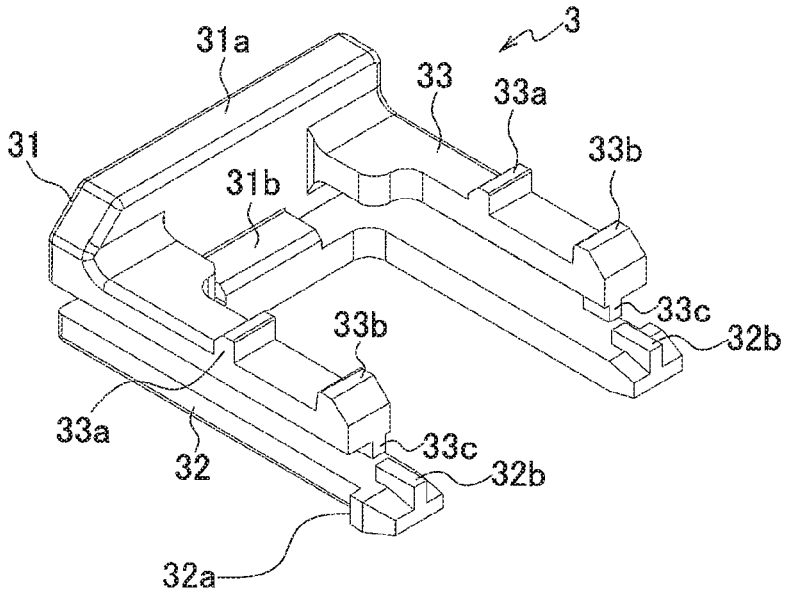
FIGS. 31A and 31B are perspective views showing a modification of the slide member included in the connector set shown as an example, FIG. 31A showing a state viewed from one side and FIG. 31B showing a state viewed from the other side.
Figure 31B:
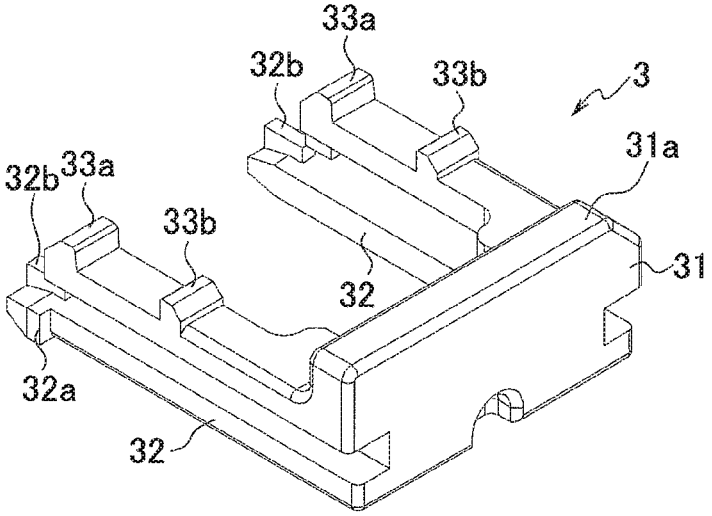
Figure 32B:
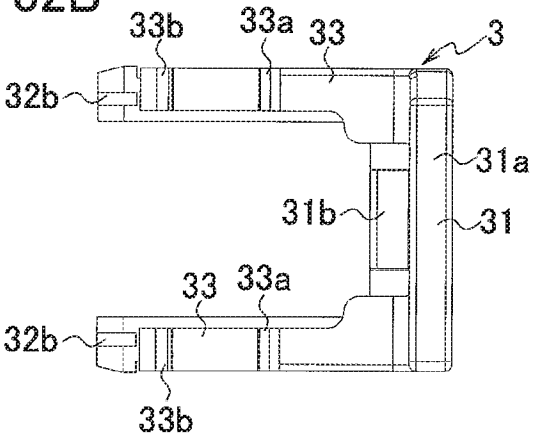
FIG. 32B is a plan view.
Figure 32C:
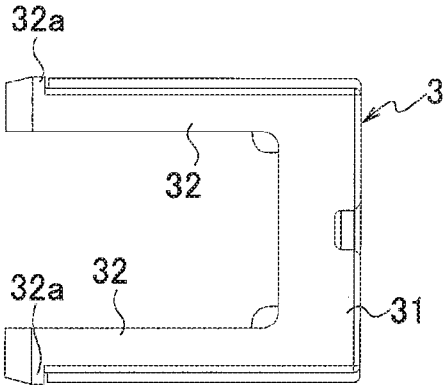
FIG. 32C is a reverse side view.
Figure 32A:
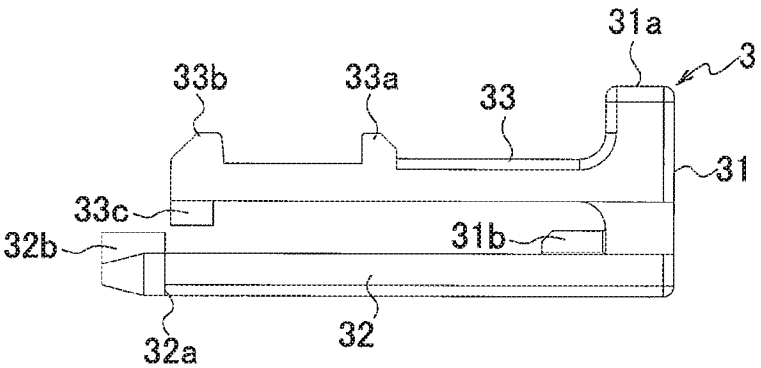
FIG. 32A is a side view.
Figure 32E:
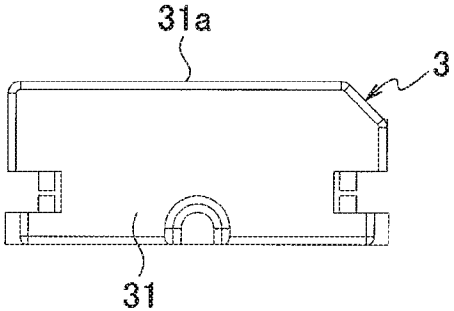
FIG. 32E is a back view, showing the modification of the slide member included in the connector set shown as an example.
Figure 32D:
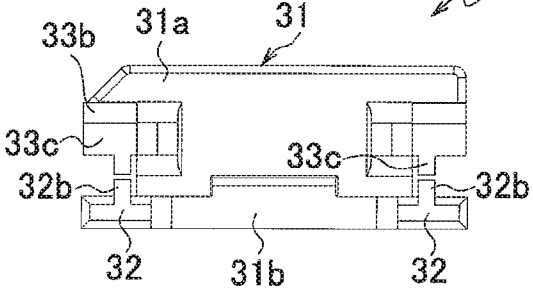
FIG. 32D is a front view.

Moreover, in this embodiment, when the slide member 3 is slid to the slide completion position (completion position), the restrictive protrusion (restrictor) 31*b* is inserted into the deflection allowance space S7 (see FIG. 30). Then, the restrictive protrusion 31*b* inserted into the deflection allowance space S7 restricts the downward movement of the lever part 121.

Here, it is preferable that the amount of upward protrusion of the restrictive protrusion 31*b* be set such that the engagement protrusion 121*b* and the engagement recess part 221*a* remain engaged with each other even when the lever part 121 is in contact with the restrictive protrusion 31*b*. This makes it possible to prevent the locking with the lever part 121 from being released unless the locking with the slide member 3 is released, and to thus maintain the lock state more securely.

Note that to release the fitting of the connector set C1 doubly locked with the lever part 121 and the slide member 3, the slide member 3 in the slide completion position is first slid to the initial position. In this embodiment, strongly pulling the slide member 3 rearward (toward the initial position) releases the locking between the engagement protrusions 33*b* and the protrusions 211*c*. Accordingly, for example, if an operator or the like grips the handle 31*a* and strongly pulls the slide member 3 rearward, the slide member 3 is slid to the initial position.

In this way, sliding the slide member 3 to the initial position releases the restriction on the downward movement of the lever part 121, making it possible to release the lock with the lever part 121.

Then, performing the above-described operation of removing the plug connector 1 from the receptacle connector 2 removes the plug connector 1 from the receptacle connector 2.

Note the configuration of the slide member 3 is not limited to the above-described configuration, and for example, the configuration shown in FIGS. 31A and 31B and FIGS. 32A to 32E is also possible. The slide member 3 shown in FIGS. 31A and 31B and FIGS. 32A to 32E includes the same constituents as those of the slide member 3 shown in the above-described embodiment. For this reason, these same constituents are given common reference signs and repetitive descriptions are omitted below.

In the slide member 3 shown in FIGS. 31A and 31B and FIGS. 32A to 32E, the pair of upper arm parts 33 are formed to be wider on their base sides (the side continuous to the main body part 31).

Moreover, in the slide member 3 shown in FIGS. 31A and 31B and FIGS. 32A to 32E, protrusions 32*b* protruding upward are formed on the tips (front ends) of the lower arm parts 32, so that the thickness of the tips of the lower arm parts 32 in the top-bottom direction is larger than the gap (the maximum distance in the top-bottom direction) between the lower arm parts 32 and the upper arm parts 33. To be more specific, the slide member 3 shown in FIGS. 31A and 31B and FIGS. 32A to 32E has the protrusions 32*b* formed on the tips of the lower arm parts 32. Then, the thickness of the lower arm parts 32 in the portion where the protrusions 32*b* are formed is made larger than the gap (the maximum distance in the top-bottom direction) between the lower arm parts 32 and the upper arm parts 33. In addition, protrusions 33*c* protruding downward are formed on the tips (front ends) of the upper arm parts 33, so that the thickness of the tips of the upper arm parts 33 in the top-bottom direction is larger than the gap (the maximum distance in the top-bottom direction) between the lower arm parts 32 and the upper arm parts 33. To be more specific, the slide member 3 shown in FIGS. 31A and 31B and FIGS. 32A to 32E has the protrusions 33*c* formed on the tips of the upper arm parts 33. Then, the thickness of the upper arm parts 33 in the portion where the protrusions 33*c* are formed is made larger than the gap (the maximum distance in the top-bottom direction) between the lower arm parts 32 and the upper arm parts 33. In this case, the lower arm parts 32 are formed such that the tips of the lower arm parts 32 protrude forward beyond the tips of the upper arm parts 33. This prevents the protrusions 33*c* and the protrusions 32*b* from interfering with each other when the upper arm parts 33 are elastically deformed in the top-bottom direction.

Moreover, the width on the tip side of the lower arm parts 32 protruding forward is also made larger than the gap (the maximum distance in the top-bottom direction) between the lower arm parts 32 and the upper arm parts 33.

This makes it possible to prevent the lower arm parts 32 or the upper arm parts 33 of another slide member 3 from being inserted into the gap between the lower arm parts 32 and the upper arm parts 33 of the slide member 3, so that these arm parts are not entangled with each other. In this way, the slide member 3 according to this embodiment is configured such that the arm parts are prevented from being entangled with each other without hindering the elastic deformation of the upper arm parts 33 in the top-bottom direction.

Figure 28:
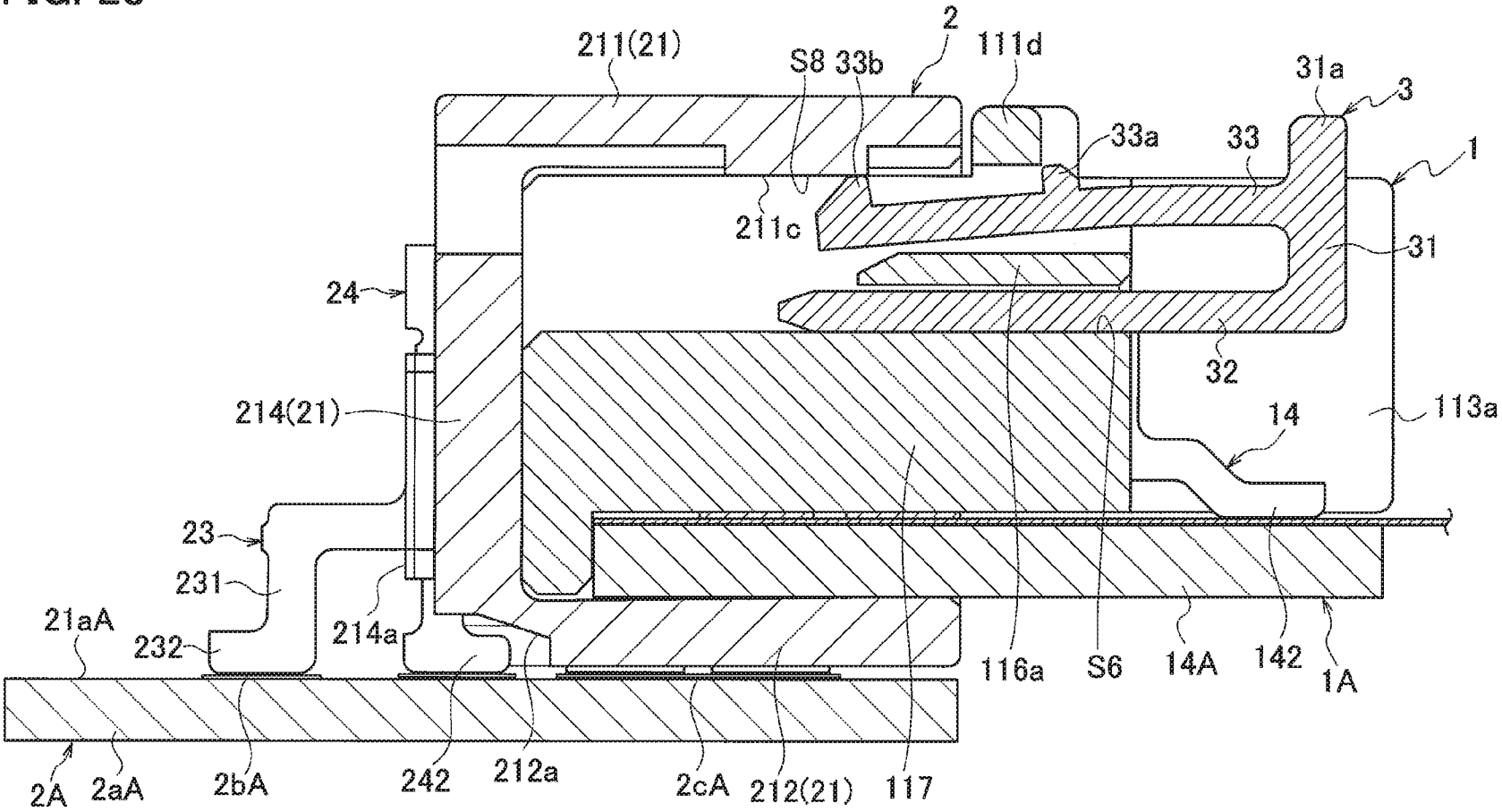
FIG. 28 is a sectional side view explaining how the plug connector and the receptacle connector shown as an example are locked with the slide member and showing a state where the plug connector in which the slide member has been temporarily held has been fitted to the receptacle connector.

When such a slide member 3 is caused to function as a CPA member as well, the operations shown in FIG. 27 to FIG. 29 are carried out as in the case of the slide member 3 shown in FIGS. 25A to 25F.

In addition, a connector set C1 shown in FIGS. 33 to 47 is also possible. Note that, the connector set C1 shown in FIGS. 33 to 47 includes the same constituents as those of the connector set C1 shown in the above-described embodiment. For this reason, these same constituents are given common reference signs and repetitive descriptions are omitted.

[Configuration Example of Connector Set]

Figure 33:
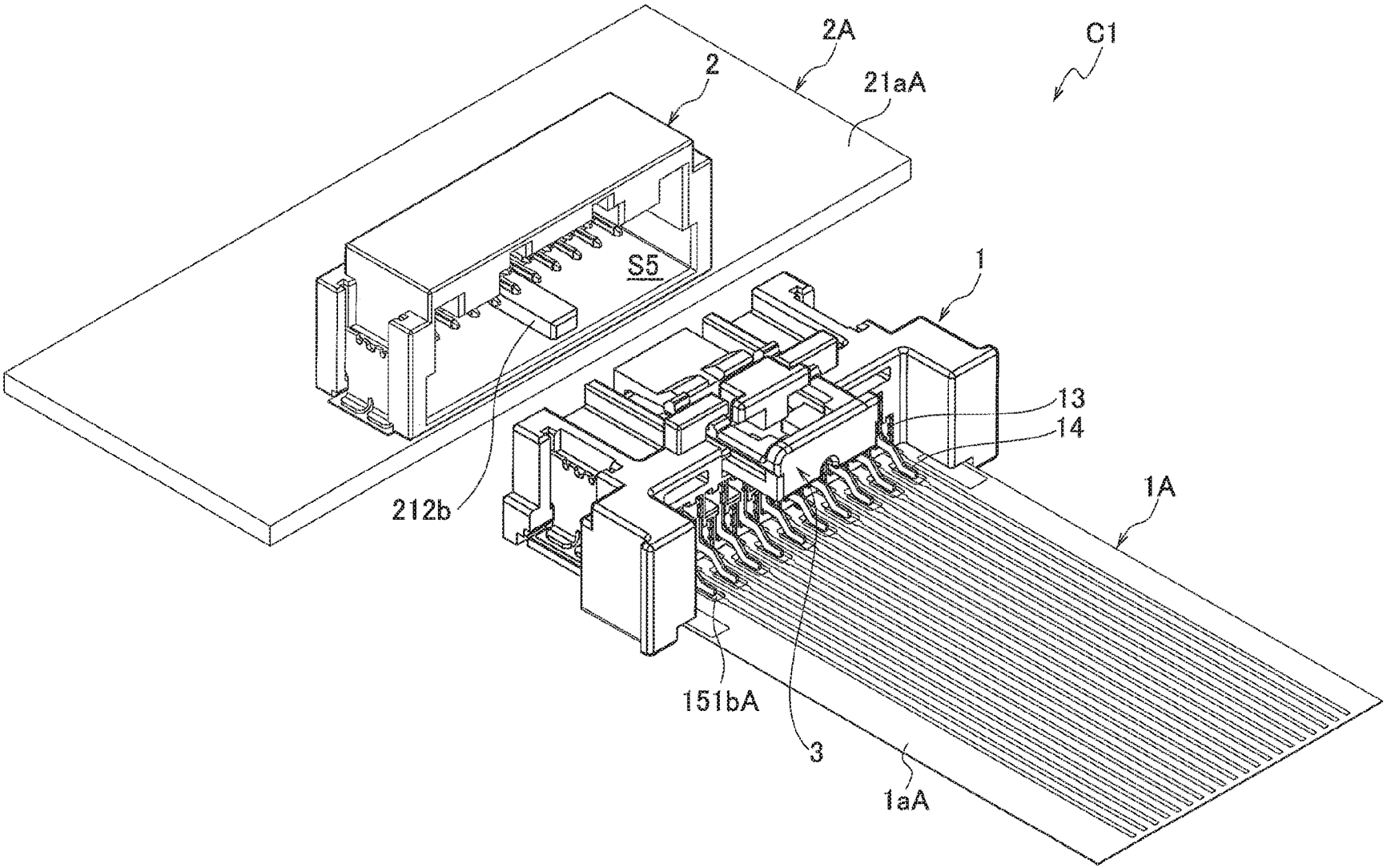
FIG. 33 is an exploded perspective view showing an alternative example of a connector set including a plug connector mounted on a cable and temporarily holding a slide member and a receptacle connector mounted on a circuit board.
Figure 34:
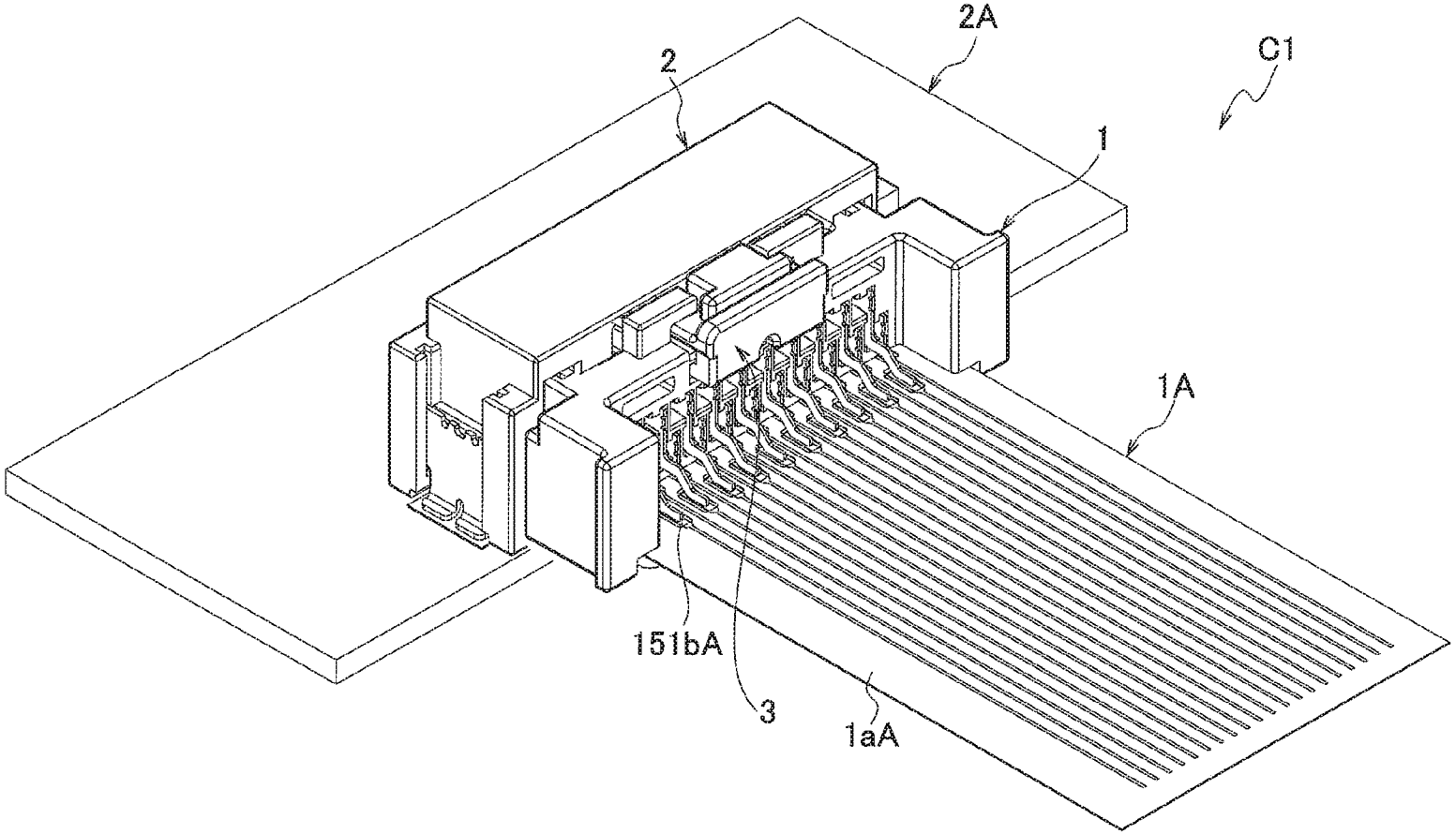
FIG. 34 is a perspective view showing the alternative example of the connector set in a state where the plug connector mounted on the cable and the receptacle connector mounted on the circuit board are fitted together and locked with the slide member.

A plug connector (connector: first connector) 1 according to an alternative example is used in the connector set C1 shown in FIG. 33 and FIG. 34 and the like.

As shown in FIG. 33 and FIG. 34, the connector set C1 includes the above-described plug connector 1 and a receptacle connector (second connector) 2 to which the plug connector 1 is fitted.

In the alternative example, the plug connector 1 is formed to be mountable on a cable (mounting member: connecting member) 1A such as an FPC or an FFC. More specifically, the plug connector 1 is configured to be mounted on the cable 1A by electrically connecting (mounting) mounting pieces (mounting parts) 132, 142 of the plug terminals 13, 14 included in the plug connector 1 to a conductor part 151*b*A of the cable 1A.

Meanwhile, the receptacle connector 2 is formed to be mountable on the circuit board (counterpart mounting member) 2A. More specifically, the receptacle connector 2 is configured to be mounted on the circuit board 2A by electrically connecting (mounting) mounting pieces (counterpart mounting parts) 232, 242 of receptacle terminals 23, 24 included in the receptacle connector 2 to a conductor part 2*b*A of the circuit board 2A.

Then, the plug terminals 13, 14 are electrically connected to the receptacle terminals 23, 24 included in the receptacle connector 2 by fitting the plug connector 1 with the plug terminals 13, 14 held in the plug housing 10 and the mounting pieces 132, 142 mounted on the cable 1A into the receptacle connector 2.

Thus, in the alternative example as well, the connector set C1 electrically connects the cable 1A to the circuit board 2A by fitting the plug connector 1 into the receptacle connector 2 to achieve conduction between the plug terminals 13, 14 and the receptacle terminals 23, 24 (see FIG. 34).

Figure 35:
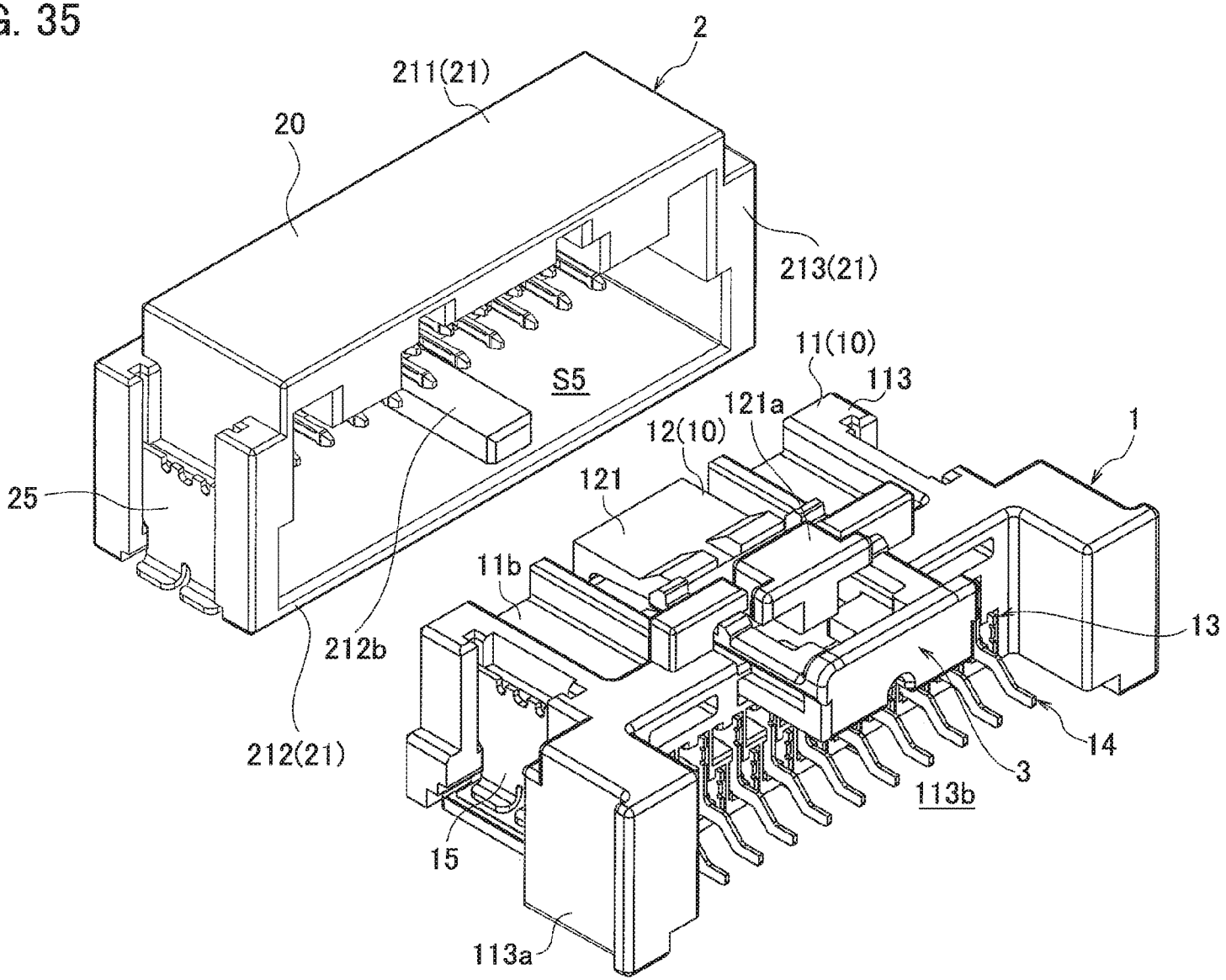
FIG. 35 is a perspective view explaining how the plug connector and the receptacle connector shown as the alternative example are locked with the slide member and showing a state before the plug connector in which the slide member has been temporarily held is fitted to the receptacle connector.
Figure 36:
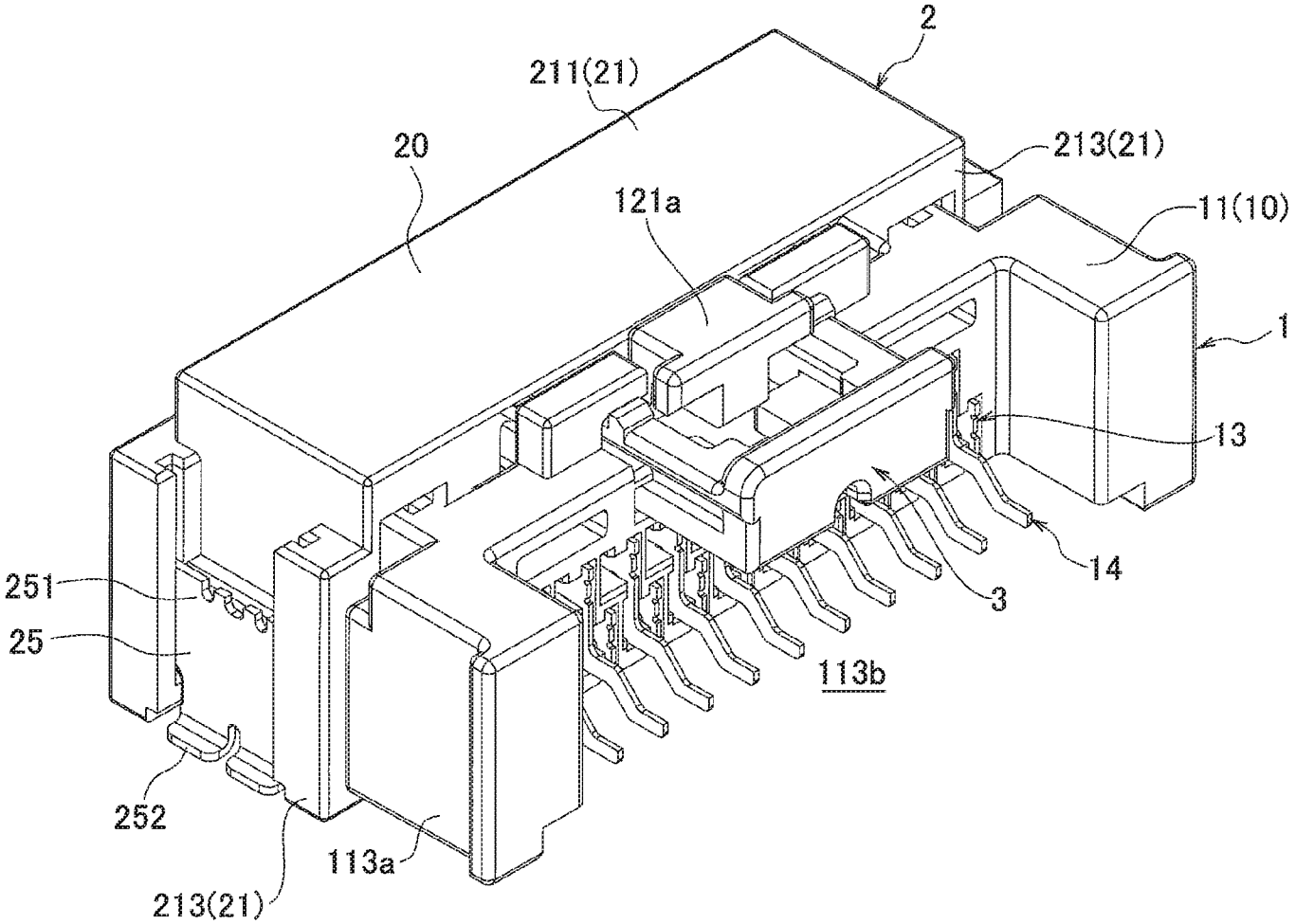
FIG. 36 is a perspective view explaining how the plug connector and the receptacle connector shown as the alternative example are locked with the slide member and showing a state where the plug connector in which the slide member has been temporarily held has been fitted to the receptacle connector.
Figure 37:
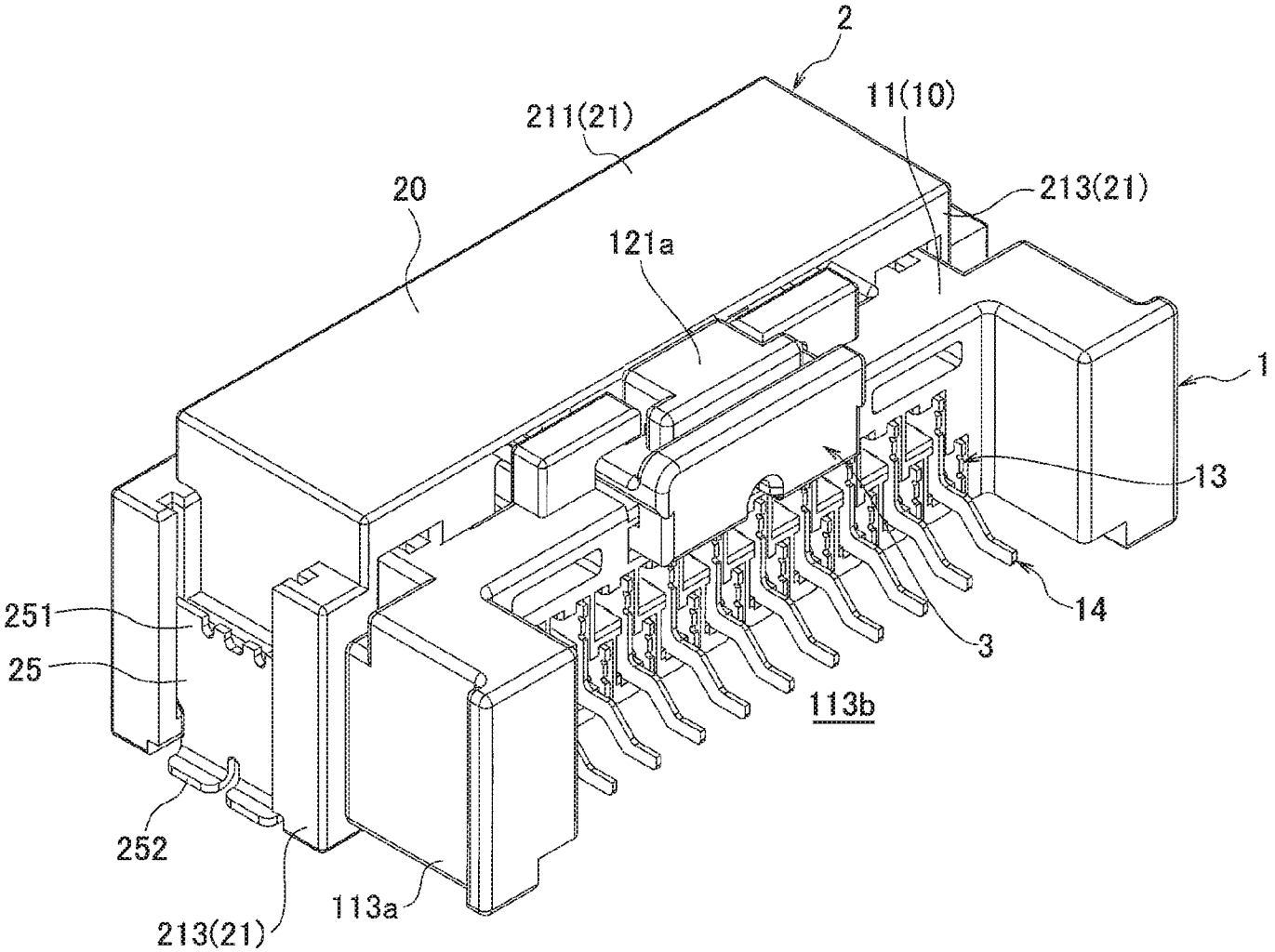
FIG. 37 is a perspective view explaining how the plug connector and the receptacle connector shown as the alternative example are locked with the slide member and showing a state where the plug connector has been fitted to the receptacle connector and locked with the slide member.

Moreover, in the alternative example as well, in the plug connector 1, the slide member 3 is slidably held (see FIG. 35 to FIG. 37).

In addition, in the alternative example as well, the connector set C1 has a connector position assurance (CPA) function and the slide member 3 functions as a CPA member.

[Configuration Example of Cable 1A]

Figure 38:
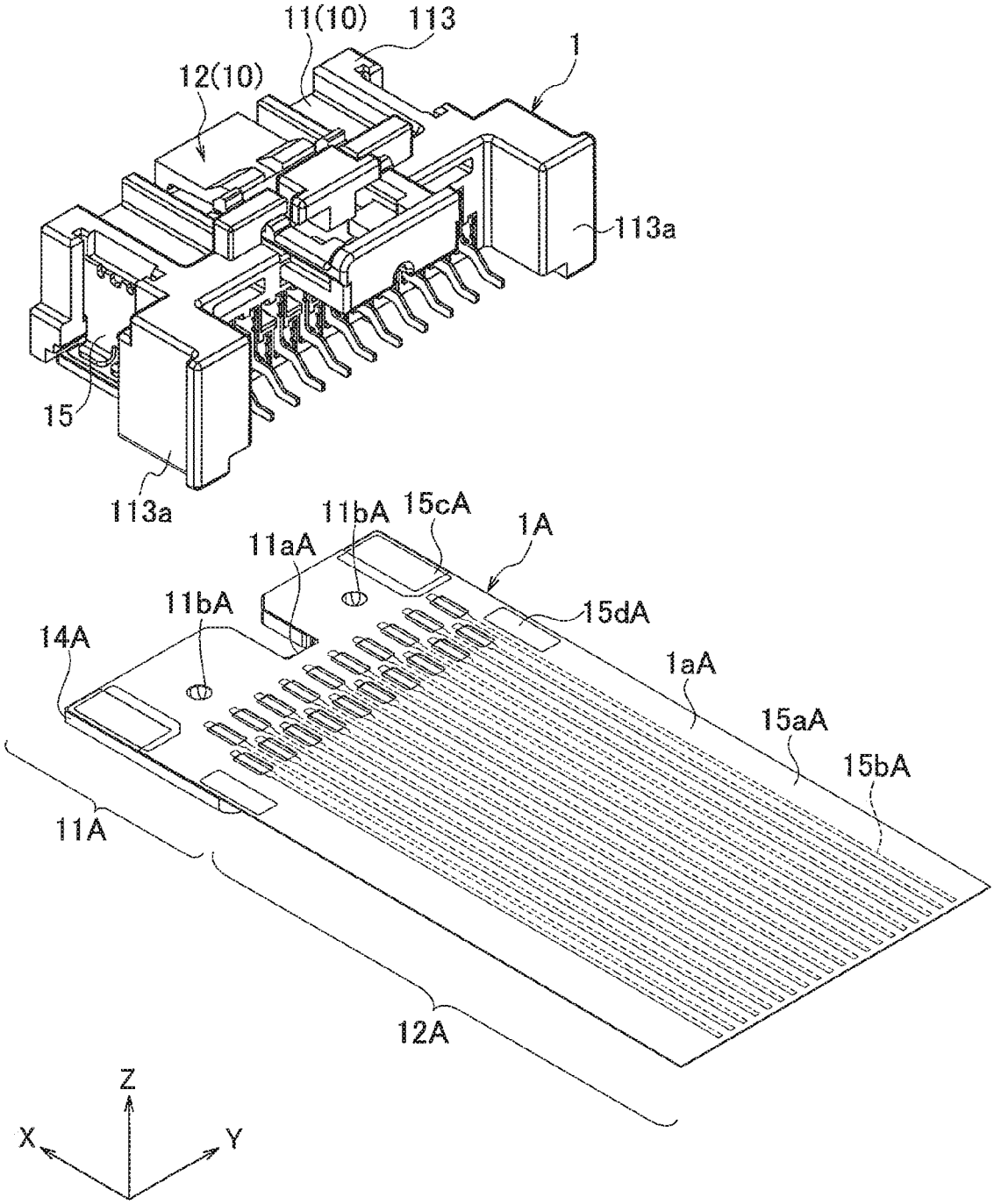
FIG. 38 is a perspective view showing a state before the plug connector in which the slide member has been temporarily held included in the connector set shown as the alternative example is mounted on a cable.
Figure 39A:
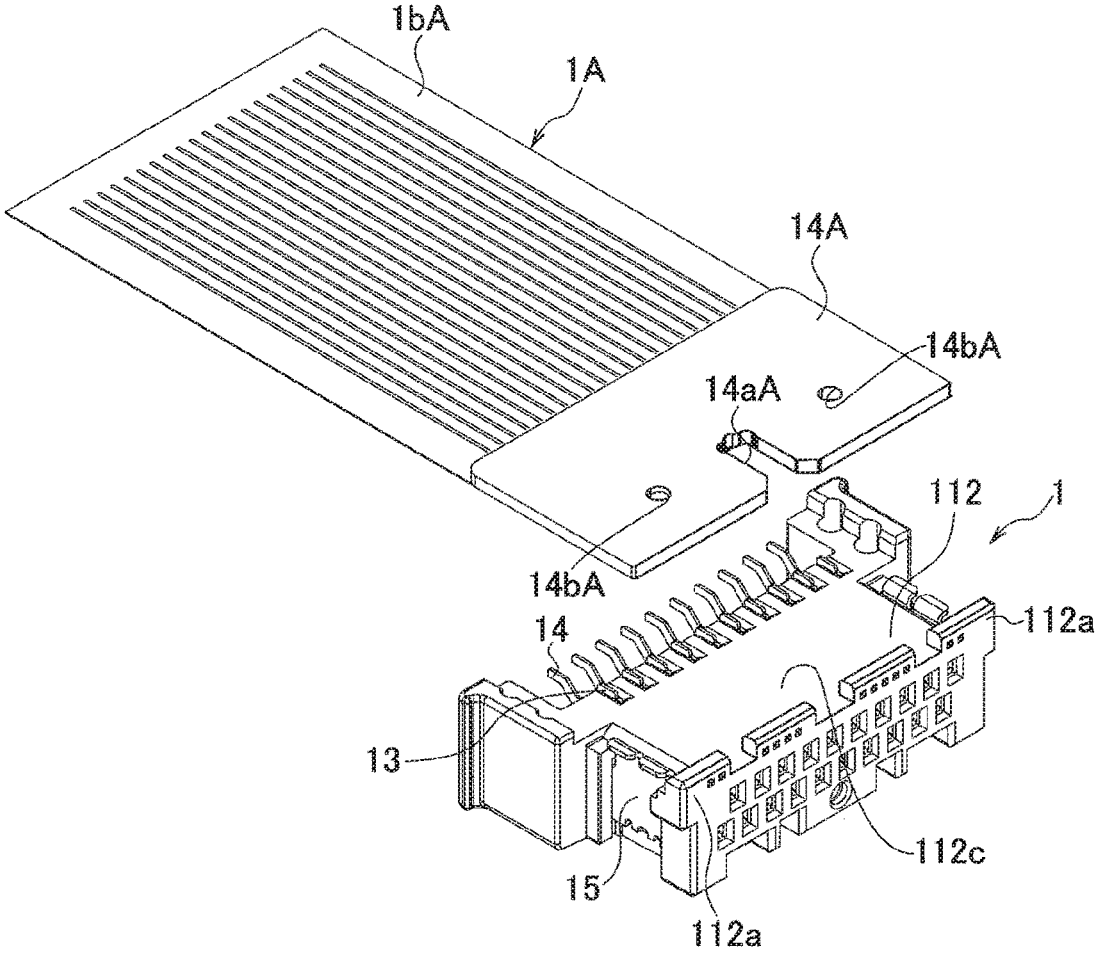
FIGS. 39A and 39B are perspective views explaining how the plug connector included in the connector set shown as the alternative example is mounted on the cable, FIG. 39A showing a state viewed from the reverse side before the plug connector is mounted and FIG. 39B showing a state viewed from the reverse side after the plug connector is mounted.
Figure 39B:
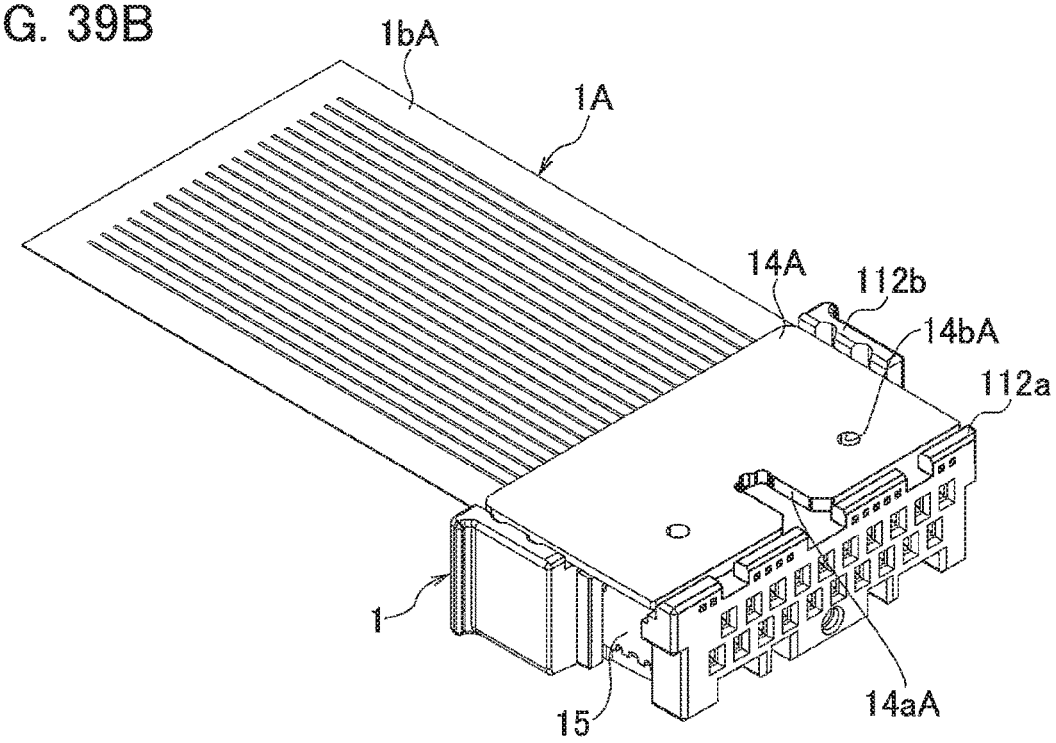

Next, with reference to FIG. 38 and FIGS. 39A and 39B, description is given of a configuration example of the cable 1A on which the plug connector 1 according to the alternative example is mounted.

The cable 1A has a sheet shape (flat plate shape) with a top surface (front surface: one side) 1*a*A and a rear surface (back surface: the other side) 1*b*A. The top surface 1*a*A serves as a mounting surface to mount the plug connector 1. The cable 1A is also flexible and thus can be bent (curved) in a cable thickness direction.

This cable 1A includes a connection region 11A used for connection with the plug connector 1 and an extension region 12A in which a conductor layer 15*b*A extends for wiring with another circuit.

In the alternative example, the cable 1A is formed such that the connection region 11A is positioned at one end side of the extension region 12A. In a state where the plug connector 1 having the connection region 11A connected thereto is fitted into the receptacle connector 2, the extension region 12A is positioned on the opposite side from the receptacle connector 2.

Moreover, the cable 1A has a multilayer structure, including a support layer 15*a*A and the conductor layer 15*b*A supported by the support layer 15*a*A. The support layer 15*a*A is formed of a plurality of insulator films to cover the conductor layer 15*b*A. On the other hand, the conductor layer 15*b*A is formed of conductor films printed on the insulator films included in the support layer 15*a*A, which are a plurality of wiring patterns corresponding to the plurality of terminals 13, 14, respectively.

On the upper surface of the connection region 11A, a plurality of conductor parts 151*b*A are formed, which are the conductor layers 15*b*A exposed from the support layer 15*a*A. The plurality of conductor parts 151*b*A are formed in two rows along the front-rear direction, and the conductor parts 151*b*A in each row are formed so as to be arranged at a predetermined pitch in the width direction (Y direction). Furthermore, in the alternative example as well, the plurality of conductor parts 151*b*A are formed in a staggered pattern in a plan view (state viewed along the mounting surface 1Aa).

Such a structure can be formed, for example, by printing the plurality of conductor films on the support layer 15*a*A to form the conductor layer 15*b*A and then covering the conductor layer 15*b*A with another support layer 15*a*A. In this event, if another support layer 15*a*A is provided so as not to cover the tip of the conductor layer 15*b*A, the cable 1A having the tip of the conductor layer 15*b*A exposed on one side (top side in the top-bottom direction) is formed.

Note that a method for forming the cable 1A is not limited to the above method, but various other methods can be used to form the cable 1A.

On the upper surface of the connection region 11A, fixing parts 15*c*A are also formed to fix holding brackets 15 in the plug connector 1. In the alternative example, the cable 1A has a rectangular shape with a width wider than the plurality of conductor layers 15*b*A arranged in the width direction (Y direction) in a plan view (state viewed along the mounting surface 1Aa), and a pair of fixing parts 15*c*A are formed on either side in the width direction (Y direction) on the tip side (the front side in the front-rear direction). Moreover, on the rear side in the front-rear direction relative to the pair of fixing parts 15*c*A, fixing parts 15*d*A are formed to fix a plug housing (housing) 10 of the plug connector 1. The fixing parts 15*c*A and the fixing part 15*d*A can be formed, for example, in the same manner as the conductor layers 15*b*A in a printing process for the conductor layers 15*b*A.

Moreover, in the alternative example, a cut portion 11*a*A that is elongated in the front-rear direction (X direction) and opens forward is formed in the connection region 11A of the cable 1A. In addition, through-holes 11*b*A that penetrate in the cable thickness direction (top-bottom direction; Z direction) are formed on either side of the cut portion 11*a*A in the width direction (Y direction) in the connection region 11A.

Furthermore, in the alternative example, the cable 1A includes a reinforcing plate 14A. This reinforcing plate 14A is formed using glass epoxy resin, stainless steel, or the like, and is configured to reinforce the connection region 11A of the cable 1A by sandwiching the connection region 11A of the cable 1A between the reinforcing plate 14A and the plug connector 1.

In the alternative example, the reinforcing plate 14A has a shape corresponding to the shape of the connection region 11A of the cable 1A. More specifically, a contour shape of the reinforcing plate 14A in the plan view (state viewed along the mounting surface 1*a*A) is approximately the same as that of the connection region 11A. Therefore, a cut portion 14*a*A that is elongated in the front-rear direction (X direction) and opens forward and through-holes 14*b*A that penetrate in the cable thickness direction (top-bottom direction; Z direction) are formed in the reinforcing plate 14A. Then, the reinforcing plate 14A is attached to the rear surface side of the connection region 11A with an adhesive or the like in a state where the cut portion 11*a*A and the cut portion 14*a*A communicate with each other and the through-holes 11*b*A and the through-holes 14*b*A communicate with each other.

In this event, it is preferable that the entire conductor part 151*b*A overlap with the reinforcing plate 14A in the plan view (state viewed along the mounting surface 1Aa). In this way, the entire conductor part 151*b*A is supported by the reinforcing plate 14A, and thus the conductor part 151*b*A can be prevented from bending in the top-bottom direction (Z direction) or warping in the width direction (Y direction).

[Configuration Example of Plug Connector 1]

Next, with reference to FIG. 40 to FIGS. 42A to 42D, description is given of a configuration example of the plug connector 1 included in the connector set C1 according to the alternative example.

Figure 40:
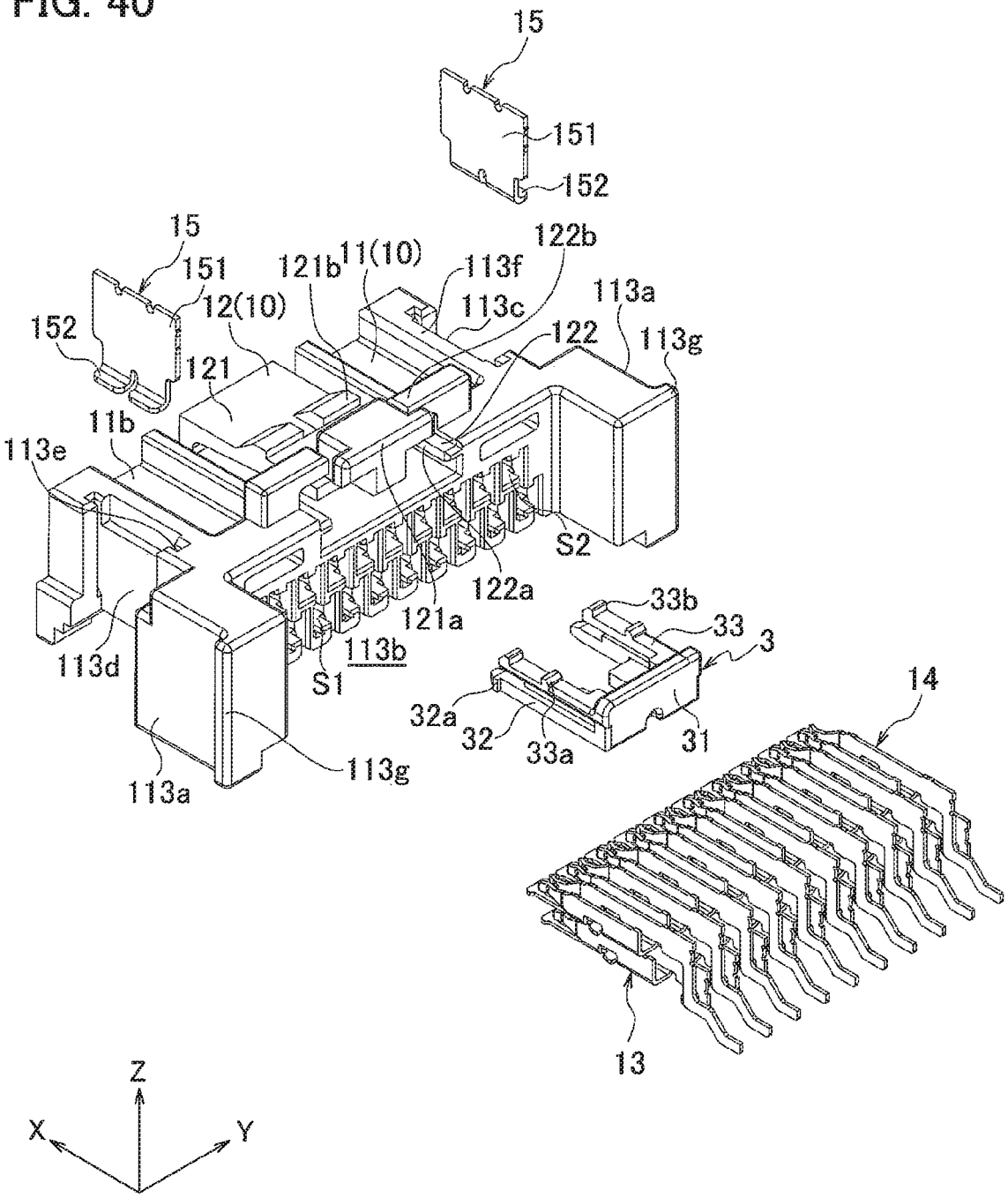
FIG. 40 is an exploded perspective view showing the plug connector and the slide member included in the connector set shown as the alternative example.
Figure 41A:
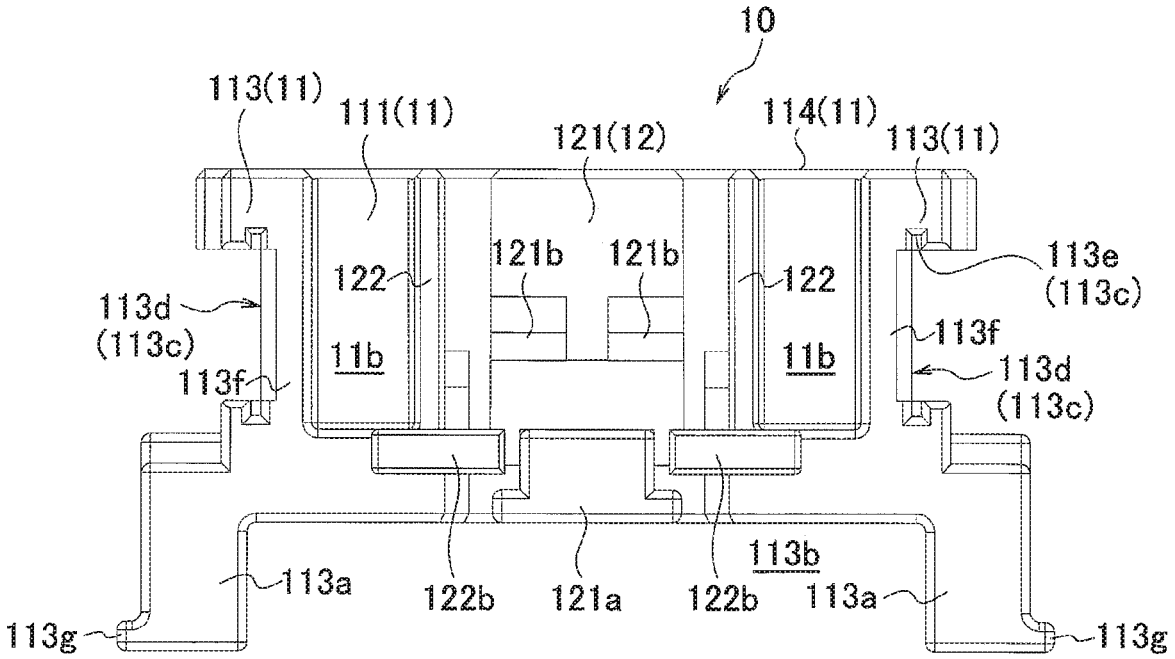
FIG. 41A is a plan view and FIG. 41B is a reverse side view, showing the plug housing included in the plug connector.
Figure 41B:
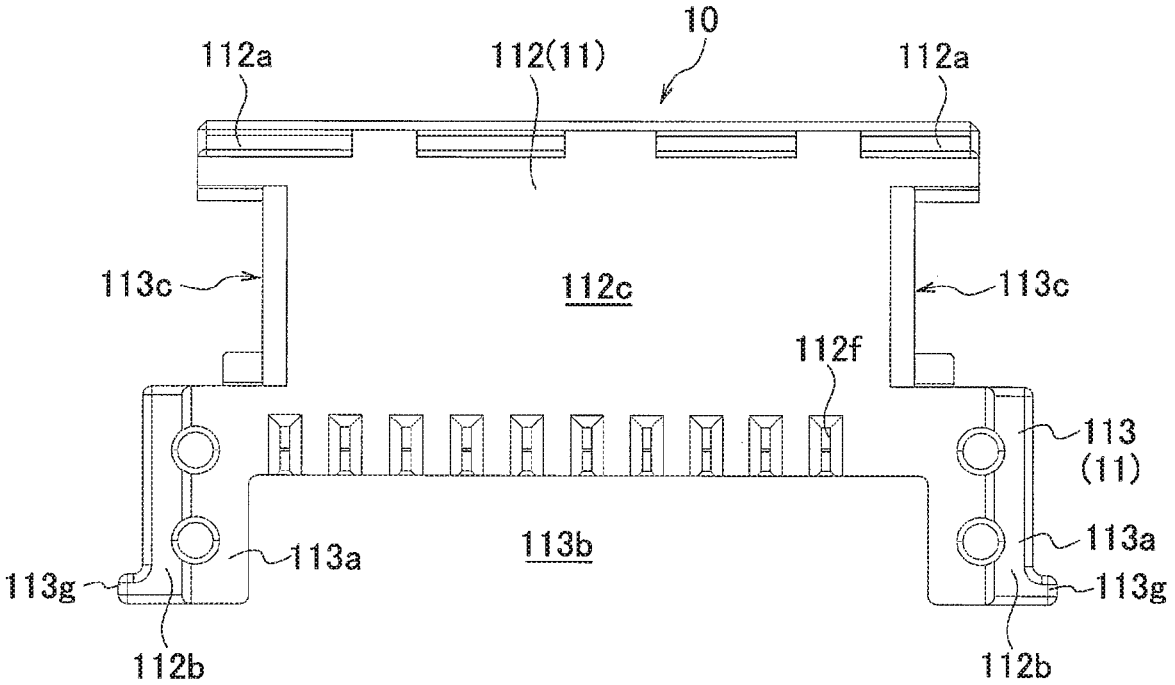
Figure 42A:
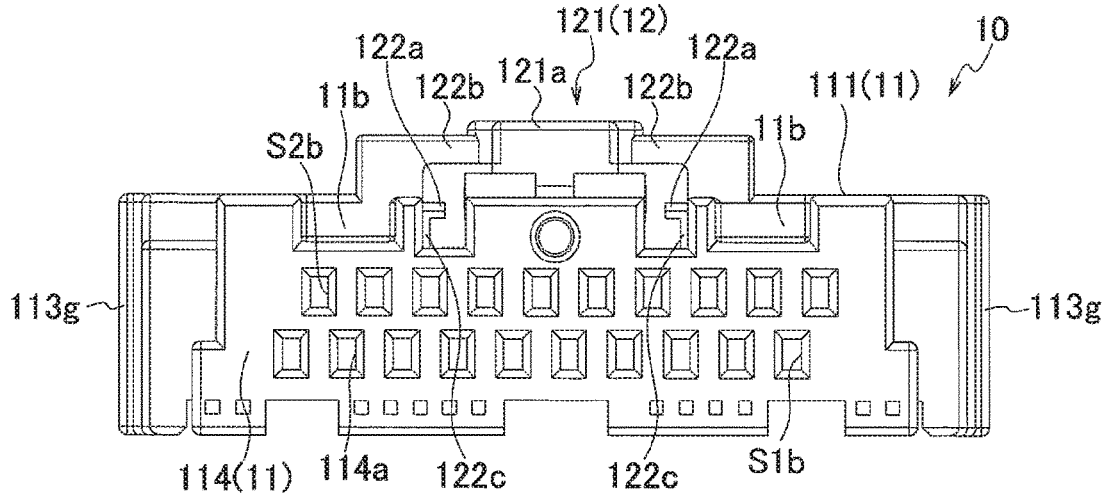
FIG. 42A is a front view.
Figure 42B:
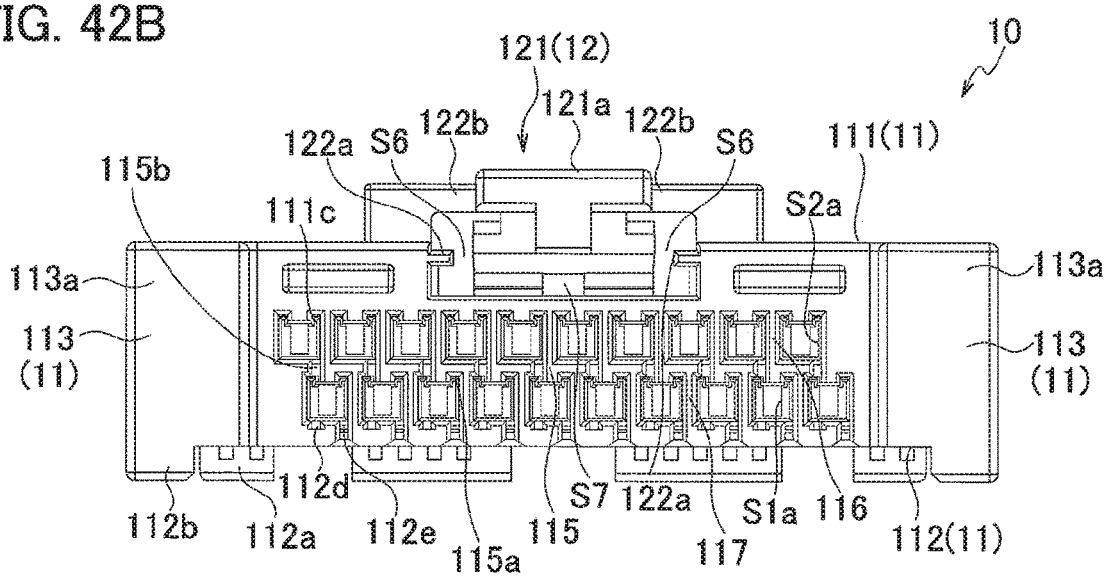
FIG. 42B is a back view.
Figure 42C:
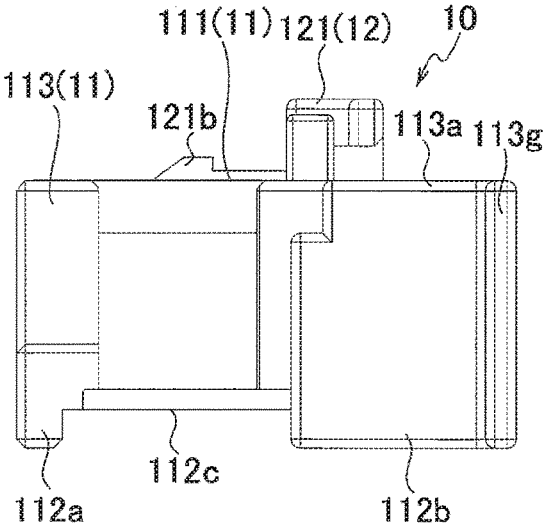
FIG. 42C is a side view.
Figure 42D:
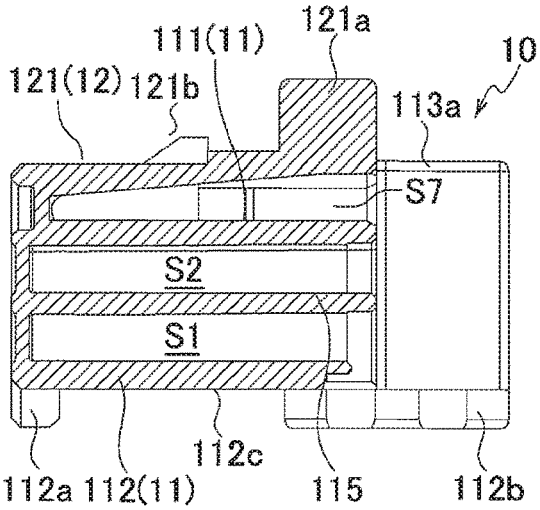
FIG. 42D is a sectional side view, showing the plug housing included in the plug connector.

As shown in FIG. 40, the plug connector 1 includes a plug housing (first housing) 10, plug terminals (lower plug terminals 13 and upper plug terminals 14) held by the plug housing 10, and holding brackets 15 held by the plug housing 10.

The plug connector 1 is mounted on the cable 1A as the mounting member by mounting the plug terminals (terminals: first terminals) 13, 14 held by the plug housing 10 on the conductor part 151*b*A of the cable 1A disposed outside the plug housing 10. Note that the plug terminals 13, 14 are mounted on the conductor part 151*b*A by soldering or the like. The holding brackets 15 are fixed to the fixing parts 15*c*A of the cable 1A by soldering or the like in a state where the holding brackets 15 are held by the plug housing 10 to fix the plug housing 10 to the cable 1A.

The plug housing 10 includes a rigid housing main body 11. This plug housing 10 can be formed, for example, using an insulating resin material.

The housing main body 11 also has a lock part 12 formed to hold the plug housing 10 and the receptacle housing 20 of the receptacle connector 2 in their fitted state or release the fitted state.

Thus, in the alternative example as well, the plug housing 10 includes the housing main body 11 and the lock part 12 formed in the housing main body 11.

The housing main body 11 includes a top wall 111, a bottom wall 112, a pair of side walls 113 connecting both ends, in the width direction (Y direction), of the top wall 111 and the bottom wall 112, and a front wall 114 provided continuously from front ends of the top wall 111, the bottom wall 112, and the side walls 113, 113.

In addition, the housing main body 11 includes a partition wall 115 that is provided continuously from the pair of side walls 113 and the front wall 114 and partitions, into upper and lower parts, a space defined by the top wall 111, the bottom wall 112, the side walls 113, 113, and the front wall 114.

The housing main body 11 further includes a plurality of upper partition walls 116 provided continuously from the top wall 111, the partition wall 115, and the front wall 114. These upper partition walls 116 partition the upper space partitioned by the partition wall 115 into a plurality of spaces. The housing main body 11 also includes a plurality of lower partition walls 117 provided continuously from the bottom wall 112, the partition wall 115, and the front wall 114. These lower partition walls 117 partition the lower space partitioned by the partition wall 115 into a plurality of spaces.

The lock part 12 is formed in the middle, in the width direction, of the upper part of the top wall 111*l* having an approximately flat plate shape, such that the lock part 12 protrudes upward. To be more specific, the lock part 12 includes a lever part 121 that is provided continuously from the front end of the top wall 111 and extends rearward. This lever part 121 has its rear side capable of moving in the top-bottom direction relative to the top wall 111 (housing main body 11). The lever part 121 has an operation part 121*a* formed at its rear end to operate the lever part 121, and also has an engagement protrusion 121*b* formed in its central portion, in the front-rear direction, of the lever part 121 to engage with an engagement recess part (engaging part) 221*a* formed in the receptacle connector 2.

In the alternative example as well, when the plug housing 10 and the receptacle housing 20 of the receptacle connector 2 are fitted together, the housings of the respective connectors can be locked together (maintained in the fitted state) by the engagement protrusion 121*b* engaging with the engagement recess part 221*a*. Then, the fitted state of the housings of the respective connectors can be released by lowering the operation part 121*a* of the lever part 121 to move downward the lever part 121 as well as the engagement protrusion 121*b*, thus releasing the engagement with the engagement recess part 221*a*.

Furthermore, the lock part 12 includes a pair of partition walls 122 provided upright on either side, in the width direction, of the lever part 121 such that the partition walls 122 extend in the front-rear direction at a distance from the lever part 121. Then, an insertion space S6 into which the slide member 3 is inserted is formed between each partition walls 122 and the lever part 121. In addition, below the lever part 121 (between the lever part 121 and the top wall 111), a deflection allowance space S7 is formed where downward deflection of the lever part 121 (the movement of the lever part 121 relative to the housing main body 11) is allowed.

Note that each insertion space S6 is partitioned into a space into which a lower arm part 32 of the slide member 3 is inserted and a space into which an upper arm part 33 of the slide member 3 is inserted, by a protrusion wall 122*a* formed to protrude in the width direction on the partition wall 122.

In addition, a step part 122*c* is formed in the middle in the front-rear direction below the protrusion wall 122*a* of each partition wall 122 and the space into which the lower arm part 32 is inserted is formed to have a wider front side in a plan view. Locking locking protrusions 32*a* that are formed to protrude outward in the width direction on the tips (front ends) of the lower arm parts 32 to the step parts 122*c* prevents the slide member 3 from falling off the housing main body 11. Note that in the alternative example, the step parts 122*c* formed on the partition walls 122 have a shape similar to that of the step parts 116*b* shown in FIG. 26.

In addition, in rear parts of the partition walls 122, restrictive protrusions (slide restrictors) 122*b* each protruding toward the lever part 121 are formed. The restrictive protrusions 122*b* prevent the slide member 3 from sliding from the initial position to the slide completion position in the state where the plug housing 10 has not been completely fitted into the receptacle housing 20.

Moreover, in the alternative example, protrusion walls 113*f* are formed such that the upper parts of the pair of side walls 113 protrudes above the top wall 111. The gap between each protrusion wall 113*f* and the lock part 12 serves as a guide recess part 11*b* that guides the fitting of the plug housing 10 into the receptacle housing 20 of the receptacle connector 2.

In addition, at the front end of the lower side (rear surface side) of the bottom wall 112, protrusions 112*a* extending in the width direction are formed so as to protrude downward. Moreover, at the rear ends on either side, in the width direction, of the bottom wall 112, a pair of protrusions 112*b* elongated in the front-rear direction are formed so as to protrude downward. The protrusions 112*a*, 112*b* are formed in the bottom wall 112 such that the amount of protrusion of the protrusions 112*a*, 112*b* is more than or equal to the sum of the thickness of the cable 1A and the thickness of the reinforcing plate 14A.

By forming such protrusions 112*a*, 112*b* in the bottom wall 112, a recess part 112*c* is formed in the lower surface of the bottom wall 112. When the plug connector 1 is mounted on the cable 1A, the connection region 11A having the reinforcing plate 14A attached thereto is housed in the recess part 112*c* (see FIG. 39B).

As described above, in the alternative example as well, the plug housing 10 includes a pair of wall parts (top wall 111 and bottom wall 112) facing each other in the housing thickness direction (top-bottom direction: Z direction). Then, the recess part 112*c* to house the connection region 11A of the cable 1A is formed in the bottom wall 112, which is one of the pair of wall parts (top wall 111 and bottom wall 112). In other words, the plug housing 10 has a receiving part (recess part 112*c*) to receive the cable (mounting member) 1A in the wall part (bottom wall 112) on one side in the housing thickness direction (top-bottom direction).

Note that in the alternative example as well, a positioning protrusion 212*b* is formed in the receptacle connector 2 so as to correspond to the slit 11 aA and the slit 14*a*A. Then, the positioning protrusion 212*b* is configured to be inserted into the slit 11*a*A and the slit 14*a*A when the plug housing 10 is fitted into the receptacle housing 20. In this way, a positional shift of the cable 1A in the width direction is suppressed. In addition, the protrusions 112*a* suppress a forward shift in position of the cable 1A.

In addition extension parts 113*a*, 113*a* extending rearward are formed on the pair of side walls 113, 113, respectively, and a region where the extension parts 113*a*, 113*a* face each other serves as a recess part 113*b* that houses mounting pieces (mounting parts) 132, 142 of the terminals 13, 14.

Moreover, protrusions 113*g* protruding outward in the width direction are formed on the rear end sides of the extension parts 113*a* so as to extend in the top-bottom direction. Providing such protrusions 113*g* makes it possible to hook fingers on the protrusions 113*g* when gripping the plug connector 1 with a hand. This allows the plug connector 1 fitted into the receptacle connector 2 to be more easily pulled out.

The front wall 114 has through-holes 114*a* formed therein, which communicate with the plurality of spaces partitioned by the partition wall 115, the upper partition wall 116, and the lower partition wall 117. Thus, in the alternative example, the plurality of spaces penetrating in the front-rear direction are formed in the housing main body 11. Then, the plug terminals (lower plug terminal 13 and upper plug terminal 14) are press-fitted (inserted) respectively into the spaces penetrating in the front-rear direction.

In the alternative example, a plurality of spaces arranged in the width direction (Y direction) are formed in two stages in the top-bottom direction (Z direction) in the housing main body 11. Moreover, the plurality of spaces are formed in a staggered pattern when the housing main body 11 is viewed from the rear side in the front-rear direction. Accordingly, the plug connector 1 is reduced in size in the width direction.

To be more specific, on the lower side (mounting surface 1*a*A side) of the housing main body 11, a plurality of spaces defined by the bottom wall 112, the partition wall 115, and the lower partition wall 117 are arranged in the width direction (Y direction). These spaces formed on the lower side (mounting surface 1*a*A side) of the housing main body 11 serve as lower spaces S1 into which the lower plug terminals 13 are press-fitted (inserted).

On the other hand, on the upper side (position further away from the mounting surface 1*a*A than the lower spaces S1) of the housing main body 11, a plurality of spaces defined by the top wall 111, the partition wall 115, and the upper partition wall 116 are arranged in the width direction (Y direction). These spaces formed on the upper side of the housing main body 11 serve as upper spaces S2 into which the upper plug terminals 14 are press-fitted (inserted).

In the alternative example, on the lower side of the housing main body 11, 10 spaces (lower spaces S1) are arranged in the width direction. On the other hand, on the upper side of the housing main body 11, 10 spaces (upper spaces S2) are arranged without the lock part 12 being interposed. Accordingly, the housing main body 11 is reduced in size in the width direction.

Moreover, in the alternative example, the upper partition walls 116 and the lower partition walls 117 are formed at positions shifted from each other in the width direction. In other words, the lower spaces S1 and the upper spaces S2 are formed so as to partially overlap with each other in the plan view. That is, the lower spaces S1 and the upper spaces S2 overlap with each other, when the plug housing 10 is viewed along a direction (top-bottom direction) normal to the mounting surface 1*a*A, in a state where the plug terminals 13, 14 are held by the plug housing 10 and also mounted on the cable 1A.

The lower plug terminals 13 are each configured to be press-fitted (inserted) forward from an opening at the rear end side of the lower space S1. The upper plug terminals 14 are each configured to be press-fitted (inserted) forward from an opening at the rear end side of the upper space S2.

Note that in the alternative example, the plug terminals 13, 14 have the same shapes as those of the plug terminals 13, 14 shown in the above-described embodiment. In addition, the holding bracket 15 also has the same shape as that of the holding bracket 15 shown in the above-described embodiment. For this reason, the lower and upper spaces S1, S2 and the holding bracket attachments 113*c* formed in the housing main body 11 also have the same shapes as those shown in the above-described embodiment.

As described above, the plug connector 1 according to the alternative example is different from the plug connector 1 shown in the above-described embodiment in that the lock part 12 is provided to protrude upward, but the other configurations are basically same as those of the plug connector 1 shown in the above-described embodiment.

[Configuration Example of Receptacle Connector 2]

Next, with reference to FIG. 43 to FIGS. 46A to 46D, description is given of a configuration example of the receptacle connector 2 included in the plug connector 1 according to the alternative example.

Figure 43:
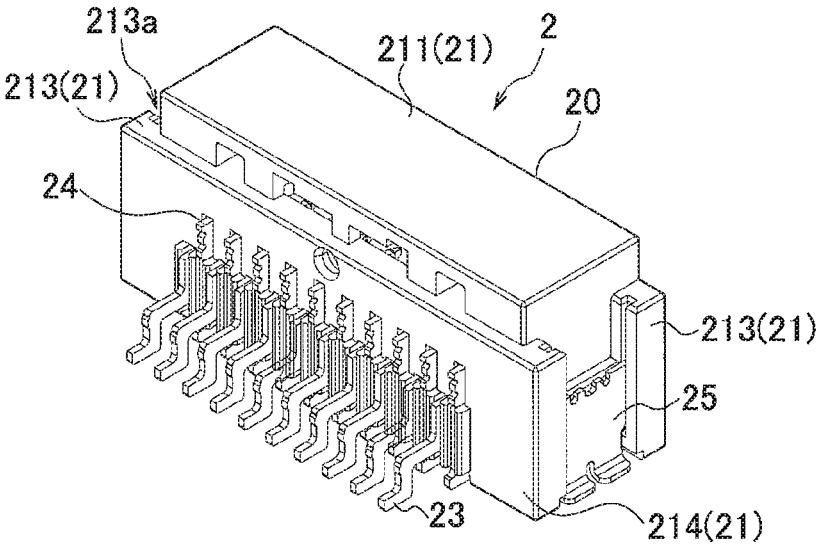
FIG. 43 is a perspective view showing the receptacle connector included in the connector set shown as the alternative example.
Figure 44:
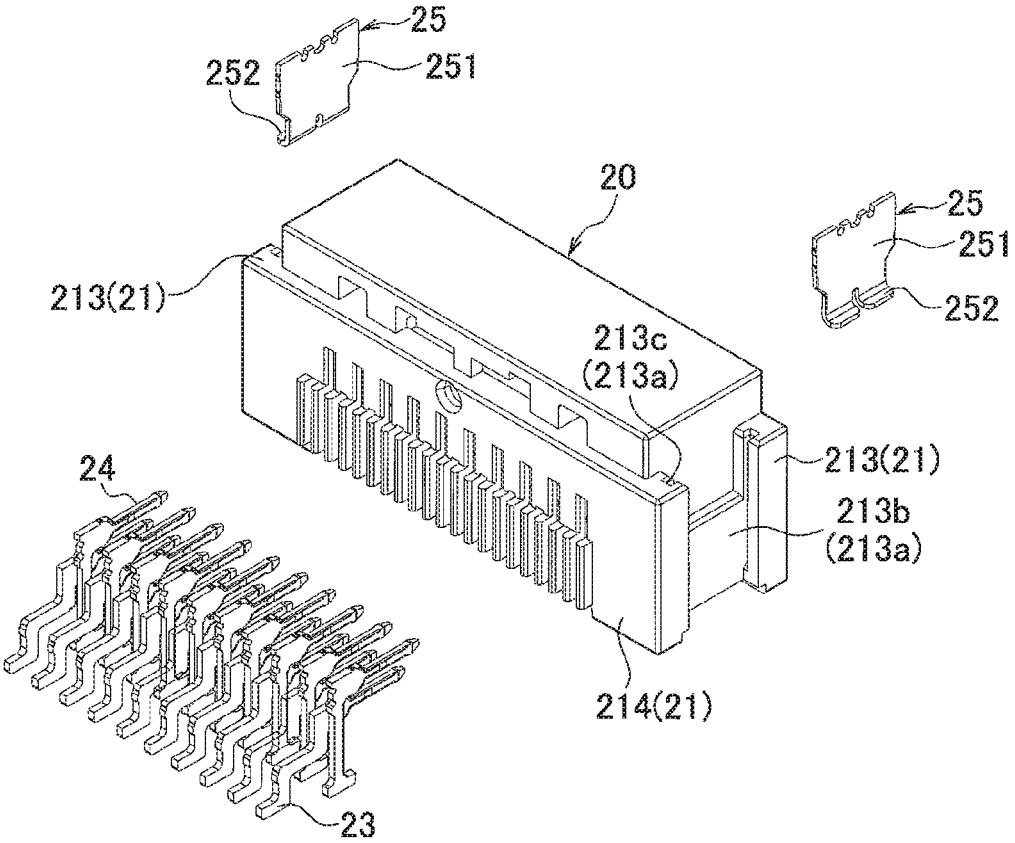
FIG. 44 is an exploded perspective view showing the receptacle connector included in the connector set shown as the alternative example.
Figure 45A:
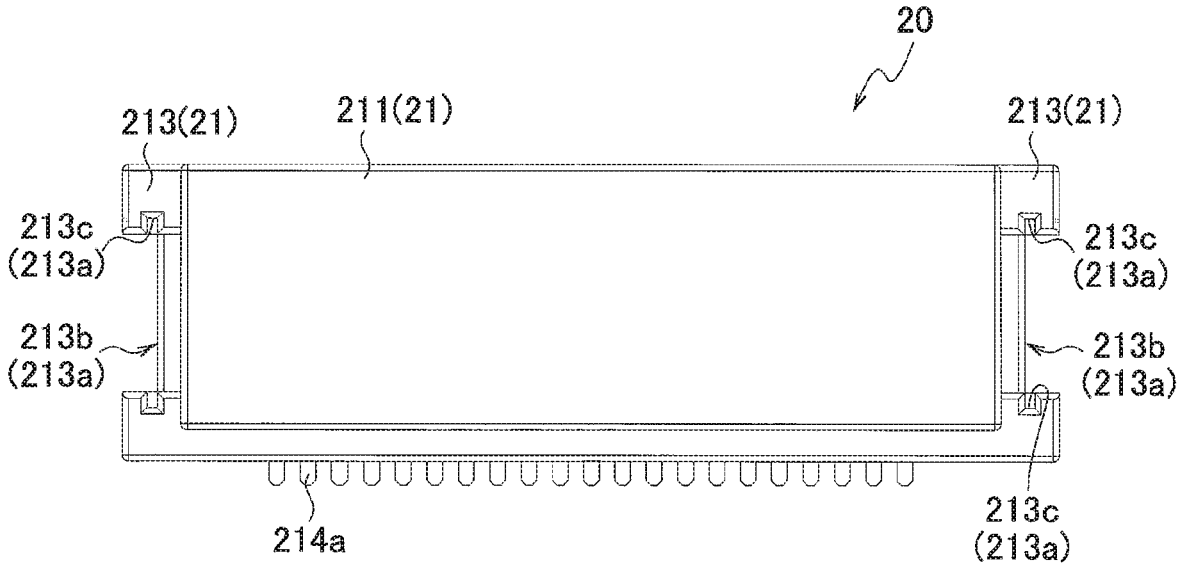
FIG. 45A is a plan view and FIG. 45B is a reverse side view, showing the receptacle housing included in the receptacle connector shown as the alternative example.
Figure 45B:
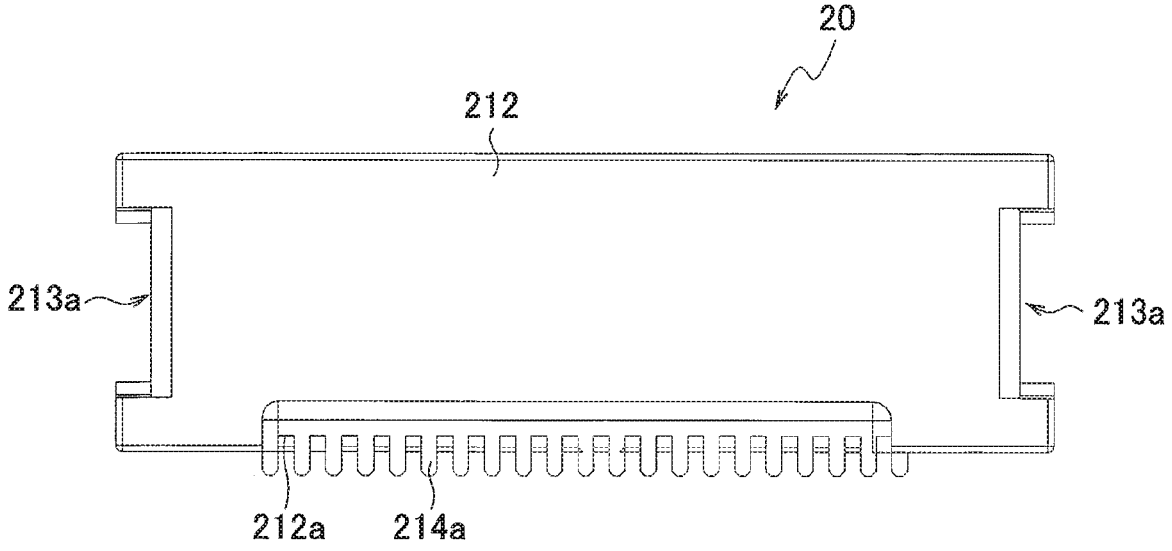
Figure 46A:
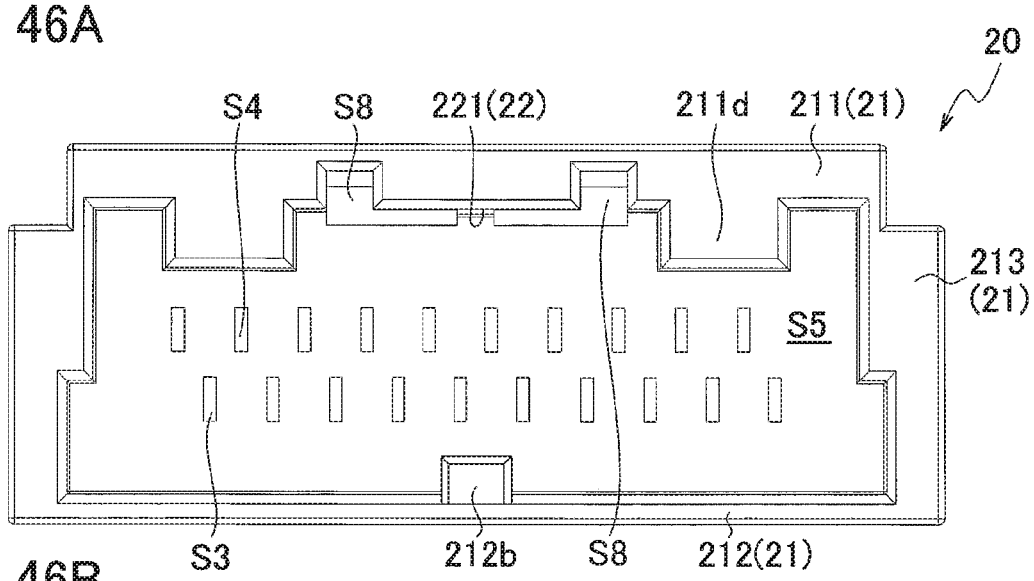
FIG. 46A is a front view.
Figure 46B:
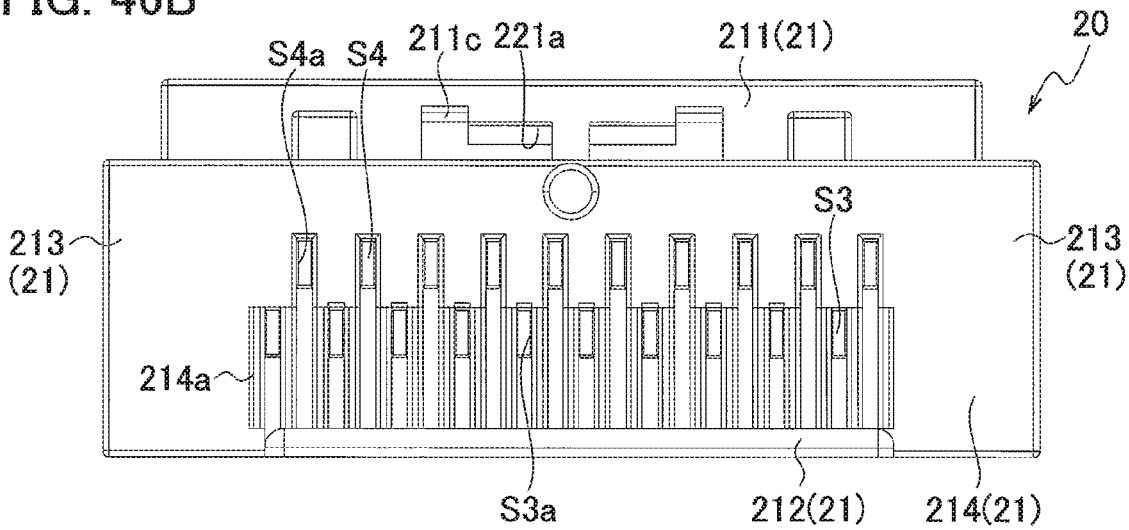
FIG. 46B is a back view.
Figure 46C:
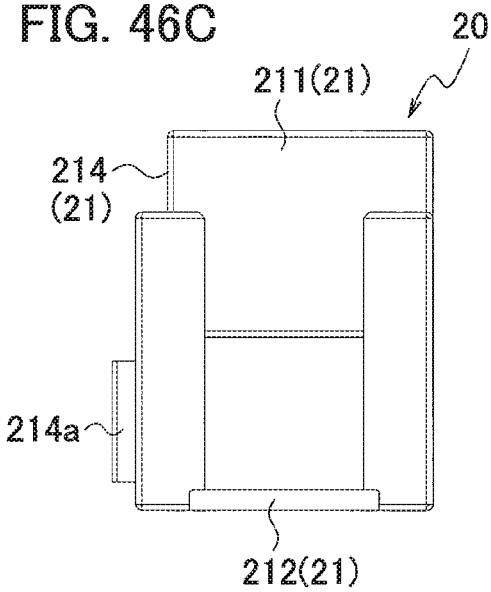
FIG. 46C is a side view.
Figure 46D:
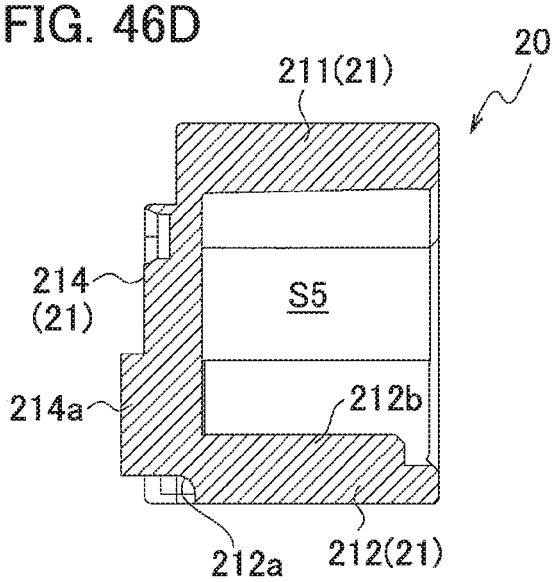
FIG. 46D is a sectional side view, showing the receptacle housing included in the receptacle connector shown as the alternative example.
Figure 47B:
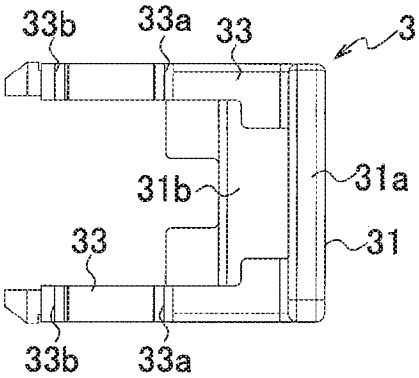
FIG. 47B is a plan view.
Figure 47C:
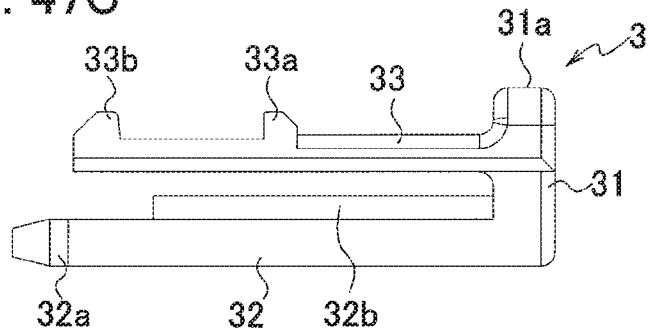
FIG. 47C is a side view.
Figure 47D:
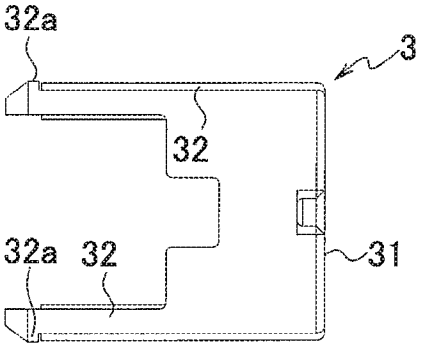
FIG. 47D is a reverse side view.
Figure 47A:
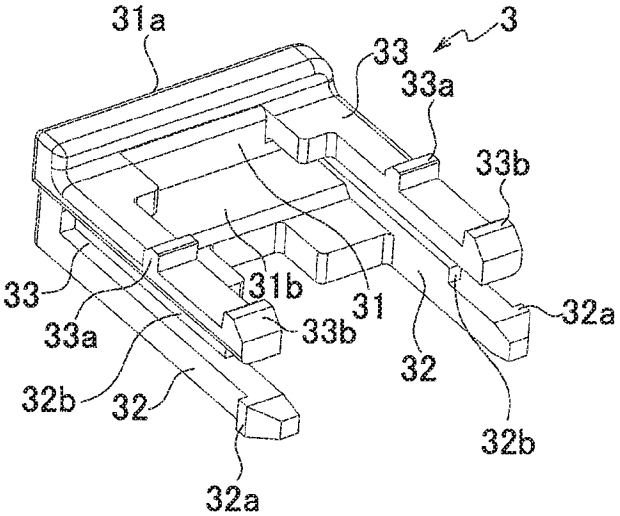
FIG. 47A is a perspective view.
Figure 47F:
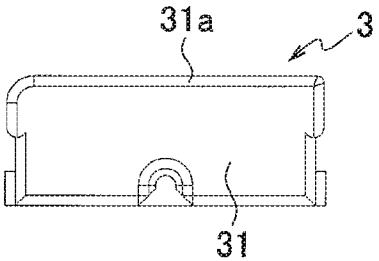
FIG. 47F is a back view, showing the slide member included in the connector set shown as the alternative example.
Figure 47E:
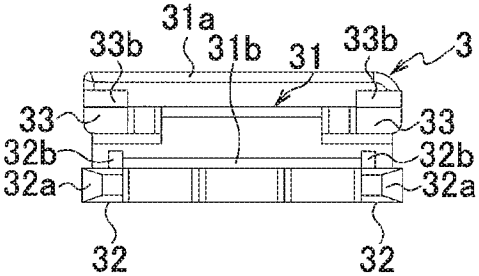
FIG. 47E is a front view.

As shown in FIG. 43 and FIG. 44, the receptacle connector 2 includes a receptacle housing (second housing) 20 and receptacle terminals (second terminals) 23, 24 held by the receptacle housing 20. The receptacle connector 2 also includes holding brackets 25 held by the receptacle housing 20.

Then, the receptacle connector 2 is mounted on the circuit board 2A as the mounting member by mounting the receptacle terminals (second terminals) 23, 24 held by the receptacle housing 20 on the conductor part 2*b*A of the circuit board 2A disposed outside the receptacle housing 20. Note that the receptacle terminals 23, 24 are also mounted on the conductor part 2*b*A by soldering or the like. The holding brackets 25 are fixed to the fixing parts 2*c*A of the circuit board 2A by soldering or the like in a state where the holding brackets 25 are held by the receptacle housing 20, to fix the receptacle housing 20 to the circuit board 2A.

Note that the circuit board 2A includes a board main body 2*a*A that has an approximately rectangular plate shape and is formed of a rigid and insulating resin material or the like. The conductor part 2*b*A and the fixing parts 2*c*A are formed so as to be exposed to the top surface 21*a*A of the board main body 2*a*A. Thus, in the alternative example as well, the top surface 21*a*A of the board main body 2*a*A serves as the mounting surface.

The receptacle housing 20 includes a rigid housing main body 21. This receptacle housing 20 can be formed, for example, using an insulating resin material.

The housing main body 21 also has a lock insertion part 22 formed on its upper side. The lock part 12 configured to hold the plug housing 10 and the receptacle housing 20 in their fitted state and to release the fitted state is inserted into this lock insertion part 22.

Thus, in the alternative example as well, the receptacle housing 20 includes the housing main body 21 and the lock insertion part 22 formed in the housing main body 21.

The housing main body 21 includes a top wall 211, a bottom wall 212, a pair of side walls 213 connecting both ends, in the width direction (Y direction), of the top wall 211 and the bottom wall 212, and a rear wall 214 provided continuously from rear ends of the top wall 211, the bottom wall 212, and the side walls 213, 213.

The lock insertion part 22 is formed in the middle, in the width direction, of the top wall 211. To be more specific, the lock insertion part 22 includes a housing part 221 that is formed inside an upward protruding region of the top wall 211, formed stepwise, and houses the lever part 121. In the middle, in the front-rear direction, of this housing part 221, an engagement recess part 221*a* is formed, which serves as an engaging part to engage with the engagement protrusion 121*b* of the lock part 12. In addition, on either side, in the width direction, of the housing part 221, guide protrusions 211*d* are formed, which are housed in the guide recess parts 11*b*.

Moreover, on either side, in the width direction, of the housing part 221, insertion spaces S8 are formed, into which the upper arm parts 33 of the slide member 3 are inserted. Protrusions (locked parts), which protrude downward but are not shown, are formed in the top wall 211 so as to be disposed in the insertion space S8 in a state viewed along the insertion direction (front-rear direction; X direction). These protrusions are configured to deflect the upper arm parts 33 downward and to lock the engagement protrusions 33*b* formed on the tips of the upper arm parts 33, like the protrusions 211*c* shown in the above second embodiment.

In addition, in the middle, in the width direction, of the bottom wall 212, a positioning protrusion 212*b* that protrudes upward is formed. This positioning protrusion 212*b* is formed so as to correspond to the cut portion 11*a*A and the cut portion 14*a*A. The positioning protrusion 212*b* is configured to be inserted into the cut portion 11*a*A and the cut portion 14*a*A when the plug housing 10 is fitted into the receptacle housing 20. In this way, this positioning protrusion 212*b* positions the cable 1A in the width direction.

In addition, a plurality of spaces that penetrate in the front-rear direction are formed in the rear wall 214. In the alternative example, a plurality of spaces arranged in the width direction (Y direction) are formed in two stages in the top-bottom direction (Z direction). Moreover, the plurality of spaces are formed in a staggered pattern when the housing main body 21 is viewed from the rear side in the front-rear direction. Accordingly, the receptacle connector 2 is reduced in size in the width direction.

Then, the receptacle terminals 23, 24 are press-fitted (inserted) respectively into the spaces penetrating in the front-rear direction.

To be more specific, the spaces formed on the lower side (mounting surface 21*a*A side) of the housing main body 21 serve as lower spaces S3 into which the lower receptacle terminals 23 out of the receptacle terminals 23, 24 are press-fitted (inserted).

On the other hand, the spaces formed on the upper side (position further away from the mounting surface 21*a*A than the lower space S3) of the housing main body 21 serve as upper spaces S4 into which the upper receptacle terminals 24 out of the receptacle terminals 23, 24 are press-fitted (inserted).

The lower receptacle terminals 23 are each configured to be press-fitted (inserted) forward from an opening at the rear end side of the lower space S3. This opening on the rear end side of the lower space S3 serves as an insertion slot S3*a*. Likewise, the upper receptacle terminals 24 are each configured to be press-fitted (inserted) forward from an opening on the rear end side of the upper space S4. This opening on the rear end side of the upper space S4 serves as an insertion slot S4*a*.

Moreover, the housing main body 21 has a fitting space S5 formed therein, which is opened forward (toward the plug connector 1 side). This fitting space S5 is a space into which the housing main body 11 of the plug housing 10 is inserted and fitted, and is defined by the top wall 211, the bottom wall 212, the pair of side walls 213, 213, and the rear wall 214. Therefore, the lower space S3 and the upper space S4 are each formed to communicate with the fitting space S5.

Note that in the alternative example, the receptacle terminals 23, 24 have the same shapes as those of the receptacle terminals 23, 24 shown in the above-described embodiment. In addition, the holding bracket 25 also has the same shape as that of the holding bracket 25 shown in the above-described embodiment. For this reason, the lower and upper spaces S3, S4 and the holding bracket attachments 213*a* formed in the housing main body 21 also have the same shapes as those shown in the above-described embodiment.

As described above, the receptacle connector 2 according to the alternative example is different from the receptacle connector 2 shown in the above-described embodiment in that the lock insertion part 22 is provided to protrude upward, but the other configurations are basically same as those of the receptacle connector 2 shown in the above-described embodiment.

[Configuration Example of Slide Member 3]

Next, an example of the configuration of the slide member 3 slidably held in the plug connector 1 according to the alternative example is described based on FIGS. 47A to 47F.

The slide member 3 includes a main body part 31 having a substantially rectangular plate shape. On the upper part of this main body part 31, a handle 31*a* is formed.

In addition, a pair of lower arm parts 32 are provided continuously on either side, in the width direction, of the lower part of the main body part 31 such that the pair of lower arm parts 32 extend forward in the front-rear direction. The pair of lower arm parts 32 are provided continuously on the main body part 31 in a cantilever fashion and are formed to be capable of elastically deforming in the width direction. On the tips (front ends) of these lower arm parts 32, locking protrusions (retaining parts) 32*a* are formed to protrude outward in the width direction.

On the other hand, a pair of upper arm parts 33 are provided continuously on either side, in the width direction, of the upper part of the main body part 31 such that the pair of upper arm parts 33 extend forward in the front-rear direction. The pair of upper arm parts 33 are provided continuously on the main body part 31 in a cantilever fashion and are formed to be capable of elastically deforming in the top-bottom direction (the direction intersecting the insertion direction of the terminals). In addition, in the slide member 3 shown in FIGS. 47A to 47F, the pair of upper arm parts 33 are formed to be wider on their base side (the side continuous to the main body part 31). On the tips (front ends) of these upper arm parts 33, engagement protrusions (engaging parts) 33*b* are formed to protrude upward.

In addition, protrusions 33*a* protruding upward are formed in a substantially middle, in the front-rear direction, of the upper arm parts 33.

Moreover, a restrictive protrusion (restrictor) 31*b* extending forward and upward is formed in a lower part of the main body part 31. Note that in the slide member 3 shown in FIGS. 47A to 47F, each of the ends, in the width direction, of the restrictive protrusion (restrictor) 31*b* is continuous on the inner surface of the lower arm part 32.

In addition, in the slide member 3 shown in FIGS. 47A to 47F, protrusions 32*b* protruding upward are formed on the lower arm parts 32 along the direction in which the lower arm parts 32 extend. To be more specific, the protrusions 32*b* are formed to extend from the base side to the tip side of the lower arm parts 32 and are each formed to be elongated in the direction in which the lower arm parts 32 extend. By forming such protrusions 32*b* on the lower arm parts 32, the gap between the lower arm parts 32 and the upper arm parts 33 is reduced. Note that in the slide member 3 shown in FIGS. 47A to 47F, the protrusions 32*b* are not formed directly below the portions where the engagement protrusions (engaging parts) 33*b* are formed in the upper arm parts 33. To be more specific, the protrusions 32*b* are formed such that their tips are located not further away (or located closer to the base) than the engagement protrusions (engaging parts) 33*b* of the upper arm parts 33. This prevents the elastic deformation of the upper arm parts 33 in the top-bottom direction from being hindered by the protrusion 32*b*.

Moreover, in the slide member 3 shown in FIGS. 47A to 47F, the gap (the shortest distance in the top-bottom direction) between the lower arm parts 32 and the upper arm parts 33 at the locations where the protrusions 32*b* are formed is made smaller than the thickness of the lower arm parts 32 in the top-bottom direction and the thickness of the upper arm parts 33 in the top-bottom direction.

As described above, in the slide member 3 shown in FIGS. 47A to 47F, the protrusion 32*b*, which makes smaller the gap between the lower arm part 32 and the upper arm part 33, is formed to extend from the base side to the tip side on each lower arm part 32, which is at least one arm part out of the lower arm part 32 and the upper arm part 33. Thus, the gap between the lower arm parts 32 and the upper arm parts 33 at the locations where the protrusions 33*b* are formed is made smaller than the thickness of the lower arm parts 32 and the thickness of the upper arm parts 33.

Furthermore, in the slide member 3 shown in FIGS. 47A to 47F, the width on the tip sides of the lower arm parts 32 and the width on the tip sides of the upper arm parts 33 are also made larger than the gap (the shortest distance in the top-bottom direction) between the lower arm parts 32 and the upper arm parts 33 at the locations where the protrusions 32*b* are formed.

This makes it possible to prevent the lower arm parts 32 or the upper arm parts 33 of another slide member 3 from being inserted into the gap between the lower arm parts 32 and the upper arm parts 33 of the slide member 3, so that these arm parts are not entangled with each other. In this way, the slide member 3 shown in FIGS. 47A to 47F is configured such that the arm parts are prevented from being entangled with each other without hindering the elastic deformation of the upper arm parts 33 in the top-bottom direction.

When such a slide member 3 is caused to function as a CPA member as well, the operations shown in FIG. 27 to FIG. 29 are carried out as in the case of the slide members 3 shown in FIGS. 25A to 25F, and FIGS. 31A and 31B and FIGS. 32A to 32F.

Note that the slide member 3 shown in FIGS. 25A to 25F or the slide member 3 shown in FIGS. 31A and 31B and FIGS. 32A to 32F may be used in the connector set C1 according to the alternative example, or the slide member 3 shown in FIGS. 47A to 47F may be used in the connector set C1 shown in the above-described embodiment.

[Operations and Effects]

As described above, the connector set C1 according to this embodiment or alternative example includes: the plug connector (first connector) 1 having the plug housing (first housing) 10 and the first terminal (lower plug terminal 13 and upper plug terminal 14) held in the plug housing 10.

In addition, the connector set C1 includes: the receptacle connector (second connector) 2 having the receptacle housing (second housing) 20 configured to be fitted to the plug housing 10 and the second terminal (lower receptacle terminal 23 and upper receptacle terminal 24) held in the receptacle housing 20 and configured to come in conduction with the first terminal in a state where the plug housing 10 and the receptacle housing 20 are fitted together.

Moreover, the connector set C1 includes the slide member 3 held in one housing (plug housing 10) out of the plug housing 10 and the receptacle housing 20 to be slidable between the initial position which is the first position and the completion position which is the second position.

Then, the plug housing 10 includes: the housing main body (first housing main body) 11 holding the first terminal; and the lever part 121 provided continuously on the housing main body 11 and configured to move relative to the housing main body 11.

In addition, the receptacle housing 20 includes: the housing main body (second housing main body) 21 holding the second terminal; and the engagement recess part (engaging part) 221*a* configured to be engaged with the lever part 121 in the state where the plug housing 10 and the receptacle housing 20 are fitted together and to maintain the fitting between the plug housing 10 and the receptacle housing 20.

Moreover, the slide member 3 includes: the slide lock mechanism. This slide lock mechanism is configured to interfere with the restrictive protrusions (slide restrictor) 111*d*, 122*b* formed on the one housing (plug housing 10), so that sliding of the slide member 3 to the completion position is restricted, in a state where the plug housing 10 and the receptacle housing 20 are not fitted together. In addition, the slide lock mechanism is configured to release the interference with the restrictive protrusions 111*d*, 122*b*, so that the sliding of the slide member 3 to the completion position is allowed, in a state where the plug housing 10 and the receptacle housing 20 are fitted together.

Then, the restrictive protrusions 111*d*, 122*b* are formed on the housing main body 11 of the one housing (plug housing 10).

In this way, in this embodiment or alternative example, the housing main body 11, which is a rigid member, restricts the sliding of the slide member 3 to the completion position.

This makes it possible to more surely prevent the restriction on the sliding of the slide member 3 to the completion position made by the restrictive protrusion 111*d*, 122*b* from being released in the state where the plug housing 10 and the receptacle housing 20 are not fitted together. In other words, it is possible to more surely prevent the sliding of the slide member 3 from the initial position to the completion position from being allowed in the state where the plug housing 10 and the receptacle housing 20 are not fitted together.

As a result, it is possible to more surely check the completion of the fitting between the plug housing 10 and the receptacle housing 20.

In addition, the plug connector (connector) 1 according to this embodiment or alternative example includes: the plug housing (housing) 10 in which the above-described slide member 3 is held to be slidable between the initial position and the completion position; and the terminal (lower plug terminal 13 and upper plug terminal 14) held in the plug housing 10.

Using such a plug connector 1 makes it possible to more surely check the completion of the fitting between the plug housing 10 and the receptacle housing 20.

As described above, according to this embodiment or alternative example, it is possible to obtain the connector set C1 and the plug connector (connector) 1 which make it possible to more surely check the completion of the fitting between the plug housing 10 and the receptacle housing 20.

In addition, in this embodiment or alternative example, the engagement protrusions (engaging part) 33*b* are formed on the slide member 3, the engagement protrusions (engaging part) 33*b* being configured to be locked to the protrusions (locked part) 221*c* formed on the other housing (receptacle housing 20) to restrict the sliding of the slide member 3 to the initial position when the slide member 3 is slid to the completion position.

In this way, causing the slide member 3 to be locked to the other housing (receptacle housing 20) makes it possible to prevent the fitting between the plug housing 10 and the receptacle housing 20 from being released, also with the slide member 3. As a result, it is possible to more surely prevent the plug housing 10 fitted to the receptacle housing 20 from falling off the receptacle housing 20. In other words, it is possible to further enhance the pullout strength of the plug housing 10 from the receptacle housing 20 in the state where these housings are fitted together.

In addition, in this embodiment or alternative example, the protrusions (locked part) 221*c* are formed on the housing main body 21 of the other housing (receptacle housing 20).

In this way, in this embodiment or alternative example, the slide member 3 locks the plug housing 10 and the receptacle housing 20 in a fitted state at a location different from that where the lever part 121 in the other housing (receptacle housing 20) and the engagement recess part (engaging part) 221*a* are engaged with each other.

Since the contact area of a portion where the plug housing 10 and the receptacle housing 20 are locked increases, this configuration makes it possible to further enhance the pull-out strength of the plug housing 10 from the receptacle housing 20 in the state where these housings are fitted together.

In addition, in this embodiment or alternative example, the restrictive protrusions (restrictor) 31*b* are formed on the slide member 3, the restrictive protrusions (restrictor) 31*b* being configured to restrict the movement of the lever part 121 relative to the housing main body 11 when the slide member 3 is slid to the completion position.

This makes it possible to prevent the locking with the lever part 121 from being released unless the locking with the slide member 3 is released.

[Others]

Although the preferred embodiment of the present disclosure has been described above, the present disclosure is not limited to the above embodiment and modified examples thereof, but various changes can be made thereto.

For example, although the above-described embodiment and modified example illustrate a connector in which a plurality of terminals are disposed in the upper and lower two stages, it is also possible to make a connector in which a plurality of terminals are disposed only in one stage and a connector in which a plurality of terminals are disposed in three stages or more.

In addition, although the connector in which the terminals disposed in the same stage have the same shape is illustrated, it is also possible to make a connector in which a plurality of types of terminals are disposed in the same stage.

In addition, although the above-described embodiment and modified example illustrate the configuration in which the interference with the restrictive protrusions 111*d*, 122*b* is released by elastically deforming the upper arm parts 33 in the top-bottom direction, it is also possible to employ a configuration in which the interference with the restrictive protrusions 111*d*, 122*b* is released by elastically deforming the upper arm parts 33 in the width direction. Specifically, it is also possible to employ a configuration in which the interference with the restrictive protrusions 111*d*, 122*b* is released by moving the protrusions 33*a*, which face and interfere with the restrictive protrusions 111*d*, 122*b* in the front-rear direction, that is, the insertion direction of the terminals, in a direction intersecting the front-rear direction (terminal insertion direction).

In addition, although the above-described embodiment and modified example illustrate the configuration in which the engagement protrusions (engaging part) 33*b*, which restrict the sliding of the slide member 3 to the initial position, are locked to the protrusions (locked part) 221*c*, which are formed on the housing main body 21 of the other housing (receptacle housing 20), the locked part may be formed on the engagement recess part (engaging part) 221*a* of the other housing (receptacle housing 20).

In addition, although the above-described embodiment and modified example illustrate the configuration in which the slide member is held in the plug connector, it is also possible to employ a configuration in which the slide member is held in the receptacle connector.

In addition, the present disclosure may be applied to connectors (plug connectors and receptacle connectors) that electrically connect boards or cables with each other. Moreover, the present disclosure may be applied to connectors (plug connectors and receptacle connectors) that electrically connect an electric wire with a board and to connectors (plug connectors and receptacle connectors) that electrically connect an electric wire with a cable.

In addition, specifications (shapes, sizes, layouts, and the like) of the housings, the terminals, and the other details may also be changed as needed.

The invention claimed is:

1. A connector set comprising:
a first connector having
a first housing, and
a first terminal held in the first housing;
a second connector having
a second housing to be fitted to the first housing, and
a second terminal held in the second housing and to come in conduction with the first terminal in a state where the first housing and the second housing are fitted together; and
a slide member held in one housing out of the first housing and the second housing to be slidable between a first position and a second position, wherein
the first housing includes:
a first housing main body holding the first terminal; and
a lever part provided continuously on the first housing main body and to move relative to the first housing main body,
the second housing includes:
a second housing main body holding the second terminal; and
a second housing side engaging part to be engaged with the lever part in the state where the first housing and the second housing are fitted together and to maintain the fitting between the first housing and the second housing,
the slide member includes:
a slide lock mechanism to interfere with a slide restrictor formed on the one housing, so that sliding of the slide member from the first position to the second position is restricted, in a state where the first housing and the second housing are not fitted together, and to release the interference with the slide restrictor, so that the slide member is slidable relative to the first housing and the second housing and the sliding of the slide member to the second position is allowed, in the state where the first housing and the second housing are fitted together, and
the slide restrictor is formed on the housing main body of the one housing.

2. The connector set according to claim 1, wherein
a slide member side engaging part is formed on the slide member, the slide member side engaging part being locked to a locked part formed on the other housing to restrict the sliding of the slide member to the first position when the slide member is slid to the second position.

3. The connector set according to claim 2, wherein
the locked part is formed on the housing main body of the other housing.

4. The connector set according to claim 1, wherein
a restrictor is formed on the slide member, the restrictor to restrict movement of the lever part relative to the first housing main body when the slide member is slid to the second position.

5. The connector set according to claim 1, wherein
the slide member includes:
a main body part with a handle formed thereon;
an upper arm part provided continuously on an upper part of the main body part to be capable of elastically deforming, in a state where the slide member is disposed such that the handle is located on an upper side; and a lower arm part provided continuously on a lower part of the main body part to be capable of elastically deforming, in the state where the slide member is disposed such that the handle is located on the upper side.

6. The connector set according to claim 5, wherein a retaining part is formed on the lower arm part, the retaining part to prevent the slide member from falling off the housing main body of the one housing.

7. The connector set according to claim 5, wherein a restrictor is formed on the main body part, the restrictor to restrict movement of the lever part relative to the first housing main body when the slide member is slid to the second position.

8. The connector set according to claim 5, wherein protrusions are formed on a tip of the lower arm part and a tip of the upper arm part, respectively, and thicknesses of the lower arm part and the upper arm part at locations where the protrusions are formed are larger than a gap between the lower arm part and the upper arm part.

9. The connector set according to claim 5, wherein a protrusion is formed to extend from a base side to a tip side on at least one arm part out of the lower arm part and the upper arm part, the protrusion making smaller a gap between the lower arm part and the upper arm part, and the gap between the lower arm part and the upper arm part at a location where the protrusion is formed is smaller than a thickness of the lower arm part and a thickness of the upper arm part.

10. The connector set according to claim 5, wherein a slide member side engaging part is formed on the upper arm part, the slide member side engaging part being locked to a locked part formed on the other housing to restrict the sliding of the slide member to the first position when the slide member is slid to the second position.

11. A connector set comprising:

a first connector having:

a first housing, and a first terminal held in the first housing;

a second connector having:

a second housing to be fitted to the first housing, and a second terminal held in the second housing and to come in conduction with the first terminal in a state where the first housing and the second housing are fitted together; and a slide member held in one housing out of the first housing and the second housing to be slidable between a first position and a second position, wherein:

the first housing includes:

a first housing main body holding the first terminal; and a lever part provided continuously on the first housing main body and to move relative to the first housing main body, the second housing includes:

a second housing main body holding the second terminal; and a second housing side engaging part to be engaged with the lever part in the state where the first housing and the second housing are fitted together and to maintain the fitting between the first housing and the second housing, the slide member includes:

a slide lock mechanism to interfere with a slide restrictor formed on the one housing, so that sliding of the slide member from the first position to the second position is restricted, in a state where the first housing and the second housing are not fitted together, and to release the interference with the slide restrictor, so that the sliding of the slide member to the second position is allowed, in the state where the first housing and the second housing are fitted together, and the slide restrictor is formed on the housing main body of the one housing, the slide member includes:

a main body part with a handle formed thereon;

an upper arm part provided continuously on an upper part of the main body part to be capable of elastically deforming, in a state where the slide member is disposed such that the handle is located on an upper side; and a lower arm part provided continuously on a lower part of the main body part to be capable of elastically deforming, in the state where the slide member is disposed such that the handle is located on the upper side, and a slide member side engaging part is formed on the upper arm part, the slide member side engaging part being locked to a locked part formed on the other housing to restrict the sliding of the slide member to the first position when the slide member is slid to the second position.

* * * * *